US008632620B2

(12) United States Patent
Ando et al.

(10) Patent No.: US 8,632,620 B2
(45) Date of Patent: Jan. 21, 2014

(54) HOLDING SEALING MATERIAL, EXHAUST GAS PURIFYING APPARATUS, AND METHOD FOR MANUFACTURING EXHAUST GAS PURIFYING APPARATUS

(75) Inventors: Hisashi Ando, Takahama (JP); Takahiko Okabe, Takahama (JP)

(73) Assignee: Ibiden Co., Ltd., Ogaki-shi (JP)

( * ) Notice: Subject to any disclaimer, the term of this patent is extended or adjusted under 35 U.S.C. 154(b) by 10 days.

(21) Appl. No.: 13/354,340

(22) Filed: Jan. 20, 2012

(65) Prior Publication Data

US 2012/0186210 A1 Jul. 26, 2012

(30) Foreign Application Priority Data

Jan. 20, 2011 (EP) ..... 11151512

(51) Int. Cl.

| | |
|---|---|
| ***B01D 39/14*** | (2006.01) |
| ***B01D 39/06*** | (2006.01) |
| ***B01D 24/00*** | (2006.01) |
| ***B01D 50/00*** | (2006.01) |

(52) U.S. Cl.

USPC ..... 55/523; 55/522; 55/524; 422/169; 422/170; 422/171; 422/172; 422/177; 422/178; 422/179; 422/180; 422/181; 422/182

(58) Field of Classification Search

USPC ..... 55/522–524, 282.3; 422/169–172, 422/177–182

See application file for complete search history.

(56) References Cited

U.S. PATENT DOCUMENTS

| | | | | |
|---|---|---|---|---|
| 5,465,573 | A * | 11/1995 | Abe et al. | 60/274 |
| 2003/0091480 | A1* | 5/2003 | Yamaguchi et al. | 422/179 |
| 2004/0105792 | A1 | 6/2004 | Worner et al. | |
| 2007/0053804 | A1 | 3/2007 | Agata | |
| 2007/0266686 | A1* | 11/2007 | Bruck | 55/523 |
| 2008/0041042 | A1 | 2/2008 | Sinha et al. | |

FOREIGN PATENT DOCUMENTS

| | | |
|---|---|---|
| DE | 198 19 083 | 11/1999 |
| DE | 10 2006 037 361 | 2/2008 |
| DE | 10 2007 034 832 | 1/2009 |
| DE | 10 2008 014 362 | 9/2009 |
| DE | 10 2008 047 752 | 3/2010 |
| JP | 5-269387 | 10/1993 |

* cited by examiner

*Primary Examiner* — Amber Orlando
(74) *Attorney, Agent, or Firm* — Ditthavong Mori & Steiner, P.C.

(57) ABSTRACT

A holding sealing material includes inorganic fibers, a mat shape, a first and a second end faces, a contact section and a void-forming section. The first end face and the second end face are approximately parallel in a width direction. The contact section includes a first distance between the first and the second end faces. The first distance is longest in a length direction. The void-forming section includes a second distance between the first and the second end faces. The second distance is shorter than the first distance. The holding sealing material has a structure to provide a void in a vicinity of the first and the second end faces of the void-forming section in a state where the holding sealing material is rolled up so that the first end face is made in contact with the second end face of the contact section.

31 Claims, 26 Drawing Sheets

A-A line cross-sectional view

C-C line cross-sectional view

A-A line cross-sectional view

B-B line cross-sectional view

HOLDING SEALING MATERIAL, EXHAUST GAS PURIFYING APPARATUS, AND METHOD FOR MANUFACTURING EXHAUST GAS PURIFYING APPARATUS

CROSS-REFERENCE TO RELATED APPLICATIONS

The present application claims priority under 35 U.S.C. §119 to European Patent Application No. 11151512.8 filed on Jan. 20, 2011, the contents of which are incorporated herein by reference in their entirety.

BACKGROUND OF THE INVENTION

1. Field of the Invention

The present invention relates to a holding sealing material, an exhaust gas purifying apparatus, and a method for manufacturing an exhaust gas purifying apparatus.

2. Discussion of the Background

In order to purify harmful substances such as toxic gases contained in exhaust gas discharged from an internal combustion engine such as an engine, conventionally an exhaust gas purifying apparatus is installed in an exhaust path (exhaust pipe for exhaust gas distribution, and the like) of the internal combustion engine.

The exhaust gas purifying apparatus has a structure in which a casing is provided in the exhaust path of the internal combustion engine, and an exhaust gas-treating body is disposed inside the casing. Examples of the exhaust gas-treating body include a catalyst carrier or a diesel particulate filter (DPF).

For improving the efficiency of purifying harmful substances of the exhaust gas purifying apparatus in which a catalyst is supported on the exhaust gas-treating body, temperatures in the exhaust path of the internal combustion engine and exhaust gas need to be maintained at temperatures suitable for activating the catalyst (hereinafter, also referred to as catalyst activation temperature).

As described earlier, the exhaust gas purifying apparatus in which a catalyst is supported on the exhaust gas-treating body is less likely to exert a sufficient catalytic action unless the temperature is raised to a predetermined catalyst activation temperature. Therefore, the exhaust gas purifying apparatus soon after starting the engine problematically requires a certain period of time to achieve a sufficient level of the exhaust gas purification ability.

For solving the problems, electrically heated catalyst (EHC) converters for rapidly heating a catalyst have been proposed to reduce harmful substances discharged immediately after starting the engine.

For example, JP-A 5-269387 discloses a catalytic converter (exhaust gas purifying apparatus) in which a metallic exhaust gas-treating body is provided in a metallic shell (casing), and positive and negative electrode members insulatingly connected to a metallic catalyst carrier (exhaust gas-treating body) are provided in a manner to pierce the metallic shell wall and project therefrom.

FIG. 1A is a cross-sectional view schematically showing the conventional exhaust gas purifying apparatus disclosed in JP-A 5-269387. FIG. 1B is a C-C line cross-sectional view of the conventional exhaust gas purifying apparatus shown in FIG. 1A.

In the conventional catalytic converter (exhaust gas purifying apparatus) 500 shown in FIG. 1A and FIG. 1B, metallic catalyst carriers (exhaust gas treating bodies) 530*a*, 530*b*, and 530*c* are disposed in a metallic shell (casing) 520. The outer surfaces of the metallic catalyst carriers 530*a*, 530*b*, and 530*c* are respectively connected to positive electrode members 550*a*, 550*b*, and 550*c*, and further respectively connected to negative electrode members 550*d*, 550*e*, and 550*f*, with another end of each of the positive and negative electrode members penetrating a metallic shell 520.

Moreover, in the conventional catalytic converter 500 shown in FIG. 1A and FIG. 1B, ring-shaped mat members (holding sealing material) 510*a*, 510*b*, and 510*c* are respectively disposed between peripheral faces of the metallic catalyst carriers 530*a*, 530*b*, and 530*c* and inner faces of the metallic shell 520.

The contents of JP-A 5-269387 are incorporated herein by reference in their entirety.

SUMMARY OF THE INVENTION

According to one aspect of the present invention, a holding sealing material includes inorganic fibers, a mat shape, a first end face and a second end face, a contact section and a void-forming section. The first end face and the second end face are approximately parallel in a width direction of the holding sealing material. The contact section includes a first portion of the holding sealing material. The first portion has a first distance between the first end face and the second end face. The first distance is longest in a length direction of the holding sealing material. The void-forming section includes a second portion of the holding sealing material. The second portion has a second distance between the first end face and the second end face. The second distance is shorter than the first distance of the contact section in the length direction of the holding sealing material. The holding sealing material has a structure to provide a void in a vicinity of the first end face of the void-forming section and the second end face of the void-forming section in a state where the holding sealing material is rolled up so that the first end face of the contact section is made in contact with the second end face of the contact section.

According to another aspect of the present invention, an exhaust gas purifying apparatus includes a casing, an exhaust gas-treating body housed in the casing, a holding sealing material and a void. The holding sealing material includes inorganic fibers, a mat shape, a first end face and a second end face, a contact section, and a void-forming section. The first end face and the second end face are approximately parallel in a width direction of the holding sealing material. The contact section includes a first portion of the holding sealing material. The first portion has a first distance between the first end face and the second end face. The first distance is longest in a length direction of the holding sealing material. The void-forming section includes a second portion of the holding sealing material. The second portion has a second distance between the first end face and the second end face. The second distance is shorter than the first distance of the contact section in the length direction of the holding sealing material. The holding sealing material is wound around the exhaust gas-treating body so that the first end face of the contact section faces the second end face of the contact section. The holding sealing material is disposed between the exhaust gas-treating body and the casing. The void is provided in a vicinity of the first end face and the second end face of the void-forming section in the holding sealing material.

According to further aspect of the present invention, a method for manufacturing an exhaust gas purifying apparatus includes providing a holding sealing material. The holding sealing material includes inorganic fibers, a mat shape, a first end face and a second end face, a contact section and a void-forming section. The first end face and the second end face are approximately parallel in a width direction of the holding sealing material. The contact section includes a first portion of the holding sealing material. The first portion has a first distance between the first end face and the second end face. The first distance is longest in a length direction of the holding sealing material. The void-forming section includes a second portion of the holding sealing material. The second portion has a second distance between the first end face and the second end face. The second distance is shorter than the first distance of the contact section in a length direction of the holding sealing material. The holding sealing material is wound around an exhaust gas-treating body so that the first end face of the contact section faces the second end face of the contact section and so that a void is provided in a vicinity of the first end face and the second end face of the void-forming section in the holding sealing. The exhaust gas-treating body is housed in a casing to dispose the holding sealing material between the exhaust gas-treating body and the casing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1A:
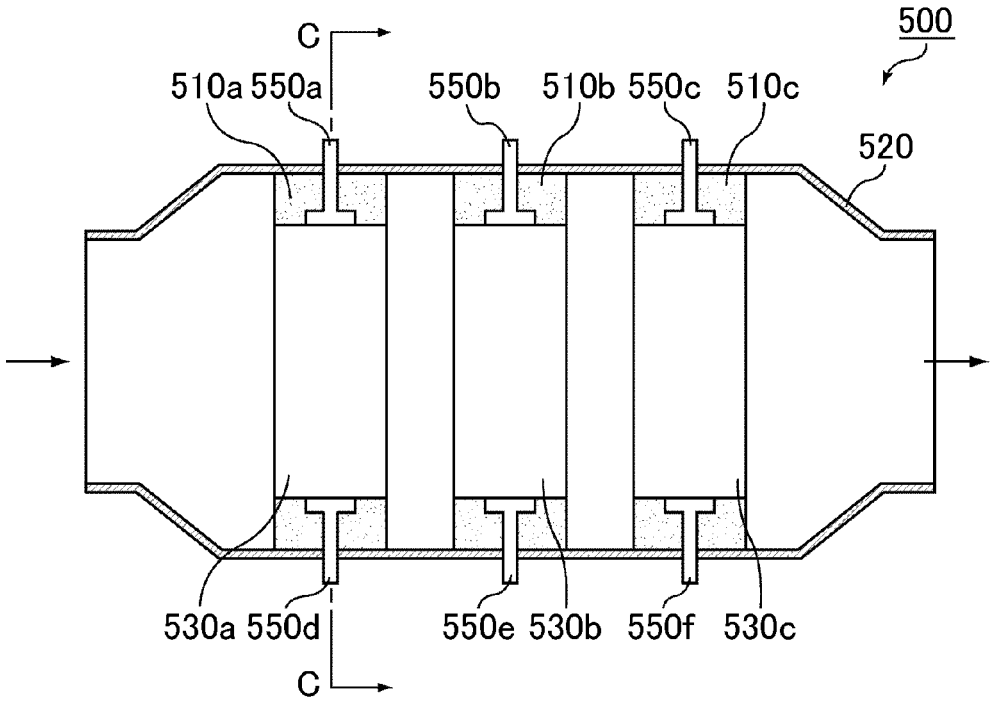
FIG.1A Background Art
FIG. 1A is a cross-sectional view schematically showing an example of a conventional exhaust gas purifying apparatus.
Figure 1B:
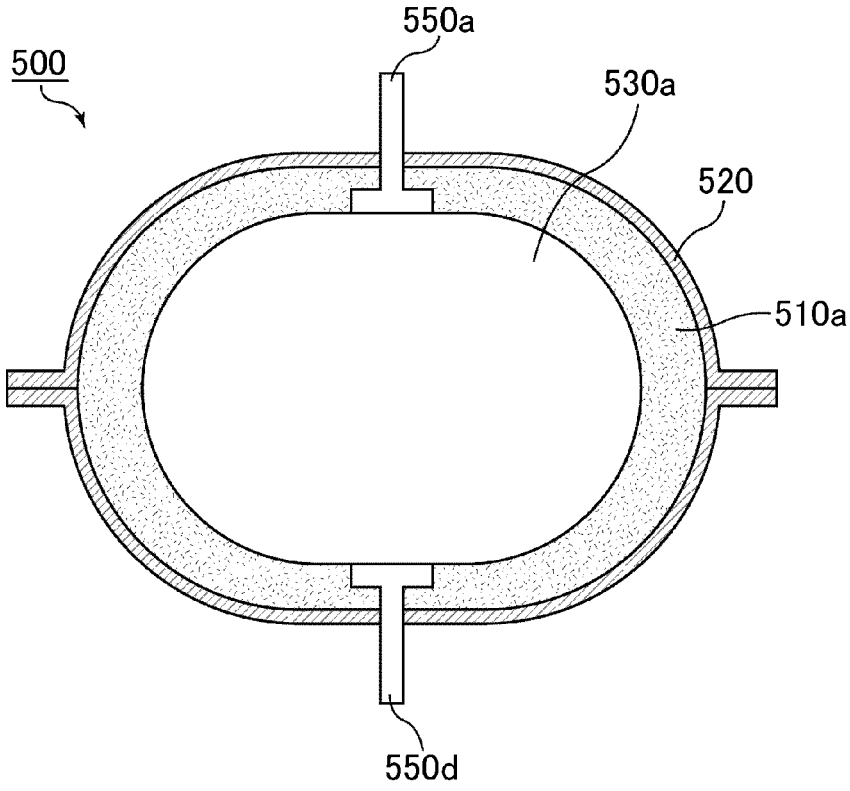
FIG.1B Background Art
FIG. 1B is a C-C line cross-sectional view of the conventional exhaust gas purifying apparatus shown in FIG. 1A.

In an electrically heated catalyst converter which is one type of exhaust gas purifying apparatuses, the electrode member penetrates the casing, passes through the holding sealing material, and then contacts the exhaust gas-treating body. Further, a sensor for measuring the temperature of the exhaust gas-treating body may penetrate the casing, pass through the holding sealing material, and contact the exhaust gas-treating body.

In the embodiments of the present invention, it is allowed to provide a holding sealing material which makes it easier to dispose the electrode member and/or sensor (hereinafter, electrode member and/or sensor is also referred to as electrode member and the like) when used in the exhaust gas purifying apparatus, an exhaust gas purifying apparatus using the holding sealing material, and a method for manufacturing the exhaust gas purifying apparatus.

In the embodiments of the present invention, the electrode member and/or sensor are easier to be disposed by forming the holding sealing material into a shape which forms a void at the end face of the holding sealing material when the holding sealing material is wound around the exhaust gas-treating body.

The holding sealing material according to the embodiment of the present invention includes a mat-shaped holding sealing material including inorganic fibers, including a first end face and a second end face which are approximately parallel in a width direction of the holding sealing material, and a contact section including a portion with a longest distance between the first end face and the second end face in a length direction of the holding sealing material and a void-forming section which is shorter than the contact section in the distance between the first end face and the second end face in a length direction of the holding sealing material, wherein a void is formed in a neighborhood of the first end face of the void-forming section and the second end of the void-forming section when the holding sealing material is rolled up so that the first end face of the contact section is made in contact with the second end face of the contact section.

The holding sealing material according to the embodiment of the present invention has the first end face and the second end face which are approximately parallel in the width direction of the holding sealing material. In the holding sealing material according to the embodiment of the present invention, a contact section including a portion with a longest distance between the first end face and the second end face in a length direction of the holding sealing material and a void-forming section which is shorter than the contact section in the distance between the first end face and the second end face are formed.

Owing to this structure, when the holding sealing material according to the embodiment of the present invention is rolled up to make the first end face in contact with the second end face, the first end face and the second end face in the void-forming section of the holding sealing material cannot contact each other. As a result, a void is formed in the neighborhood of the first end face and the second end of the void-forming section.

Thus, it may become easier to dispose an electrode member and/or a sensor at the void upon manufacturing an exhaust gas purifying apparatus using the holding sealing material according to the embodiment of the present invention.

Use of the holding sealing material according to the embodiment of the present invention makes it easier to dispose an electrode member and/or a sensor without forming through holes in the holding sealing material. Since punching process or the like for forming through holes is not necessary in manufacturing the holding sealing material, problems arising from complex manufacturing process tend not to occur in manufacturing the holding sealing material.

If through holes are formed in the holding sealing material, retention of the holding sealing material tends to decrease because the area of the holding sealing material decreases by the area of the through holes.

Meanwhile, in the case of forming a void in the holding sealing material, even if a void with an area smaller than that of the through hole is formed, an electrode member and/or a sensor are more likely to be disposed at the formed void. Accordingly, it may become easier to prevent the problem of reduced retention of the holding sealing material arising from reduction in the area of the holding sealing material.

Moreover, if through holes are formed in the holding sealing material, the area of the holding sealing material in the width direction is reduced, which is more likely to deteriorate the tensile strength of the holding sealing material.

In contrast, in the case of forming a void in the holding sealing material, the tensile strength of the holding sealing material is more likely to be prevented from decreasing because reduction in the area of the holding sealing material in the width direction is more likely to be avoided. Therefore, it may become easier to avoid assembly defects which may occur when the holding sealing material is pulled for assembling it into the exhaust gas-treating body, such as breakage or overlapping of the holding sealing material. Overlapping used herein means excessive winding of the holding sealing material that may occur when a holding sealing material having through holes formed therein is assembled in the exhaust gas-treating body due to overstretching of the holding sealing material upon pulling the holding sealing material.

In the holding sealing material according to the embodiment of the present invention, at least one of the first end face and the second end face in the void-forming section of the holding sealing material preferably has an end-face notch which is formed in the length direction of the holding sealing material.

The holding sealing material having an end face with the aforementioned shape tends to form a void when the holding sealing material is rolled up.

The holding sealing material according to the embodiment of the present invention preferably has a step formed by at least one projected portion in at least one of the first end face and the second end face.

In the case a step is provided in the first end face and the second end face of the holding sealing material, the holding sealing material tends to fit due to the projected portion. Therefore, exhaust gas is less likely to leak from the engaged portion, and thus exhaust gas sealing properties of the holding sealing material is more likely to be maintained. Moreover, in the case a step is provided in the first end face and the second end face of the holding sealing material, the holding sealing material tends to fit due to the projected portion. Therefore, even if force is applied on the exhaust gas purifying apparatus in the width direction of the holding sealing material, the holding sealing material tends not to be displaced in the exhaust gas purifying apparatus.

In the holding sealing material according to the embodiment of the present invention, the length of the projected portion in the void-forming section of the holding sealing material may be shorter than the length of the projected portion in the contact section of the holding sealing material in the length direction of the holding sealing material.

In the holding sealing material according to the embodiment of the present invention, the projected portion in the void-forming section of the holding sealing material may have a projected-portion notch which is formed in the length direction of the holding sealing material.

In the holding sealing material according to the embodiment of the present invention, an end face opposite to the projected portion in the void-forming section of the holding sealing material may have an opposite-portion notch which is formed in the length direction of the holding sealing material.

These holding sealing materials each have the void-forming section with the aforementioned shape, and thus the void tends to be formed when the holding sealing material is rolled up.

In the holding sealing material according to the embodiment of the present invention, a penetration portion penetrating the holding sealing material in the thickness direction of the holding sealing material is preferably formed.

The penetration portion is preferably formed in the holding sealing material according to the embodiment of the present invention as mentioned earlier. In the case of manufacturing an exhaust gas purifying apparatus using the above holding sealing material, an electrode member and the like are more likely to be disposed not only at the void formed at least one fitting portion but at the penetration portion of the holding sealing material as well.

The exhaust gas purifying apparatus according to the embodiment of the present invention includes a casing, an exhaust gas-treating body housed in the casing, and a holding sealing material wound around the exhaust gas-treating body and disposed between the exhaust gas-treating body and the casing, wherein the holding sealing material is the holding sealing material according to the embodiments of the present invention, and a void is formed in a neighborhood of a first end face and a second end face of a void-forming section in the holding sealing material wound around the exhaust gas-treating body.

In the exhaust gas purifying apparatus according to the embodiment of the present invention, a void is formed in the neighborhood of the first end face and the second end face in the void-forming section of the holding sealing material wound around the exhaust gas-treating body. Therefore it may become easier to dispose members which penetrate the casing to be connected to the exhaust gas-treating body at the void.

The exhaust gas purifying apparatus according to the embodiment of the present invention preferably further includes at least one of an electrode member and a sensor which is connected to the exhaust gas-treating body, passes through the holding sealing material, and penetrates the casing, wherein the at least one of the electrode member and the sensor is preferably disposed at the void of the holding sealing material.

As mentioned above, in the exhaust gas purifying apparatus, an electrode member and/or a sensor are more likely to be disposed at the void formed in the holding sealing material. Especially, the exhaust gas purifying apparatus having an electrode member disposed at the void is more likely to be used as an electrically heated catalyst converter.

The exhaust gas purifying apparatus according to the embodiment of the present invention preferably includes at least one of another electrode member and another sensor which is connected to the exhaust gas-treating body, passes through the holding sealing material, and penetrates the casing, wherein the holding sealing material is the holding sealing material which has a penetration portion penetrating the holding sealing material in the thickness direction of the holding sealing material, and the at least one of another electrode member and another sensor is preferably disposed at the penetration portion in the holding sealing material.

This structure makes it easier to dispose an electrode member and the like not only at the void formed at least one fitting portion of the holding sealing material but at the penetration portion as well.

The method for manufacturing an exhaust gas purifying apparatus according to the embodiment of the present invention is a method for manufacturing an exhaust gas purifying apparatus including a casing, an exhaust gas-treating body housed in the casing, and a holding sealing material wound around the exhaust gas-treating body and disposed between the exhaust gas-treating body and the casing, and the method includes forming a void in the neighborhood of a first end face and a second end face of a void-forming section in the holding sealing material wound around the exhaust gas-treating body by using the holding sealing material according to the embodiments of the present invention as the holding sealing material.

The method for manufacturing an exhaust gas purifying apparatus according to the embodiment of the present invention preferably includes disposing at least one of an electrode member and a sensor in a manner that the at least one of the electrode member and the sensor is connected to the exhaust gas-treating body, passes through the holding sealing material, and penetrates the casing, wherein the at least one of the electrode member and the sensor is preferably disposed at the void of the holding sealing material.

The method for manufacturing an exhaust gas purifying apparatus according to the embodiment of the present invention preferably further includes disposing at least one of another electrode member and another sensor in a manner that the at least one of another electrode member and another sensor is connected to the exhaust gas-treating body, passes through the holding sealing material, and penetrates the casing, wherein the holding sealing material which has a penetration portion penetrating the holding sealing material in the thickness direction of the holding sealing material is used as the holding sealing material, and the at least one of another electrode member and another sensor is preferably disposed at the penetration portion in the holding sealing material.

In the methods for manufacturing an exhaust gas purifying apparatus according to the embodiments of the present invention, each of the exhaust gas purifying apparatuses according to the embodiments of the present invention are more likely to be preferably manufactured.

The embodiments will now be described with reference to the accompanying drawings, wherein like reference numerals designate corresponding or identical elements throughout the various drawings. The present invention is not limited to embodiments below and can be appropriately applicable to other embodiments in the scope that does not change the gist of the present invention.

First Embodiment

Referring to the drawings, the following will describe the first embodiment that is one of the embodiments of the holding sealing material, the exhaust gas purifying apparatus, and the method for manufacturing an exhaust gas purifying apparatus according to the present invention.

First, the holding sealing material according to the first embodiment of the present invention is described.

Figure 2:
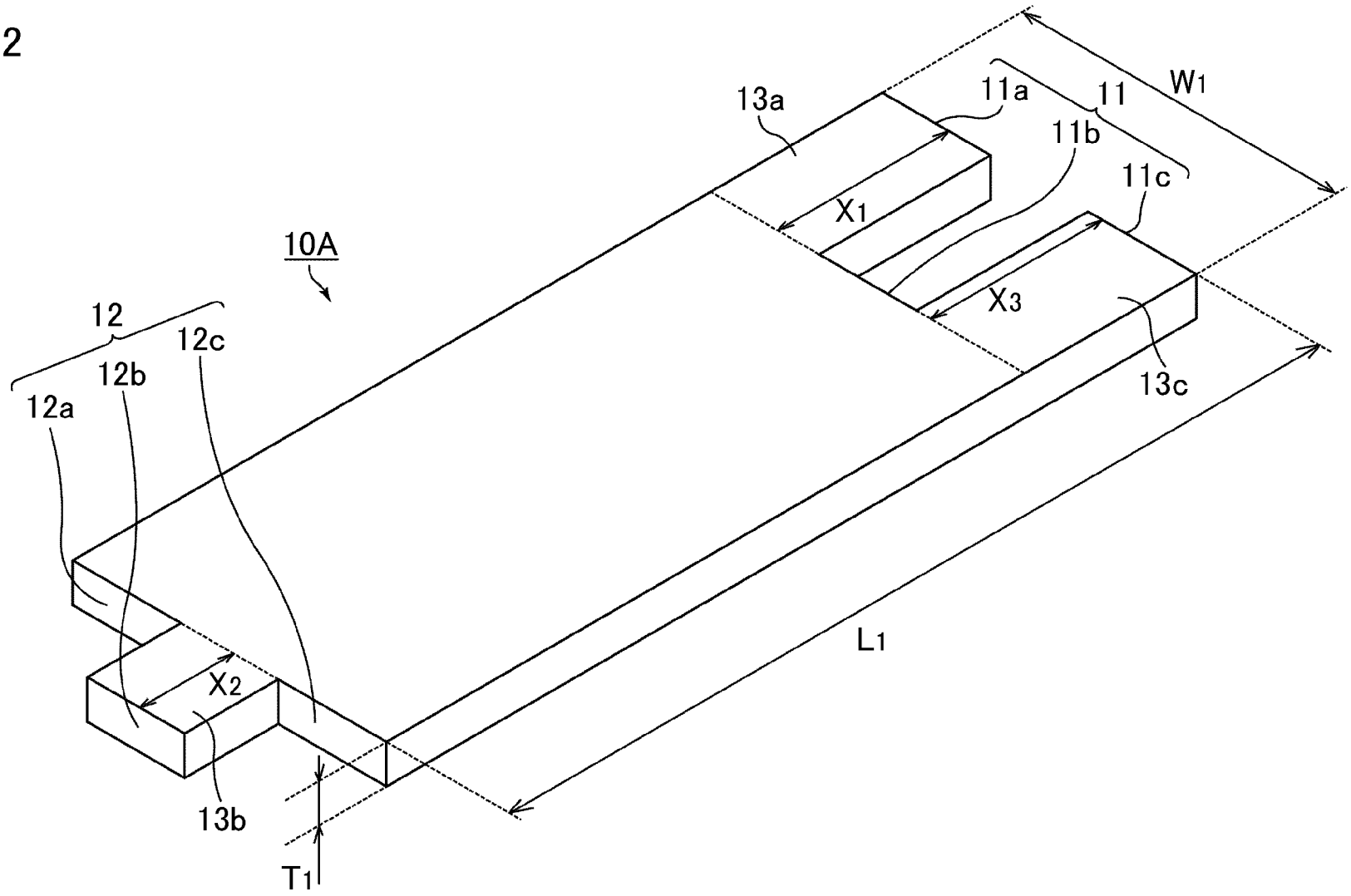
FIG. 2 is a perspective view schematically showing an example of a holding sealing material according to a first embodiment of the present invention.

FIG. 2 is a perspective view schematically showing an example of the holding sealing material according to the first embodiment of the present invention.

A holding sealing material 10A illustrated in FIG. 2 includes inorganic fibers such as alumina-silica fibers and has a mat shape. More specifically, the holding sealing material 10A has a plain plate shape with an approximately rectangular shape in a plain view having a predetermined length (shown by an arrow $L_1$ in FIG. 2), a predetermined width (shown by an arrow $W_1$ in FIG. 2), and a predetermined thickness (shown by an arrow $T_1$ in FIG. 2). Moreover, the holding sealing material 10A has first end face 11 (11*a*, 11*b*, and 11*c*) and second end face 12 (12*a*, 12*b*, and 12*c*) that are approximately parallel in the width $W_1$ direction of the holding sealing material 10A.

Meanwhile, the expression "the length of the holding sealing material in a length direction" used herein refers to the distance between the first end face and the second end face in the length direction of the holding sealing material. Additionally, "the length of the holding sealing material in a length direction" is also simply called "the length of the holding sealing material."

In the holding sealing material of the present embodiment, each of the first end face and the second end face has a step formed by at least one projected portion.

In the holding sealing material 10A shown in FIG. 2, two projected portions 13*a* and 13*c* are formed at the first end face 11, and one projected portion 13*b* is formed at the second end face 12.

As mentioned earlier, in the holding sealing material 10A illustrated in FIG. 2, each of the first end face 11 and the second end face 12 has three levels of steps.

Figure 3A:
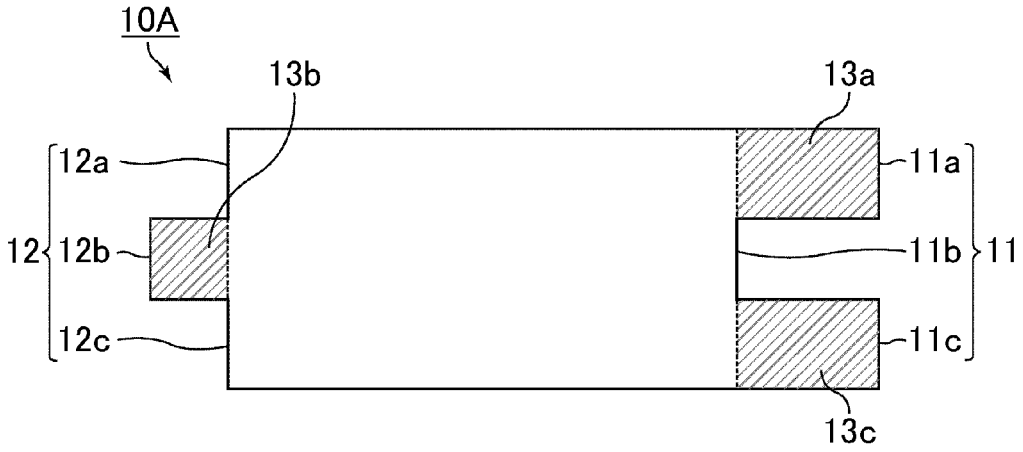
FIG. 3A and FIG. 3B each are a plain view of the holding sealing material shown in FIG. 2.
Figure 3B:
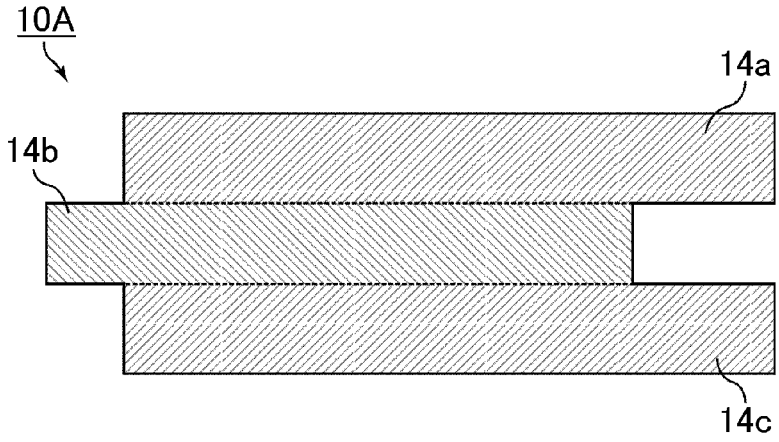

FIG. 3A and FIG. 3B each are a plain view of the holding sealing material shown in FIG. 2.

FIG. 3A shows specific locations of the projected portions 13*a*, 13*b*, and 13*c* formed in the holding sealing material 10A.

As used herein, the expression "projected portion" refers to the following region.

Namely, the "projected portion" refers to a portion of the holding sealing material between an end face including the start point of a step and an end face including the end point of the step in the end faces (first end face or second end face) of the holding sealing material. Therefore, the projected portion of the holding sealing material exists at both of the side of the first end face and the side of the second end face of the holding sealing material.

The holding sealing material of the present embodiment has a contact section including a portion with a longest distance between the first end face and the second end face in a length direction of the holding sealing material and a void-forming section which is shorter than the contact section in the distance between the first end face and the second end face.

As used herein, the expressions "contact section" and "void-forming section" refer to the following regions.

First, consideration is given to the regions each formed by extending each projected portion of the holding sealing material to the opposite end face in the length direction of the holding sealing material. Among the regions, the region including a portion with the longest distance between the first end face and the second end face in the length direction of the holding sealing material is called "contact section" and the region including a portion which is shorter than the contact section in the distance between the first end face and the second end face is called "void-forming section."

In the holding sealing material according to the present embodiment, the length of the projected portion in the void-forming section is shorter than the length of the projected portion in the contact section in the length direction of the holding sealing material.

Hereinafter, the length of the projected portion in the length direction of the holding sealing material may also be simply called "the length of the projected portion."

In the holding sealing material 10A illustrated in FIG. 2, the length (shown by an arrow $X_2$ in FIG. 2) of the projected portion 13*b* in the length $L_1$ direction of the holding sealing material 10A is shorter than the length (shown by an arrow $X_1$ in FIG. 2) of the projected portion 13*a* and the length (shown by an arrow $X_3$ in FIG. 2) of the projected portion 13*c* in the length $L_1$ direction of the holding sealing material 10A.

Provided that the length of the projected portion 13*a* and the length of the projected portion 13*c* are approximately the same in the holding sealing material 10A illustrated in FIG. 2, the region including the projected portion 13*a* and the region including the projected portion 13*c* are contact sections, and the region including the projected portion 13*b* is a void-forming section. FIG. 3B shows specific locations of contact sections 14*a* and 14*c*, and a void-forming section 14*b* formed in the holding sealing material 10A.

As shown in FIG. 2, the holding sealing material according to the first embodiment of the present invention has the structure in which the first end face and the second end face of the holding sealing material are approximately perpendicular to the length direction of the holding sealing material. In the case of holding sealing materials having a structure in which the first end face and the second end face of the holding sealing material are not approximately perpendicular to the length direction of the holding sealing material, the holding sealing materials are considered to have a notch in the first end face or the second end face, and are included in the below-mentioned second embodiment or third embodiment of the present invention.

In the holding sealing material of the present embodiment, a void is formed in the neighborhood of the first end face of the void-forming section and the second end of the void-forming section when the holding sealing material is rolled up so that the first end face of the contact section is made in contact with the second end face of the contact section.

Figure 4:
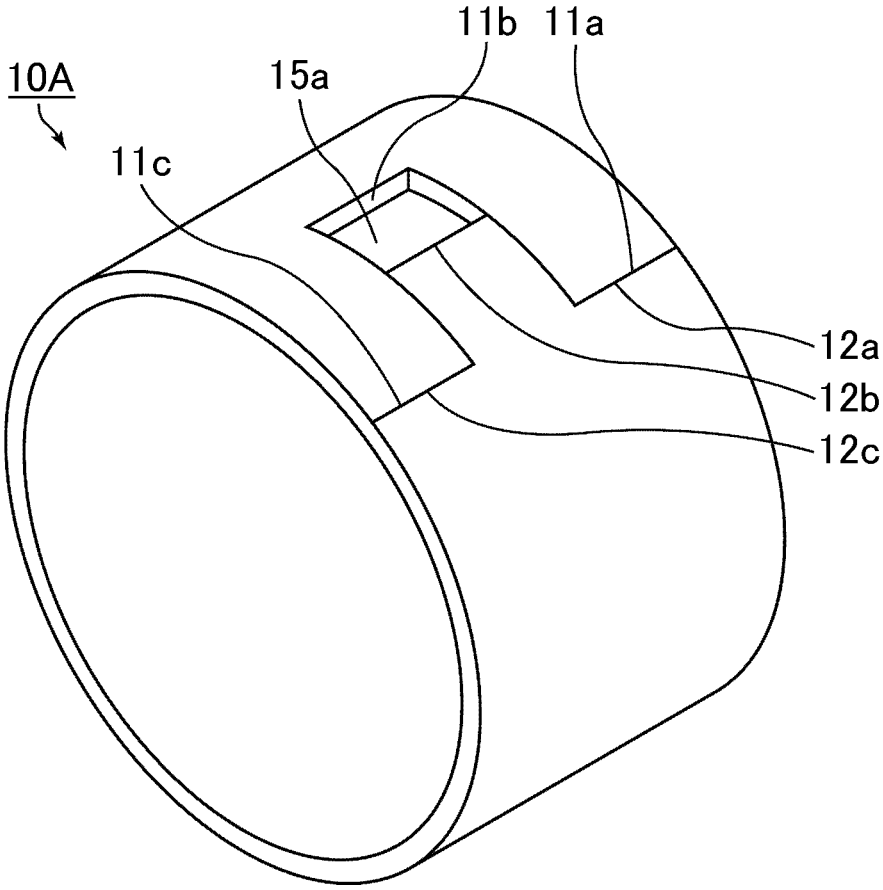
FIG. 4 is a perspective view schematically illustrating the holding sealing material shown in FIG. 2 in a rolled-up shape.

FIG. 4 is a perspective view schematically showing the holding sealing material shown in FIG. 2 in a rolled-up shape.

When the holding sealing material 10A illustrated in FIG. 2 is rolled up, in the contact section, contact between the first end face 11*a* and the second end face 12*a* and contact between the first end face 11*c* and the second end face 12*c* are more likely to be achieved. Meanwhile, in the void-forming section, the first end face 11*b* does not contact the second end face 12*b*. As a result, a void 15*a* is formed in the neighborhood of the first end face 11*b* and the second end face 12*b*.

Accordingly, when the holding sealing material 10A illustrated in FIG. 2 is rolled up, the convex formed by the projected portion 13*b* does not fully engage with the concave formed by the projected portions 13*a* and 13*c* so that the void 15*a* is formed.

As used herein, the expression "holding sealing material is rolled up" means that the holding sealing material is wound around a body to be wound, such as an exhaust gas-treating body and the like.

Figure 5A:
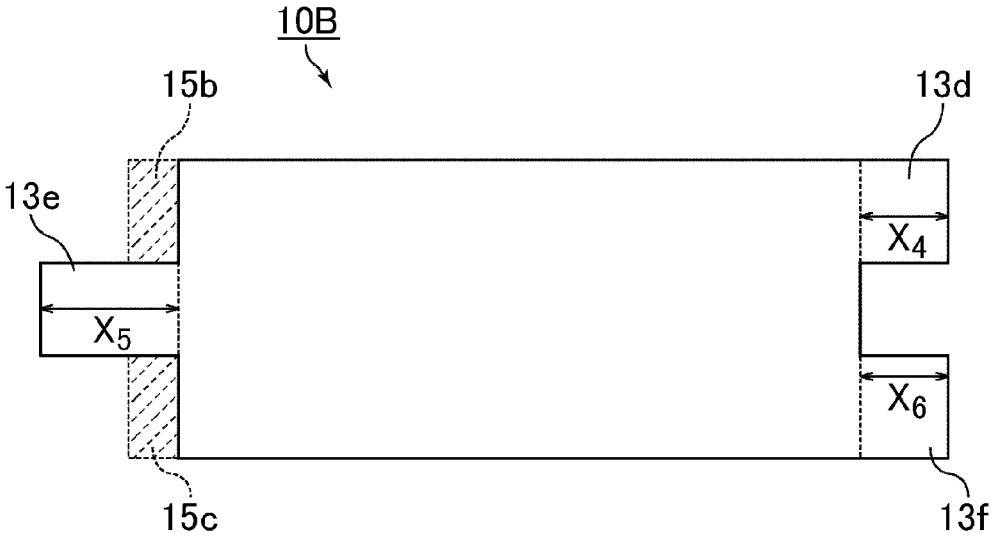
FIG. 5A and FIG. 5B each are a plain view schematically showing other example of the holding sealing material according to the first embodiment of the present invention.
Figure 5B:
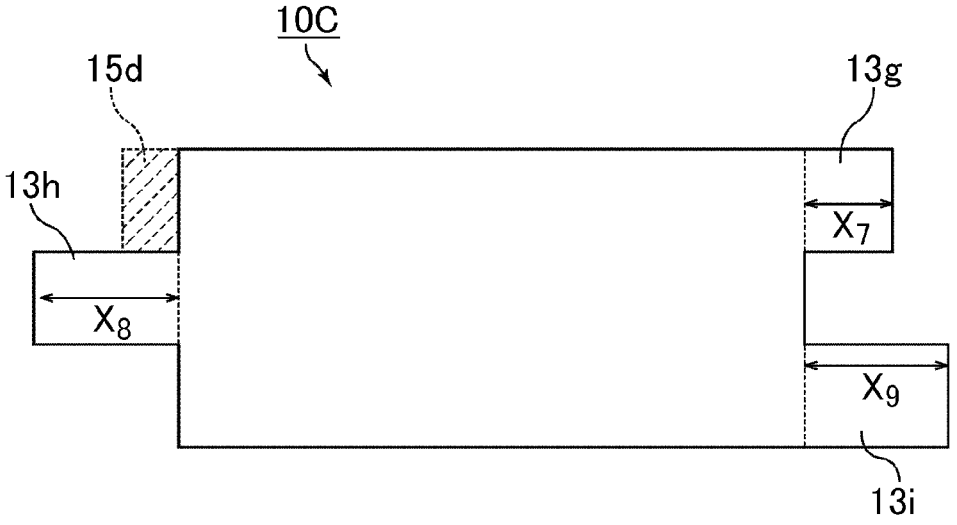

FIG. 5A and FIG. 5B each are a plain view schematically showing other example of the holding sealing material according to the first embodiment of the present invention.

In the holding sealing material of the present embodiment, as shown in a holding sealing material 10B illustrated in FIG. 5A, both of the length $X_4$ of a projected portion 13*d* and the length $X_6$ of a projected portion 13*f* may be shorter than the length $X_5$ of a projected portion 13*e*. When the holding sealing material 10B is rolled up, voids 15*b* and 15*c* are formed.

Moreover, in the holding sealing material of the present embodiment, as shown in a holding sealing material 10C in FIG. 5B, the length $X_7$ of a projected portion 13*g* may be shorter than the length $X_8$ of a projected portion 13*h* and the length $X_9$ of a projected portion 13*i*. When the holding sealing material 10C is rolled up, a void 15*d* is formed.

In the holding sealing material of the present embodiment, the length of all the projected portions may be different from one another.

In the holding sealing material of the present embodiment, the length of the projected portion in the void-forming section of the holding sealing material is preferably from about 1% to about 90% and more preferably from about 35% to about 75% the length of the projected portion in the contact section of the holding sealing material.

If the length of the projected portion in the void-forming section of the holding sealing material is about 1% or more of the length of the projected portion in the contact section of the holding sealing material, the area of the holding sealing material is less likely to be reduced. As a result, retention of the holding sealing material tends not to decrease. If the length of the projected portion in the void-forming section of the holding sealing material is about 90% or less of the length of the projected portion in the contact section of the holding sealing material, a void with a sufficient area may become easier to be formed in the neighborhood of the first end face and the second end face of the holding sealing material upon rolling up the holding sealing material. Thus, an electrode member and/or a sensor may be easily disposed at the void.

Specifically, in the holding sealing material of the present embodiment, the length of the projected portion in the void-forming section of the holding sealing material is shorter, preferably by from about 1 mm to about 100 mm and more preferably by from about 20 mm to about 40 mm than the length of the projected portion in the contact section of the holding sealing material.

If the length of the projected portion in the void-forming section of the holding sealing material is about 1 mm or more shorter than the length of the projected portion in the contact section of the holding sealing material, a void with a sufficient area may become easier to be formed in the neighborhood of the first end face and the second end face of the holding sealing material upon rolling up the holding sealing material. Thus, an electrode member and/or a sensor may become easier to be disposed at the void. If the length of the projected portion in the void-forming section of the holding sealing material is about 100 mm or less shorter than the length of the projected portion in the contact section of the holding sealing material, the area of the holding sealing material tends not to be reduced. As a result, retention of the holding sealing material tends not to decrease.

In the holding sealing material of the present embodiment, the cross-sectional area (cross-sectional area in approximately parallel with the main face of the holding sealing material) of the void formed upon making the first end face in contact with the second end face in the contact section of the holding sealing material is preferably from about 1 $mm^2$ to about 10000 $mm^2$, and more preferably from about 400 $mm^2$ to about 1600 $mm^2$.

In the case that the cross-sectional area of the void is about 1 $mm^2$ or more, disposing an electrode member or the like at the void may become easier in use of the holding sealing material in the exhaust gas purifying apparatus. In the case that the cross-sectional area of the void is about 10000 $mm^2$ or less, the area of the holding sealing material is not too small, which tends not to deteriorate the retention of the holding sealing material.

The holding sealing material of the present embodiment may include a binder such as an organic binder. The binder included in the holding sealing material may become easier to bond the inorganic fibers forming the holding sealing material to one another. Therefore, it may become easier to reduce the volume of the holding sealing material upon stuffing the holding sealing material into the casing, or to prevent the inorganic fibers from scattering.

The holding sealing material of the present embodiment may be a needle mat obtained by carrying out a needling treatment on a base mat including inorganic fibers.

The needling treatment refers to a treatment in which needles or the like serving as a fiber entangling means are inserting and withdrawing to and from the base mat. In the holding sealing material subjected to the needling treatment, inorganic fibers having a comparatively long fiber length are more likely to be three-dimensionally entangled with one another. As a result, the strength of the needle mat is more likely to be improved.

The holding sealing material of the present embodiment can be manufactured, for example, by punching the base mat prepared by entangling the inorganic fibers with one another in a desired shape by a spinning method.

Next, an exhaust gas purifying apparatus according to the first embodiment of the present invention will be described.

Figure 6A:
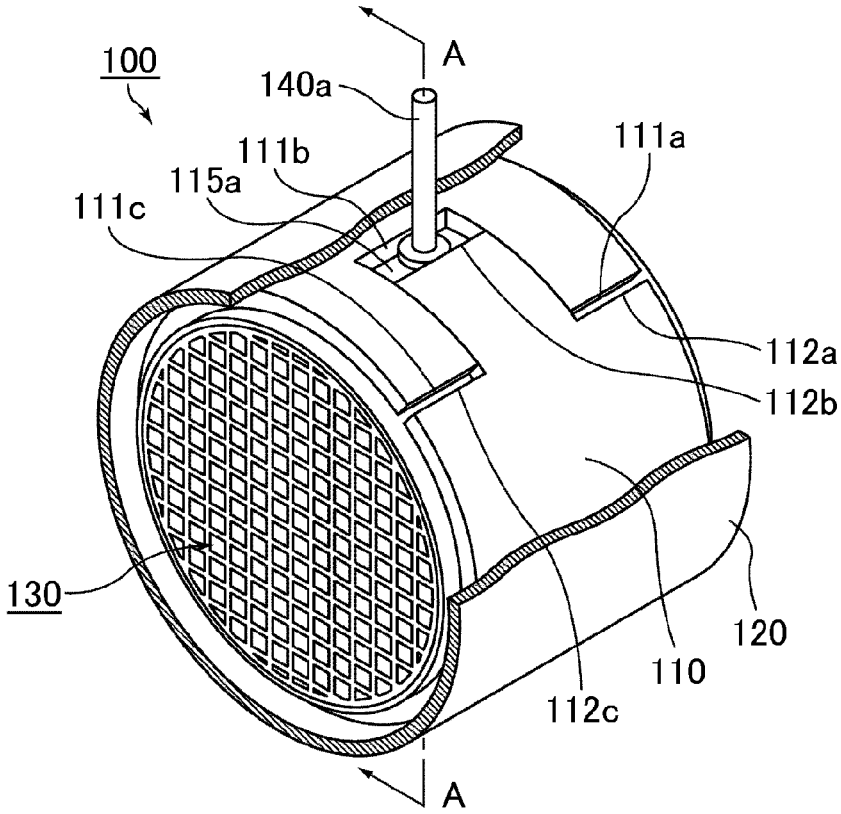
FIG. 6A is a perspective cross-sectional cutaway view schematically showing an example of an exhaust gas purifying apparatus according to the first embodiment of the present invention.
Figure 6B:
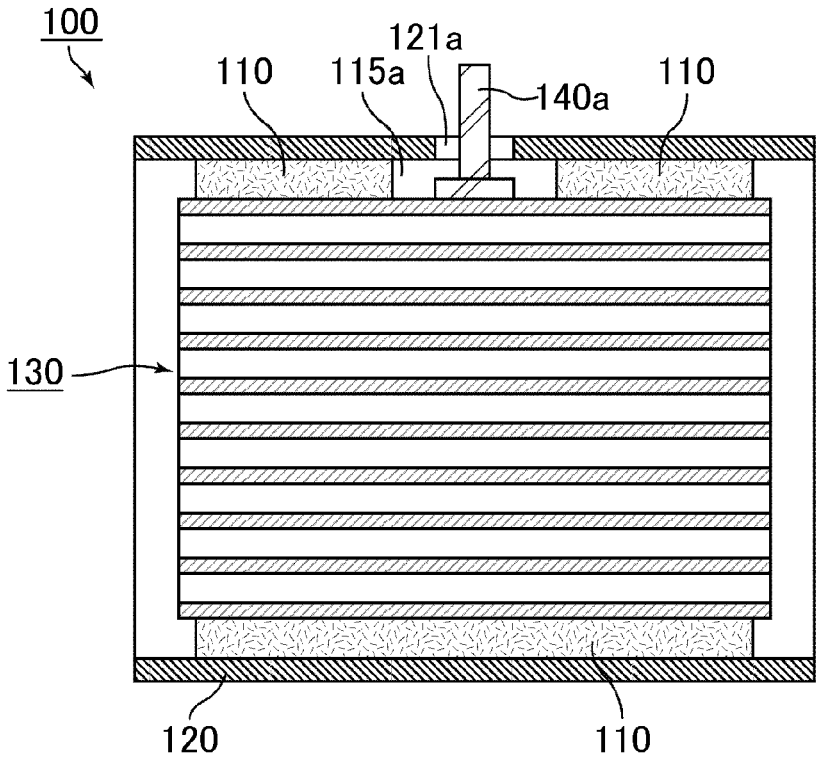
FIG. 6B is an A-A line cross-sectional view of the exhaust gas purifying apparatus shown in FIG. 6A.

FIG. 6A is a perspective cross-sectional cutaway view schematically showing an example of an exhaust gas purifying apparatus according to the first embodiment of the present invention. FIG. 6B is an A-A line cross-sectional view of the exhaust gas purifying apparatus shown in FIG. 6A.

An exhaust gas purifying apparatus 100 shown in FIG. 6A and FIG. 6B includes a casing 120, an exhaust gas-treating body 130 housed in the casing 120, and a holding sealing material 110 disposed between the exhaust gas-treating body 130 and the casing 120.

The exhaust gas purifying apparatus 100 further includes a sensor 140*a* which is connected to the exhaust gas-treating body 130, passes through the holding sealing material 110, and penetrates the casing 120.

The holding sealing material 110 is wound around the exhaust gas-treating body 130. The exhaust gas-treating body 130 is held by the holding sealing material 110.

An inlet pipe for introducing exhaust gas discharged from the internal combustion engine and an exhaust pipe for discharging the exhaust gas having passed through the exhaust gas-treating body to the outside are connected to an end of the casing 120, if necessary.

The following description will discuss the holding sealing material forming the exhaust gas purifying apparatus of the present embodiment.

The exhaust gas purifying apparatus of the present embodiment uses the holding sealing material of the present embodiment.

FIG. 6A and FIG. 6B show an example of an exhaust gas purifying apparatus 100 in which the holding sealing material 10A illustrated in FIG. 2 is used as the holding sealing material 110.

As shown in FIG. 6A and FIG. 6B, a void 115*a* is formed in the neighborhood of a first end face 111*b* and a second end face 112*b* in the void-forming section of the holding sealing material 110 which is wound around an exhaust gas-treating body 130. A sensor 140*a* is disposed at the void 115*a*.

In the exhaust gas purifying apparatus of the present embodiment, the first end face and the second end face in the contact section of the holding sealing material may contact each other without a gap or may form a gap with a predetermined size.

In the case where a gap is formed between the first end face and the second end face in the contact section of the holding sealing material, an electrode member and/or a sensor are more likely to be disposed at the gap. In the case that a gap is formed between the first end face and the second end face in the contact section of the holding sealing material, the distance between the first end face and the second end face in the contact section of the holding sealing material is preferably about 80 mm or less, more preferably from about 5 mm to about 80 mm, and further preferably from about 5 mm to about 20 mm. If the distance between the first end face and the second end face in the contact section of the holding sealing material is about 80 mm or less, the area of the holding sealing material that contacts the exhaust gas-treating body tends not to decrease. The holding sealing material is thus more likely to hold the exhaust gas-treating body. If the distance between the first end face and the second end face in the contact portion of the holding sealing material is about 5 mm or more, the gap is not too small. Thus, an electrode member and/or a sensor may become easier to be disposed at the gap.

The following description will discuss the exhaust gas-treating body forming the exhaust gas purifying apparatus of the present embodiment.

Figure 7:
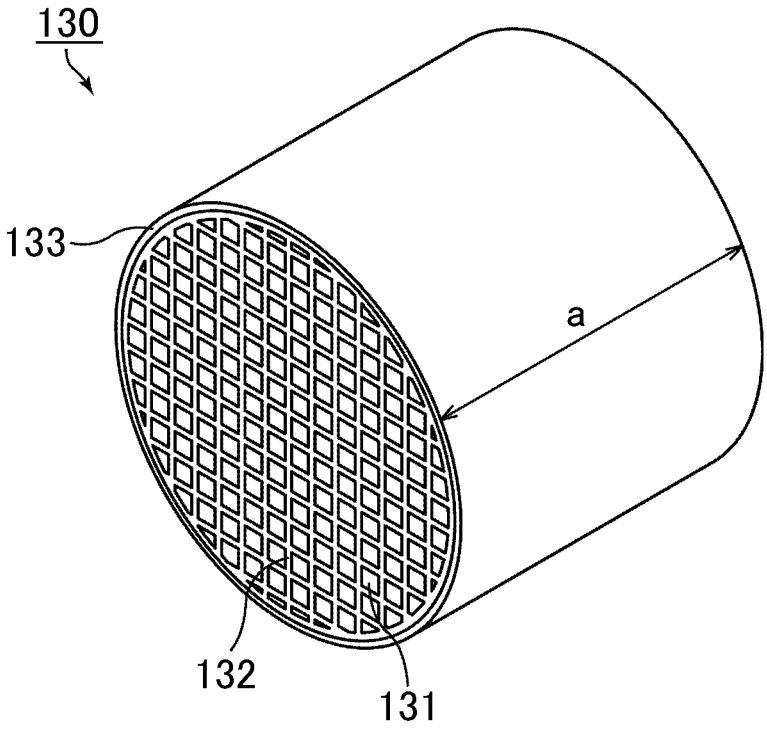
FIG. 7 is a perspective view schematically showing an example of an exhaust gas-treating body forming the exhaust gas purifying apparatus according to the first embodiment of the present invention.

FIG. 7 is a perspective view schematically showing an example of an exhaust gas-treating body forming the exhaust gas purifying apparatus according to the first embodiment of the present invention.

FIG. 7 illustrates a catalyst carrier as an example of the exhaust gas-treating body.

As shown in FIG. 7, the exhaust gas-treating body 130 mainly includes a porous ceramic material and has a approximately round pillar-shape. Moreover, a coat layer 133 is formed on the outer periphery of the exhaust gas-treating body 130 so as to reinforce the outer peripheral portion of the exhaust gas-treating body 130, to adjust the shape and to improve the heat insulating property of the exhaust gas-treating body 130. Meanwhile, the coat layer may be formed, if necessary.

The exhaust gas-treating body 130 shown in FIG. 7 is a honeycomb structure in which a large number of through holes 131 are placed in parallel with one another in the longitudinal direction (in FIG. 7, a direction indicated by a double-headed arrow "a"), with a separation wall 132 interposed therebetween.

In the exhaust gas-treating body 130, a catalyst for converting toxic gas components contained in exhaust gas such as CO, HC, and NOx is supported on the separation wall 132 of the honeycomb structure. Examples of the catalyst include platinum.

The following description will discuss the casing forming the exhaust gas purifying apparatus of the present embodiment.

Figure 8:
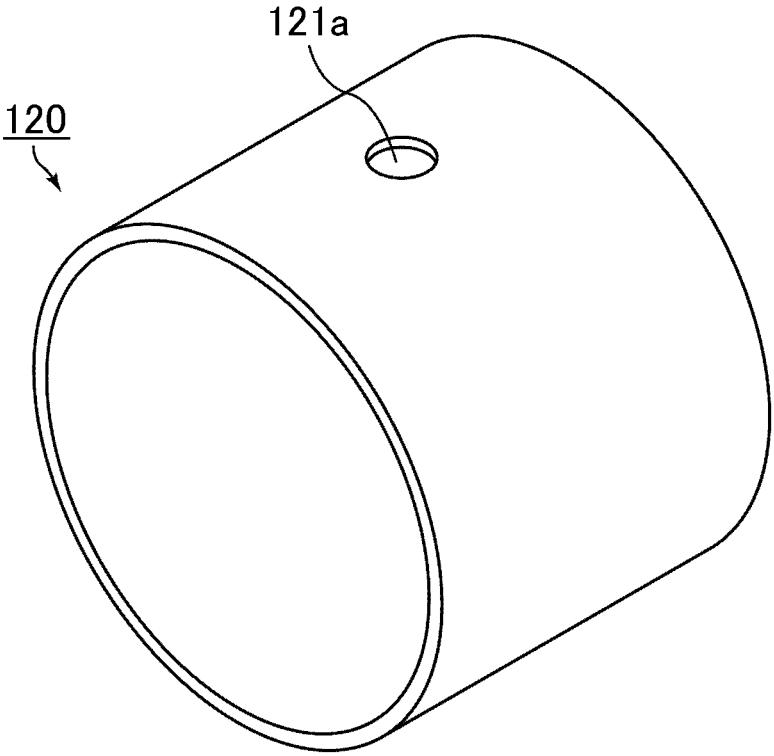
FIG. 8 is a perspective view schematically showing an example of a casing forming the exhaust gas purifying apparatus according to the first embodiment of the present invention.

FIG. 8 is a perspective view schematically showing an example of a casing forming the exhaust gas purifying apparatus according to the first embodiment of the present invention. The casing 120 shown in FIG. 8 is mainly made of metal such as stainless steel, and has an approximately cylindrical shape. The casing 120 has a hole 121*a* for allowing a sensor to penetrate therein.

The inner diameter of the casing 120 is made slightly shorter than a sum of the diameter of an end face of the exhaust gas-treating body 130 shown in FIG. 7 and the thickness of the holding sealing material wound around the exhaust gas-treating body 130.

Meanwhile, the length of the casing may be slightly longer than the longitudinal direction length of the exhaust gas-treating body and may approximately the same with the longitudinal direction length of the exhaust gas-treating body.

In the exhaust gas purifying apparatus 100 illustrated in FIG. 6A and FIG. 6B, the location of the void 115*a* formed in the neighborhood of the first end face and the second end face in the void-forming section of the holding sealing material 110 corresponds with the location of the hole 121*a* of the casing 120. The sensor 140*a* is disposed at the void 115*a* formed in the neighborhood of the first end face and the second end face in the void-forming section of the holding sealing material 110 and in the hole 121*a* of the casing 120.

The following description will discuss a sensor forming the exhaust gas purifying apparatus of the present embodiment.

The kinds of the sensor in the exhaust gas purifying apparatus of the present embodiment are not particularly limited. Examples of the sensor include a temperature sensor for measuring the temperature of the exhaust gas purifying apparatus or the atmosphere, and an oxygen sensor.

The sensor may be used singly or in combination with a plurality of sensors as long as the sensor is disposed at the void formed in the neighborhood of the first end face and the second end face of the holding sealing material. In the case where a gap is formed in the contact section of the holding sealing material, at least one sensor is disposed at the void formed in the neighborhood of the first end face and the second end face of the holding sealing material and other sensor(s) may be disposed at the gap formed in the contact section of the holding sealing material.

The following description will discuss the method for manufacturing an exhaust gas purifying apparatus according to the first embodiment of the present invention with reference to the drawings.

FIG. 9A, FIG. 9B, FIG. 9C, and FIG. 9D each are a perspective view schematically showing an example of a method for manufacturing the exhaust gas purifying apparatus according to the first embodiment of the present invention.

FIG. 9A, FIG. 9B, FIG. 9C, and FIG. 9D illustrate a method for manufacturing the exhaust gas purifying apparatus 100 shown in FIG. 6A and FIG. 6B as an example of the method for manufacturing the exhaust gas purifying apparatus according to the first embodiment of the present invention.

Figure 9A:
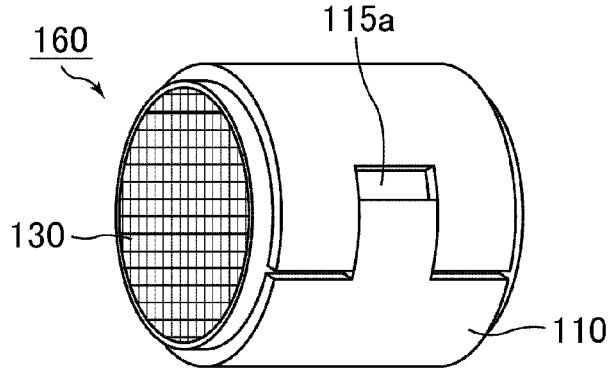
FIG. 9A, FIG. 9B, FIG. 9C, and FIG. 9D each are a perspective view schematically showing an example of a method for manufacturing an exhaust gas purifying apparatus according to the first embodiment of the present invention.

First, as shown in FIG. 9A, winding process is performed by winding the holding sealing material 110 around the exhaust gas-treating body 130 to manufacture a wound body (exhaust gas-treating body wound with the holding sealing material) 160.

The holding sealing material 10A shown in FIG. 2 is used as the holding sealing material 110. In this case, the void 115*a* is formed in the neighborhood of the first end face and the second end face in the void-forming section of the holding sealing material.

Depending on the relation between the length of the holding sealing material and the circumferential length of the exhaust gas-treating body, the first end face and the second end face in the contact section of the holding sealing material may contact each other, or may form a gap without contacting.

Figure 9B:
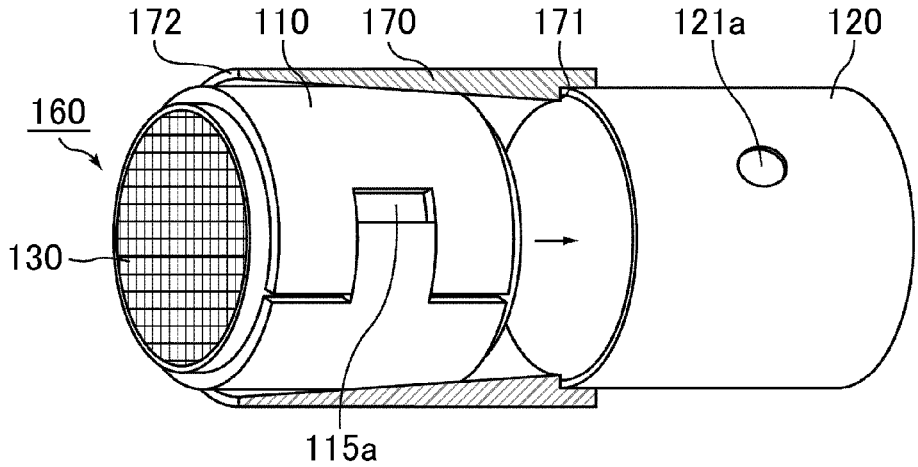

Next, as shown in FIG. 9B, housing process is performed by housing the manufactured wound body 160 in the casing 120 having an approximately cylindrical shape.

Examples of the method for housing the wound body in the casing include a press-fitting method (stuffing method), a sizing method (swaging method), and a clam shell method.

In a press-fitting method (stuffing method), the wound body is stuffed with a jig for stuffing and the like into a predetermined position in the casing. In a sizing method (swaging method), the wound body is inserted into the casing and is then compressed by applying pressures from the outer periphery side so as to reduce the inner diameter of the casing. In a clam shell method, the casing is made separable into two parts of the first casing and the second casing. The wound body is placed on the first casing and covered with the second casing to be sealed.

The press-fitting method (stuffing method) or sizing method (swaging method) is preferable among the methods for housing the wound body in the casing. This is because the press-fitting method (stuffing method) or sizing method (swaging methods) does not require two parts as casing, and therefore the number of manufacturing process is more likely to be reduced.

FIG. 9B illustrates a method for stuffing the wound body 160 into the casing 120 by using a stuffing jig 170.

The stuffing jig 170 has an approximately cylindrical shape as a whole, with its inside being expanded from one end to the other end in a tapered state.

One end of the stuffing jig 170 forms an end portion on a shorter diameter side 171 having an inner diameter corresponding to a diameter slightly smaller than the inner diameter of the casing 120. Moreover, the other end of the stuffing jig 170 forms an end portion on a longer diameter side 172 having at least an inner diameter corresponding to the outer diameter of the wound body 160.

By using the stuffing jig 170, the wound body 160 is more likely to be easily stuffed into the casing 120.

Meanwhile, the method for stuffing the wound body into the casing is not particularly limited, and, for example, a method may be used in which the wound body is stuffed into the casing by pushing the wound body with the hand.

Figure 9C:
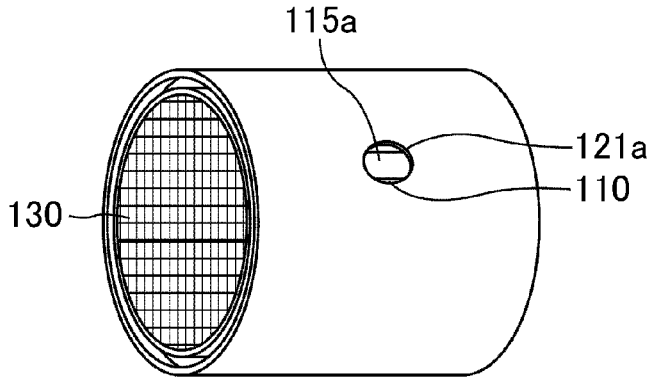

Thereafter, as shown in FIG. 9C, position adjustment process is performed by adjusting the position of the void 115*a* formed in the neighborhood of the first end face and the second end face in the void-forming section of the holding sealing material 110 to the position of the hole 121*a* of the casing 120.

Examples of the method for adjusting the position of the void to the position of the hole of the casing include a method including rotation of the wound body housed in the casing.

In the above housing process, in the case of housing the wound body in the casing while adjusting the position of the void to match the position of the hole of the casing, the housing process and the position adjustment process is more likely to be simultaneously performed.

Subsequently, a disposing process (first disposing process) is performed for disposing a sensor to be connected with the exhaust gas-treating body, to pass through the holding sealing material, and to penetrate the casing.

Figure 9D:
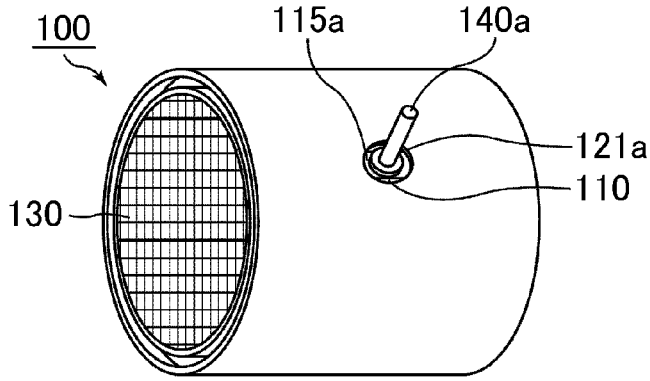

As shown in FIG. 9D, in the disposing process (first disposing process), the sensor 140*a* such as a temperature sensor is passed through the void 115*a* formed in the neighborhood of the first end face and the second end face in the void-forming section of the holding sealing material 110 and the hole 121*a* of the casing 120 so that the sensor 140*a* is connected to the exhaust gas-treating body 130.

The exhaust gas purifying apparatus 100 shown in FIG. 6A and FIG. 6B can be manufactured through the above process.

In the above method for manufacturing an exhaust gas purifying apparatus according to the present embodiment, the sensor is disposed at the void and the hole of the casing after housing the wound body in the casing.

In the case where a clam shell method is applied in the method for manufacturing an exhaust gas purifying apparatus according to the present embodiment, the wound body may be housed in the casing in a following manner. Namely, the wound body is placed on the first casing, and the sensor is disposed at the void, and then the second casing is allowed to cover thereon in a manner that the sensor is allowed to pass through the hole formed in the second casing.

Moreover, in the method for manufacturing an exhaust gas purifying apparatus according to the present embodiment, if a clam shell method is applied, a sensor-attached wound body may be manufactured by firstly fixing the sensor at a predetermined position of the exhaust gas-treating body and then winding the holding sealing material around the exhaust gas-treating body in a manner avoiding the sensor. In this case, after placing the sensor-attached wound body on the first casing, the wound body is covered with the second casing in a manner that the sensor pass through the hole formed in the second casing so that the wound body is housed in the casing.

The following description will list the effects obtained by the holding sealing material, the exhaust gas purifying apparatus, and the method for manufacturing the exhaust gas purifying apparatus of the present embodiment.

(1) The holding sealing material of the present embodiment has a first end face and a second end face which are approximately parallel in the width direction of the holding sealing material. The holding sealing material of the present embodiment has a contact section including a portion with a longest distance between the first end face and the second end face in a length direction of the holding sealing material and a void-forming section which is shorter than the contact section in the distance between the first end face and the second end face.

For this reason, if the holding sealing material of the present embodiment is rolled up to make the first end face in contact with the second end face, the first end face and the second end face do not contact at the void-forming section of the holding sealing material. As a result, a void is formed in the neighborhood of the first end face and the second end face in the void-forming section.

Accordingly, in manufacturing an exhaust gas purifying apparatus using the holding sealing material according to the present embodiment, an electrode member and/or a sensor are more likely to be disposed at the void.

(2) By using the holding sealing material of the present embodiment, a sensor is more likely to be disposed even if a through hole is not formed in the holding sealing material. Since punching process or the like for forming a through hole is not necessary in manufacturing the holding sealing material, problems of complex manufacturing process of the holding sealing material are less likely to occur.

(3) Forming a through hole in the holding sealing material reduces the area of the holding sealing material by the area of the though hole, and thus the retention of the holding sealing material tends to decrease.

Meanwhile, in the case of forming a void in the holding sealing material, even if the area of the void is small as compared with the case of forming a through hole, an electrode member and the like are more likely to be disposed at the formed void. Accordingly, problematic deterioration of the retention of the holding sealing material caused by reduction in the area of the holding sealing material is more likely to be prevented from occurring.

(4) Forming a through hole in the holding sealing material reduces the area in the width direction of the holding sealing material, and thus the tensile strength of the holding sealing material tends to decrease.

Meanwhile, in the case of forming a void in the holding sealing material, reduction of the area in the width direction of the holding sealing material is more likely to be avoided. Therefore, reduction in the tensile strength of the holding sealing material is more likely to be prevented from occurring. Accordingly, it may become easier to avoid problems of assembly defect such as breakage or overlapping of the holding sealing material upon pulling the holding sealing material to assemble the holding sealing material in the exhaust gas-treating body.

(5) In the holding sealing material of the present embodiment, each of the first end face and the second end face is provided with a step formed by at least one projected portion.

In the case where each of the first end face and the second end face of the holding sealing material has a step, the projected portion of the holding sealing material allows easier fit of the holding sealing material. As a result, exhaust gas tends not to leak from the fitting portion of the holding sealing material, and thus the exhaust gas-sealing property is more likely to be maintained. Moreover, in the case where each of the first end face and the second end face of the holding sealing material has a step, the projected portion of the holding sealing material allows easier fit of the holding sealing material. As a result, even if the exhaust gas purifying apparatus receives a force in the width direction of the holding sealing material, displacement of the holding sealing material from the exhaust gas-treating body tends not to occur.

(6) In the holding sealing material of the present embodiment, the length of the projected portion in the void-forming section is shorter than the length of the projected portion in the contact section in the length direction of the holding sealing material.

Since the holding sealing material of the present embodiment has the void-forming section with the aforementioned shape, a void tends to be formed when the holding sealing material is rolled up.

(7) In the exhaust gas purifying apparatus and the method for manufacturing an exhaust gas purifying apparatus of the present embodiment, a void is formed in the neighborhood of the first end face and the second end face in the void-forming section of the holding sealing material wound around the exhaust gas-treating body. Therefore, a sensor which penetrates the casing to be connected to the exhaust gas purifying apparatus is more likely to be disposed at the void.

Second Embodiment

The following description will discuss a second embodiment that is one of the embodiments of the present invention.

In the holding sealing material, the exhaust gas purifying apparatus, and the method for manufacturing an exhaust gas purifying apparatus according to the first embodiment of the present invention, the length of the projected portion in the void-forming section of the holding sealing material is shorter than the length of the projected portion in the contact section of the holding sealing material. Meanwhile, in the holding sealing material, the exhaust gas purifying apparatus, and the method for manufacturing an exhaust gas purifying apparatus according to the second embodiment of the present invention, the projected portion in the void-forming section of the holding sealing material has a projected-portion notch which is formed in the length direction of the holding sealing material.

The following will discuss the holding sealing material according to the second embodiment of the present invention.

Figure 10:
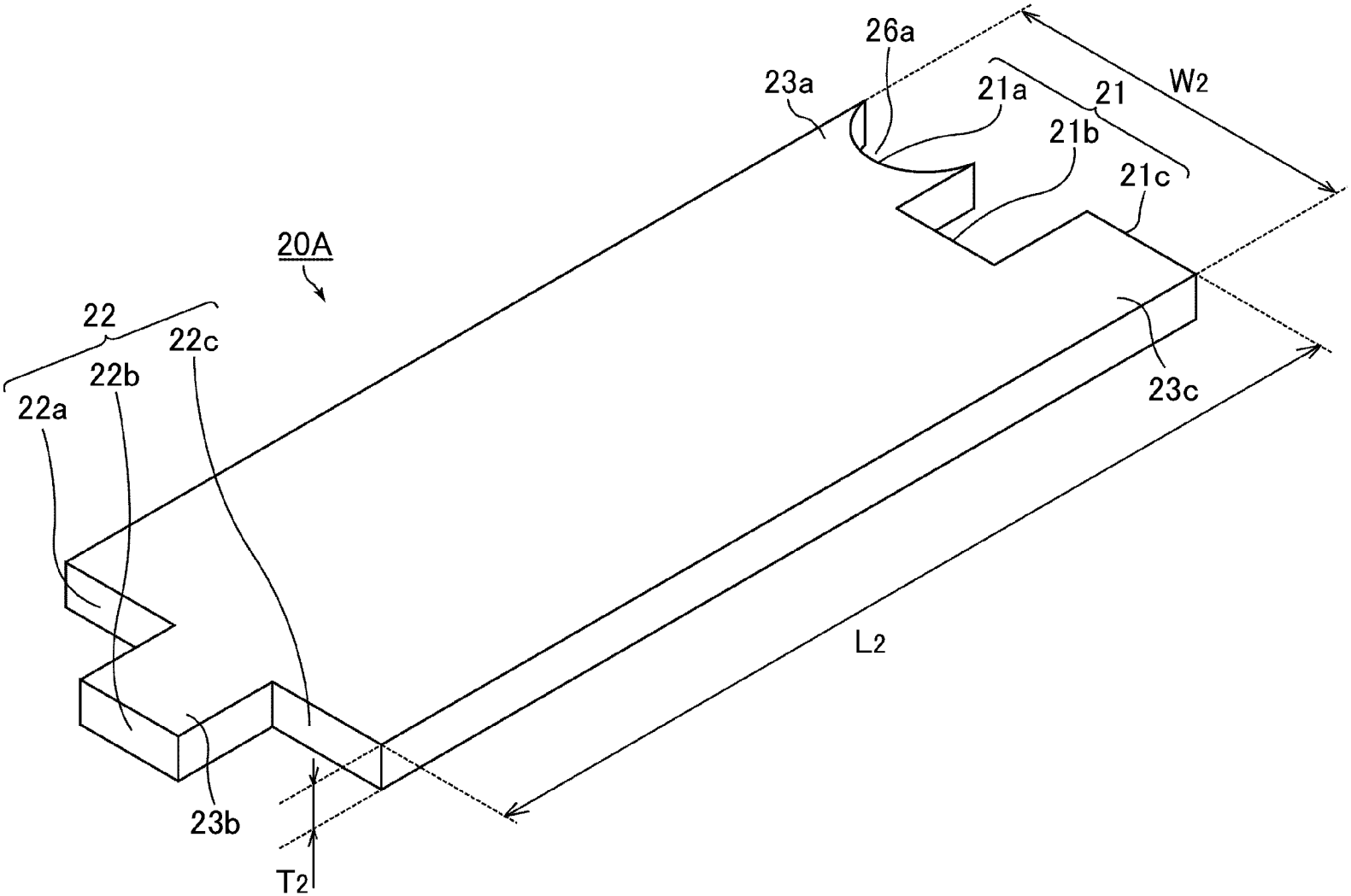
FIG. 10 is a perspective view schematically showing an example of a holding sealing material according to a second embodiment of the present invention.

FIG. 10 is a perspective view schematically showing an example of the holding sealing material according to the second embodiment of the present invention.

A holding sealing material 20A illustrated in FIG. 10 includes inorganic fibers such as alumina-silica fibers and has a mat shape. More specifically, the holding sealing material 20A has a plain plate shape with an approximately rectangular shape in a plain view having a predetermined length (shown by an arrow $L_2$ in FIG. 10), a predetermined width (shown by an arrow $W_2$ in FIG. 10), and a predetermined thickness (shown by an arrow $T_2$ in FIG. 10). Moreover, the holding sealing material 20A has first end face 21 (21*a*, 21*b*, and 21*c*) and second end face 22 (22*a*, 22*b*, and 22*c*) that are approximately parallel in the width $W_2$ direction of the holding sealing material 20A.

In a similar manner as in the first embodiment of the present invention, in the holding sealing material of the present embodiment, each of the first end face and the second end face has a step formed by at least one projected portion.

In the holding sealing material 20A shown in FIG. 10, two projected portions 23*a* and 23*c* are formed at the first end face 21, and one projected portion 23*b* is formed at the second end face 22. As mentioned earlier, the holding sealing material 20A shown in FIG. 10 has three levels of steps at both of the first end face 21 and the second end face 22.

In a similar manner as in the first embodiment of the present invention, the holding sealing material of the present embodiment has a contact section including a portion with a longest distance between the first end face and the second end face in a length direction of the holding sealing material and a void-forming section which is shorter than the contact section in the distance between the first end face and the second end face.

In the holding sealing material of the present embodiment, at least one of the first end face and the second end face of the void-forming section has an end-face notch which is formed in the length direction of the holding sealing material.

Specifically, the projected portion in the void-forming section of the holding sealing material has a projected-portion notch (first notch) which is formed in the length direction of the holding sealing material.

In the holding sealing material 20A shown in FIG. 10, the projected portion 23*a* has a projected-portion notch 26*a* which is formed in the length $L_2$ direction of the holding sealing material 20A.

Provided that the length of the projected portion 23*b* is approximately the same as that of the projected portion 23*c* in the holding sealing material 20A shown in FIG. 10, the region including the projected portion 23*b* and the region including the projected portion 23*c* each corresponds to a contact section, and the region including the projected portion 23*a* corresponds to a void-forming section.

In a similar manner as in the first embodiment of the present invention, in the holding sealing material of the present embodiment, a void is formed in the neighborhood of the first end face of the void-forming section and the second end of the void-forming section when the holding sealing material is rolled up so that the first end face of the contact section is made in contact with the second end face of the contact section.

Figure 11:
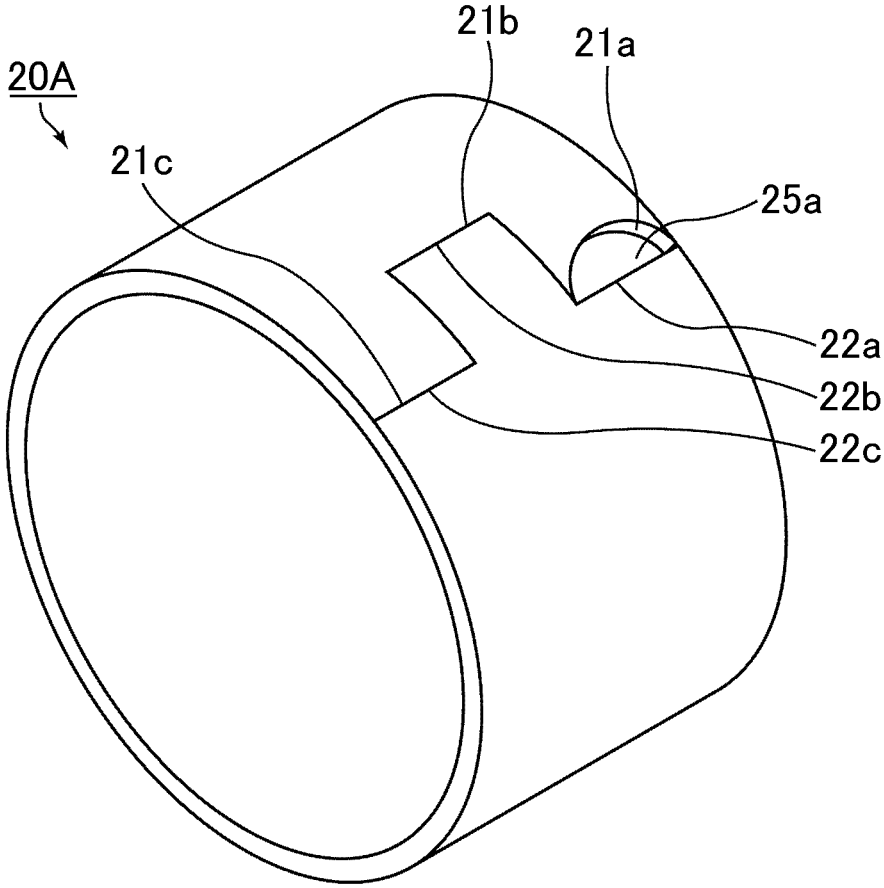
FIG. 11 is a perspective view schematically illustrating the holding sealing material shown in FIG. 10 in a rolled-up shape.

FIG. 11 is a perspective view schematically showing the holding sealing material shown in FIG. 10 in a rolled-up shape.

When the holding sealing material 20A illustrated in FIG. 10 is rolled up, in the contact section, contact between the first end face 21*b* and the second end face 22*b* and contact between the first end face 21*c* and the second end face 22*c* may become easier to be achieved. Meanwhile, in the void-forming section, the first end face 21*a* does not contact the second end face 22*a*. Asa result, a void 25*a* is formed in the neighborhood of the first end face 21*a* and the second end face 22*a*.

Accordingly, when the holding sealing material 20A illustrated in FIG. 10 is rolled up, the convex formed by the projected portion 23*b* does not engage with the concave formed by the projected portions 23*a* and 23*c* so that the void 25*a* is formed.

Figure 12A:
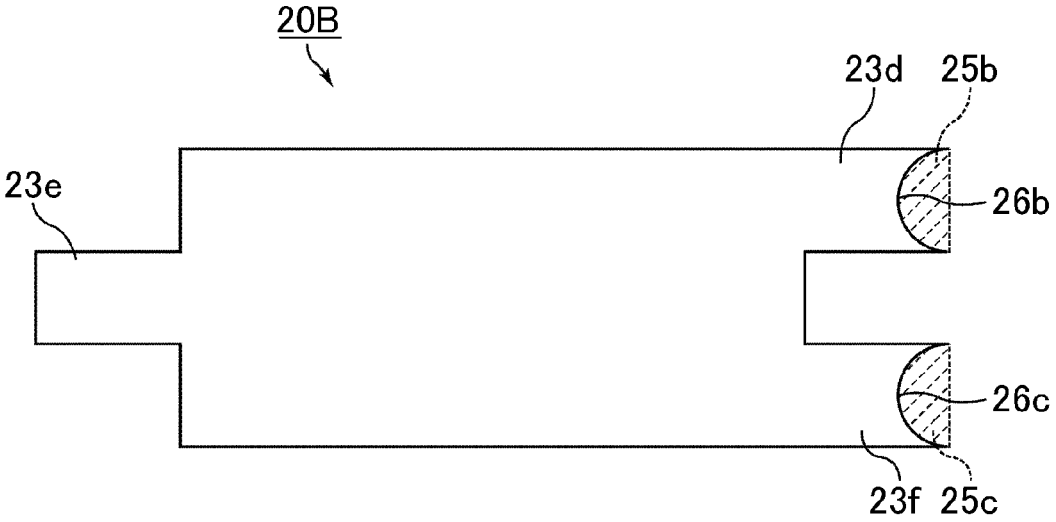
FIG. 12A and FIG. 12B each are a plain view schematically showing other example of the holding sealing material according to the second embodiment of the present invention.
Figure 12B:
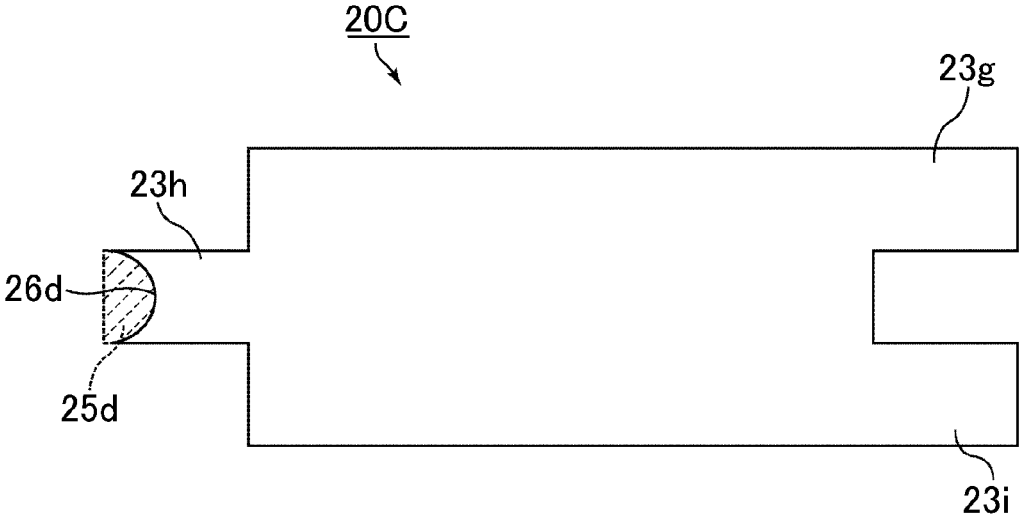
Figure 13A:
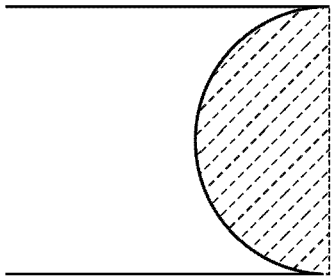
FIG. 13A, FIG. 13B, FIG. 13C, FIG. 13D, FIG. 13E, FIG. 13F, FIG. 13G, and FIG. 13H each are a plain view schematically showing an example of a cross-sectional shape of a projected-portion notch formed in the holding sealing material according to the second embodiment of the present invention.
Figure 13B:
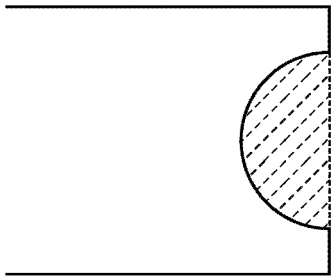
Figure 13C:
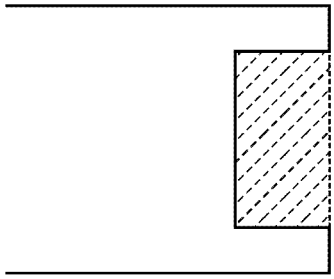
Figure 13D:
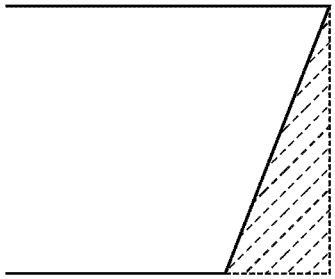
Figure 13E:
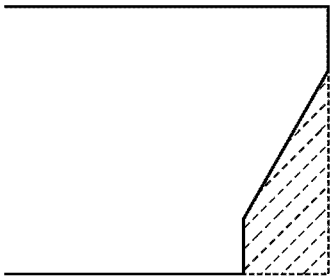
Figure 13F:
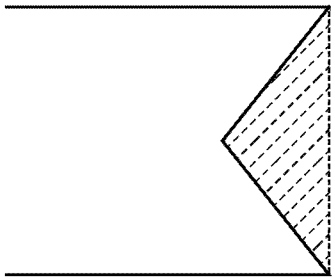
Figure 13G:
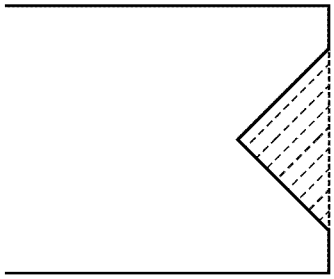
Figure 13H:
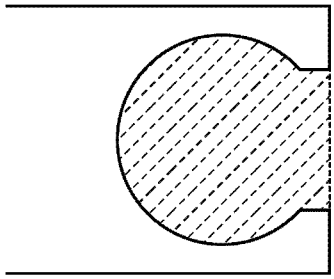

FIG. 12A and FIG. 12B each are a plain view schematically showing other example of the holding sealing material according to the second embodiment of the present invention.

In the holding sealing material of the present embodiment, as shown in a holding sealing material 20B shown in FIG. 12A, the projected portions 23*d* and 23*f* may have projected-portion notches 26*b* and 26*c*, respectively, which are formed in the length direction of the holding sealing material. When the holding sealing material 20B is rolled up, voids 25*b* and 25*c* are formed.

Moreover, in the holding sealing material of the present embodiment, as shown in a holding sealing material 20C illustrated in FIG. 12B, the projected portion 23*h* may have a projected-portion notch 26*d* which is formed in the length direction of the holding sealing material. When the holding sealing material 20C is rolled up, a void 25*d* is formed.

In the holding sealing material of the present embodiment, any projected portion may have a projected-portion notch, and the position and the number of the projected-portion notch in the holding sealing material is not particularly limited. For example, all the projected portions in the holding sealing material may have a projected-portion notch.

FIG. 13A, FIG. 13B, FIG. 13C, FIG. 13D, FIG. 13E, FIG. 13F, FIG. 13G, and FIG. 13H each are a plain view schematically showing an example of a cross-sectional shape of the projected-portion notch formed in the holding sealing material according to the second embodiment of the present invention.

In the holding sealing material of the present embodiment, the cross-sectional shape of the projected-portion notch formed in each projected portion is not particularly limited. The cross-sectional shape may be any shape as shown in FIG. 13A, FIG. 13B, FIG. 13C, FIG. 13D, FIG. 13E, FIG. 13F, FIG. 13G, and FIG. 13H.

Moreover, in the holding sealing material of the present embodiment, in the case where a plurality of the projected-portion notches are formed, the shapes of the projected-portion notches in the holding sealing material may be approximately the same or may be a combination of different shapes.

Meanwhile, the cross-sectional shape of the projected-portion notch in the holding sealing material refers to a cross-sectional shape which is in approximately parallel with the main face of the holding sealing material.

In the holding sealing material of the present embodiment, the cross-sectional area (cross-sectional area which is in approximately parallel with the main face of the holding sealing material) of the projected-portion notch formed in each projected portion is preferably from about 1% to about 90% and more preferably from about 35% to about 75% of the cross-sectional area of the void-forming section without the projected-portion notch.

In the case where the cross-sectional area of the projected-portion notch formed in each projected portion in the holding sealing material is about 1% or more of the cross-sectional area of the void-forming section without the projected-portion notch, a void with a sufficient area is more likely to be formed in the neighborhood of the first end face and the second end face of the holding searing material when the holding sealing material is rolled up. For this reason, an electrode member and/or a sensor are more likely to be disposed at the void. Meanwhile, in the case where the cross-sectional area of the projected-portion notch formed in each projected portion in the holding sealing material is about 90% or less of the cross-sectional area of the void-forming section without the projected-portion notch, the area of the holding sealing material tends not to decrease, which tends not to deteriorate the retention of the holding sealing material.

In the holding sealing material of the present embodiment, the cross-sectional area (cross-sectional area in approximately parallel with the main surface of the holding sealing material) of the void formed upon making the first end face in contact with the second end face in the contact section of the holding sealing material is preferably from about 1 $mm^2$ to about 10000 $mm^2$, and more preferably from about 400 $mm^2$ to about 1600 $mm^2$.

In the case that the cross-sectional area of the void is about 1 $mm^2$ or more, disposing an electrode member or the like at the void may become easier upon using the holding sealing material in the exhaust gas purifying apparatus. In the case that the cross-sectional area of the void is about 10000 $mm^2$ or less, the area of the holding sealing material is not too small, which tends not to deteriorate the retention of the holding sealing material.

In the holding sealing material of the present embodiment, a projected-portion notch (first notch) is formed in the projected portion of the holding sealing material, and also the length of the projected portion having no projected-portion notch may be smaller than that of the other projected portion.

The holding sealing material of the present embodiment may include a binder such as an organic binder.

Moreover, the holding sealing material of the present embodiment may be a needle mat obtained by performing a needling treatment on a base mat including inorganic fibers.

The holding sealing material of the present embodiment may be manufactured, for example, by punching the base mat prepared by entangling inorganic fibers in accordance with a spinning method, in a desired shape.

The following description will discuss the exhaust gas purifying apparatus according to the second embodiment of the present invention.

The exhaust gas purifying apparatus according to the second embodiment of the present invention has a similar structure as that of the exhaust gas purifying apparatus according to the first embodiment of the present invention except for the structure of the holding sealing material.

The holding sealing material of the present embodiment is used in the exhaust gas purifying apparatus of the present embodiment.

The method for manufacturing the exhaust gas purifying apparatus according to the second embodiment of the present invention is similar with the method for manufacturing the exhaust gas purifying apparatus according to the first embodiment of the present invention.

The present embodiment can exert not only the effects (1) to (5) and (7) explained in the first embodiment of the present invention but the effects mentioned below as well.

(8) In the holding sealing material of the present embodiment, at least one of the first end face and the second end face in the void-forming section of the holding sealing material has an end-face notch which is formed in the length direction of the holding sealing material.

The holding sealing material having an end face with the aforementioned shape tends to form a void when the holding sealing material is rolled up.

(9) In the holding sealing material of the present embodiment, the projected portion in the void-forming section of the holding sealing material has a projected-portion notch which is formed in the length direction of the holding sealing material.

As the holding sealing material of the present embodiment has the void-forming section with the aforementioned shape, a void tends to be formed when the holding sealing material is rolled up.

Third Embodiment

The following description will discuss a third embodiment that is one of the embodiments of the present invention.

In the holding sealing material, the exhaust gas purifying apparatus, and the method for manufacturing an exhaust gas purifying apparatus according to the first embodiment of the present invention, the length of the projected portion in the void-forming section of the holding sealing material is shorter than the length of the projected portion in the contact section of the holding sealing material. Meanwhile, in the holding sealing material, the exhaust gas purifying apparatus, and the method for manufacturing an exhaust gas purifying apparatus according to the third embodiment of the present invention, an end face opposite to the projected portion in the void-forming section of the holding sealing material has an opposite-portion notch which is formed in the length direction of the holding sealing material.

The following will discuss the holding sealing material according to the third embodiment of the present invention.

Figure 14:
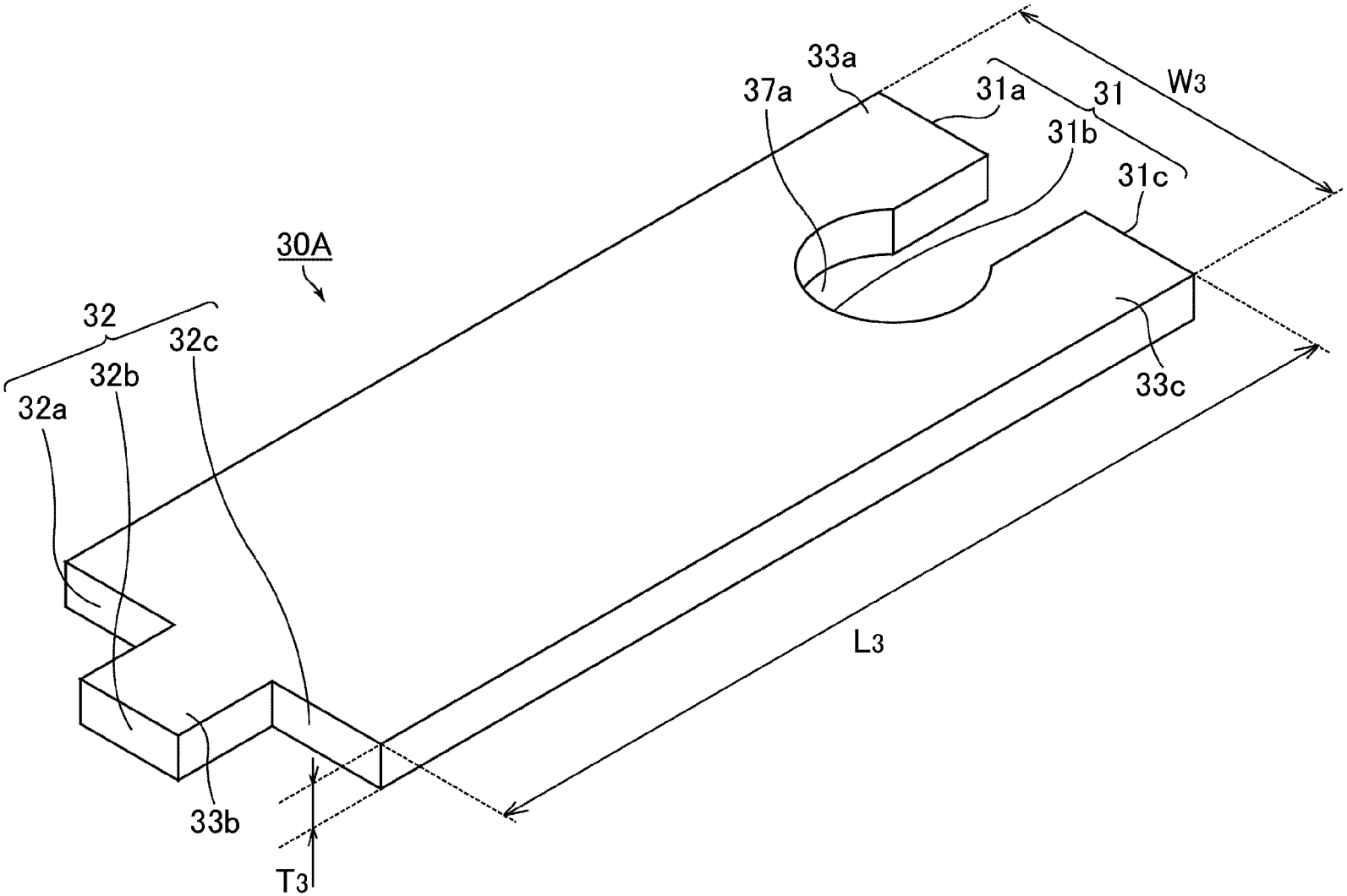
FIG. 14 is a perspective view schematically showing an example of a holding sealing material according to a third embodiment of the present invention.

FIG. 14 is a perspective view schematically showing an example of the holding sealing material according to the third embodiment of the present invention.

A holding sealing material 30A illustrated in FIG. 14 includes inorganic fibers such as alumina-silica fibers and has a mat shape. More specifically, the holding sealing material 30A has a plain plate shape with an approximately rectangular shape in a plain view having a predetermined length (shown by an arrow $L_3$ in FIG. 14), a predetermined width (shown by an arrow $W_3$ in FIG. 14), and a predetermined thickness (shown by an arrow $T_3$ in FIG. 14). Moreover, the holding sealing material 30A has first end face 31 (31*a*, 31*b*, and 31*c*) and second end face 32 (32*a*, 32*b*, and 32*c*) that are approximately parallel in the width $W_3$ direction of the holding sealing material 30A.

In a similar manner as in the first embodiment of the present invention, in the holding sealing material of the present embodiment, each of the first end face and the second end face has a step formed by at least one projected portion.

In the holding sealing material 30A shown in FIG. 14, two projected portions 33*a* and 33*c* are formed at the first end face 31, and one projected portion 33*b* is formed at the second end face 32. As mentioned earlier, the holding sealing material 30A illustrated in FIG. 14 has three levels of steps at both of the first end face 31 and the second end face 32.

In a similar manner as in the first embodiment of the present invention, the holding sealing material of the present embodiment has a contact section including a portion with a longest distance between the first end face and the second end face in a length direction of the holding sealing material and a void-forming section which is shorter than the contact section in the distance between the first end face and the second end face.

In the holding sealing material of the present embodiment, at least one of the first end face and the second end face of the void-forming section has an end-face notch which is formed in the length direction of the holding sealing material.

Specifically, an end face opposite to the projected portion in the void-forming section of the holding sealing material has an opposite-portion notch (second notch) which is formed in the length direction of the holding sealing material.

In the holding sealing material 30A shown in FIG. 14, an end face 31*b* opposite to the projected portion 33*b* has an opposite-portion notch 37*a* which is formed in the length $L_3$ direction of the holding sealing material 30A.

Provided that the length of the projected portion 33*a* is approximately the same as that of the projected portion 33*c* when the opposite-portion notch 37*a* is not formed in the holding sealing material 30A shown in FIG. 14, the region including the projected portion 33*a* and the region including the projected portion 33*c* each corresponds to the contact section, and the region including the projected portion 33*b* corresponds to the void-forming section.

Meanwhile, in the holding sealing material 30A shown in FIG. 14, a part of the opposite-portion notch 37*a* is included in the contact section. As used herein, the region including a portion with a longest distance between the first end face and the second end face of the holding sealing material is referred to as the contact section even if a part of the opposite-portion notch is included in the contact section as described above.

In a similar manner as in the first embodiment of the present invention, in the holding sealing material of the present embodiment, a void is formed in the neighborhood of the first end face of the void-forming section and the second end of the void-forming section when the holding sealing material is rolled up so that the first end face of the contact section is made in contact with the second end face of the contact section.

Figure 15:
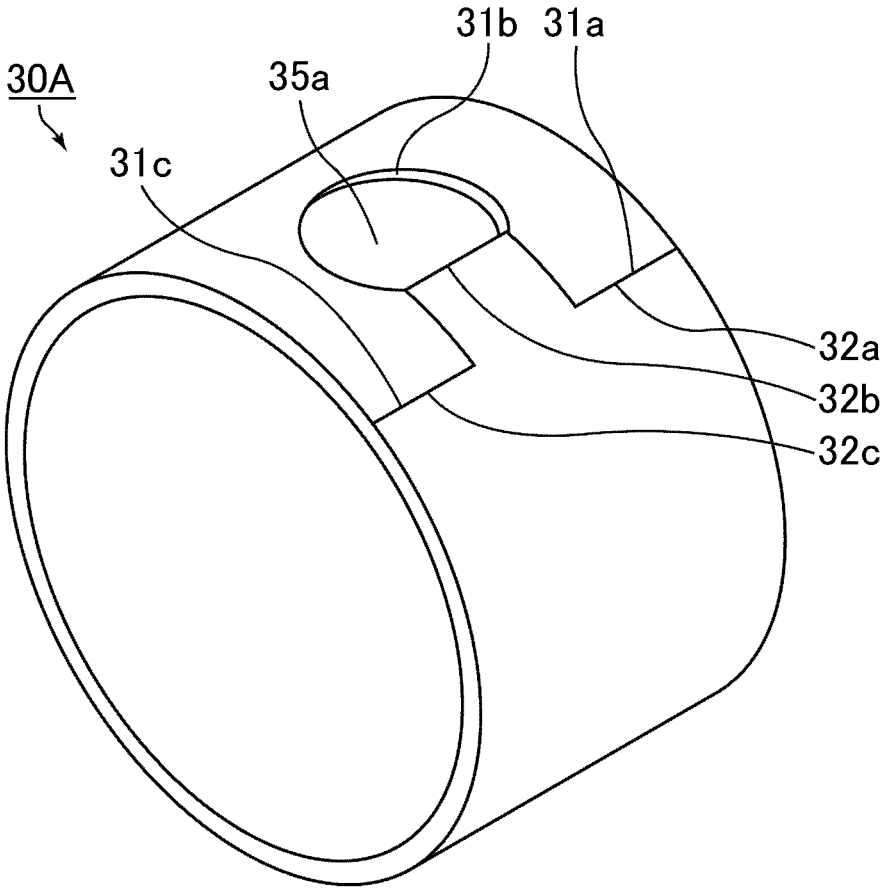
FIG. 15 is a perspective view schematically illustrating the holding sealing material shown in FIG. 14 in a rolled-up shape.

FIG. 15 is a perspective view schematically showing the holding sealing material shown in FIG. 14 in a rolled-up shape.

When the holding sealing material 30A illustrated in FIG. 14 is rolled up, in the contact section, contact between the first end face 31*a* and the second end face 32*a* and contact between the first end face 31*c* and the second end face 32*c* may become easier to be achieved. Meanwhile, in the void-forming section, the first end face 31*b* cannot make in contact with the second end face 32*b*. As a result, a void 35*a* is formed in the neighborhood of the first end face 31*b* and the second end face 32*b*.

Accordingly, when the holding sealing material 30A illustrated in FIG. 14 is rolled up, the convex formed by the projected portion 33*b* does not fully engage with the concave formed by the projected portions 33*a* and 33*c* so that the void 35*a* is formed.

Figure 16A:
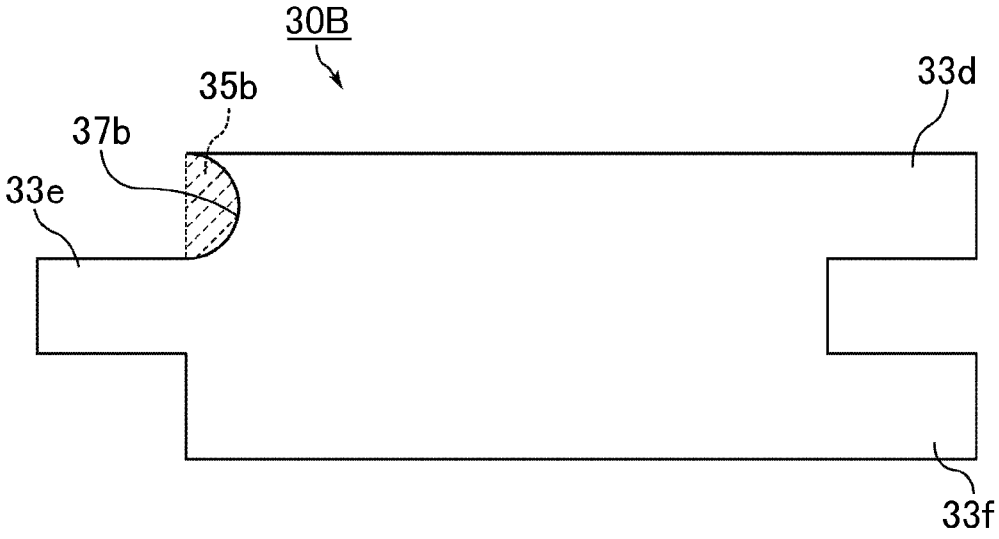
FIG. 16A and FIG. 16B each are a plain view schematically showing other example of the holding sealing material according to the third embodiment of the present invention.
Figure 16B:
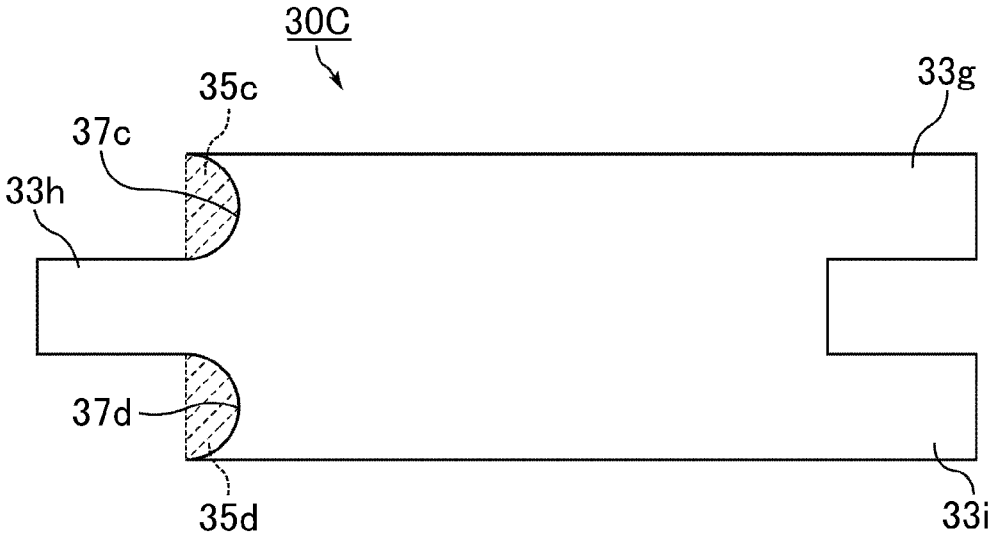
Figure 17A:
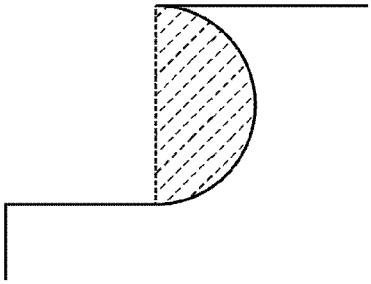
FIG. 17A, FIG. 17B, FIG. 17C, FIG. 17D, FIG. 17E, FIG. 17F, FIG. 17G, and FIG. 17H each are a plain view schematically showing an example of the cross-sectional shape of an opposite-portion notch formed in the holding sealing material according to the third embodiment of the present invention.
Figure 17B:
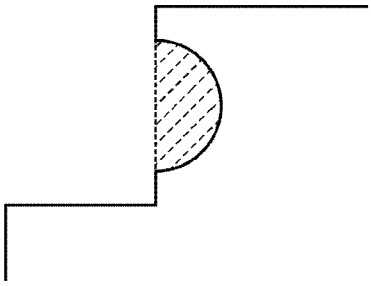
Figure 17C:
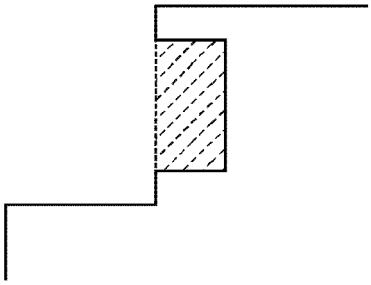
Figure 17D:
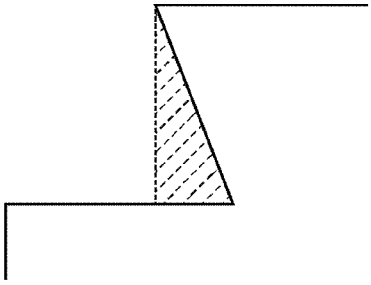
Figure 17E:
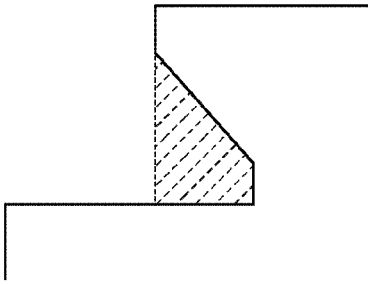
Figure 17F:
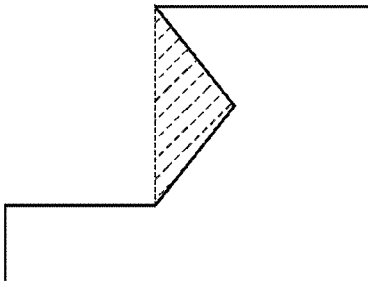
Figure 17G:
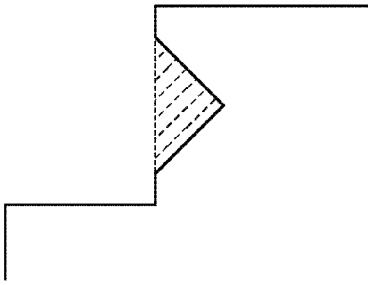
Figure 17H:
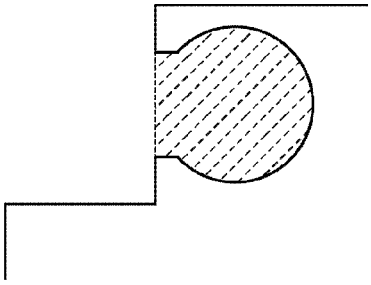

FIG. 16A and FIG. 16B each are a plain view schematically showing other example of the holding sealing material according to the third embodiment of the present invention.

In the holding sealing material of the present embodiment, as shown in a holding sealing material 30B illustrated in FIG. 16A, an end face opposite to the projected portion 33*d* may have an opposite-portion notch 37*b* which is formed in the length direction of the holding sealing material. When the holding sealing material 30B is rolled up, a void 35*b* is formed.

Moreover, in the holding sealing material of the present embodiment, as shown in a holding sealing material 30C in FIG. 16B, an end face opposite to the projected portion 33*g* and an end face opposite to the projected portion 33*i* may have an opposite-portion notch 37*c* and an opposite-portion notch 37*d*, respectively, which are formed in the length direction of the holding sealing material. When the holding sealing material 30C is rolled up, voids 35*c* and 35*d* are formed.

In the holding sealing material of the present embodiment, any end face opposite to the projected portion may have an opposite-portion notch, and the position and the number of the opposite-portion notch in the holding sealing material is not particularly limited. For example, each of the end faces opposite to all the projected portions in the holding sealing material may have an opposite-portion notch.

FIG. 17A, FIG. 17B, FIG. 17C, FIG. 17D, FIG. 17E, FIG. 17F, FIG. 17G, and FIG. 17H each are a plain view schematically showing an example of the cross-sectional shape of the opposite-portion notch formed in the holding sealing material according to the third embodiment of the present invention.

In the holding sealing material of the present embodiment, the cross-sectional shape of the opposite-portion notch formed in the end face opposite to each projected portion is not particularly limited. The cross-sectional shape may be any shape as shown in FIG. 17A, FIG. 17B, FIG. 17C, FIG. 17D, FIG. 17E, FIG. 17F, FIG. 17G, and FIG. 17H.

Moreover, in the holding sealing material of the present embodiment, in the case where a plurality of opposite-portion notches are formed, the shapes of the opposite-portion notches in the holding sealing material may be approximately the same or may be a combination of different shapes.

Meanwhile, the cross-sectional shape of the opposite-portion notch in the holding sealing material refers to a cross-sectional shape which is in approximately parallel with the main face of the holding sealing material.

In the holding sealing material of the present embodiment, the cross-sectional area (cross-sectional area which is in approximately parallel with the main face of the holding sealing material) of the opposite-portion notch formed in an end face opposite to each projected portion is preferably from about 1% to about 90% and more preferably from about 35% to about 75% of the cross-sectional area of the void-forming section without the opposite-portion notch.

In the case where the cross-sectional area of the opposite-portion notch formed in an end face opposite to each projected portion in the holding sealing material is about 1% or more of the cross-sectional area of the void-forming section without the opposite-portion notch, a void with a sufficient area is more likely to be formed in the neighborhood of the first end face and the second end face of the holding searing material when the holding sealing material is rolled up. For this reason, an electrode member and/or a sensor are more likely to be disposed at the void. Meanwhile, in the case where the cross-sectional area of the opposite-portion notch formed in an end face opposite to each projected portion in the holding sealing material is about 90% or less of the cross-sectional area of the void-forming section without the opposite-portion notch, the area of the holding sealing material tends not to decrease, which tends not to lower the retention of the holding sealing material.

In the holding sealing material of the present embodiment, the cross-sectional area (cross-sectional area in approximately parallel with the main surface of the holding sealing material) of the void formed upon making the first end face in contact with the second end face in the contact section of the holding sealing material is preferably from about 1 $mm^2$ to about 10000 $mm^2$, and more preferably from about 400 $mm^2$ to about 1600 $mm^2$.

In the case that the cross-sectional area of the void is about 1 $mm^2$ or more, disposing an electrode member or the like at the void may become easier in use of the holding sealing material in the exhaust gas purifying apparatus. In the case that the cross-sectional area of the void is about 10000 $mm^2$ or less, the area of the holding sealing material is not too small, which tends not to deteriorate the retention of the holding sealing material.

Figure 18A:
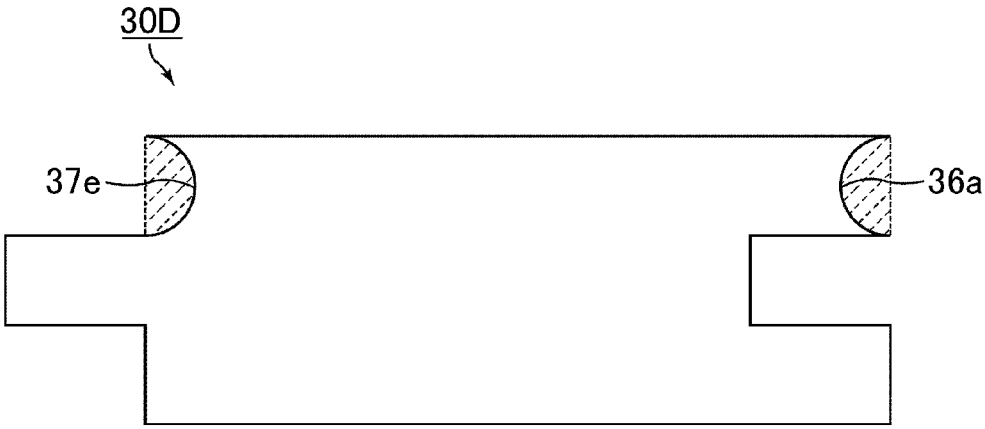
FIG. 18A, FIG. 18B, and FIG. 18C each are a plain view schematically showing other example of the holding sealing material according to the third embodiment of the present invention.
Figure 18B:
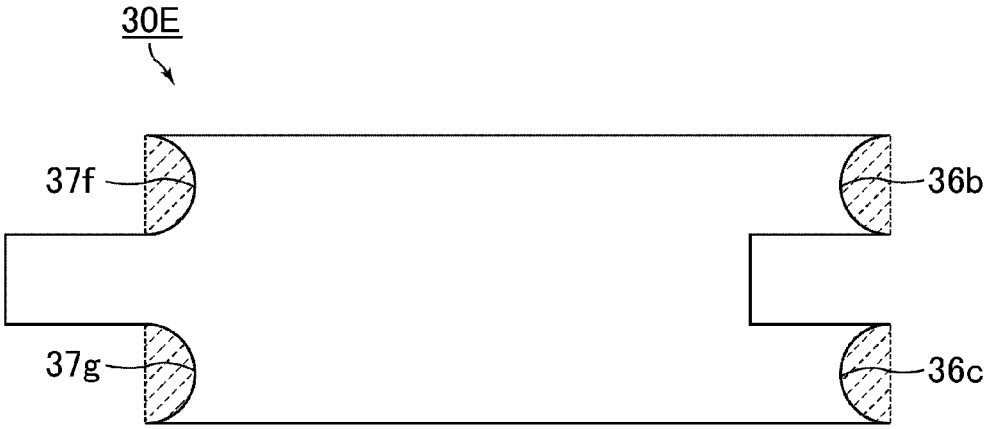
Figure 18C:
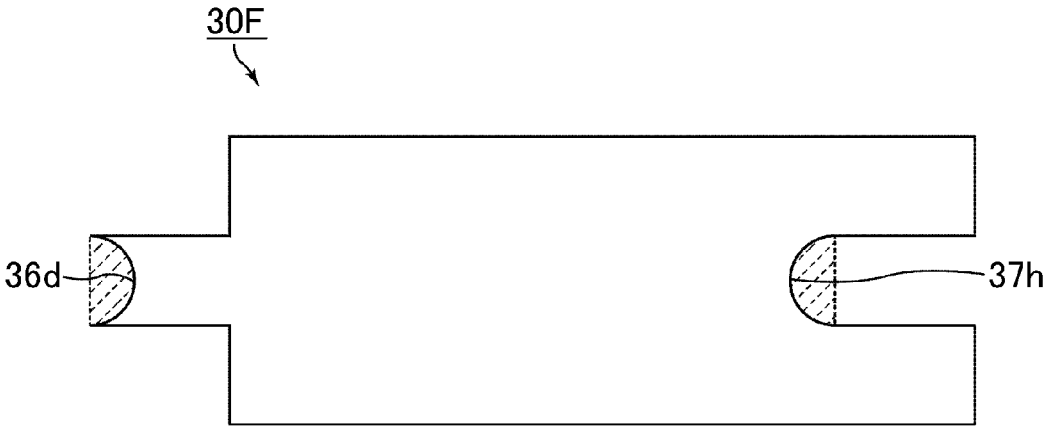

FIG. 18A, FIG. 18B, and FIG. 18C each are a plain view schematically showing other example of the holding sealing material according to the third embodiment of the present invention.

In the holding sealing material of the present embodiment, as shown by a holding sealing material 30D illustrated in FIG. 18A, an end face opposite to the projected portion has an opposite-portion notch (second notch) 37*e*, and further the projected portion may have a projected-portion notch (first notch) 36*a*.

Moreover, in the holding sealing material of the present embodiment, as shown by a holding sealing material 30E illustrated in FIG. 18B, not only opposite-portion notches 37*f* and 37*g* but also projected-portion notches 36*b* and 36*c* may be formed. Alternatively, as shown by a holding sealing material 30F illustrated in FIG. 18C, not only an opposite-portion notch 37*h* but also a projected-portion notch 36*d* may be formed.

In the holding sealing material of the present embodiment, an end face opposite to the projected portion may have an opposite-portion notch (second notch), and also the length of the projected portion having no projected-portion notch may be shorter than the length of other projected portion(s).

Moreover, in the holding sealing material of the present embodiment, an opposite-portion notch and a projected-portion notch may be formed, and also the length of the projected portion having no opposite-portion notch and projected-portion notch may be shorter than the length of other projected portion(s).

The holding sealing material of the present embodiment may include a binder such as an organic binder.

Moreover, the holding sealing material of the present embodiment may be a needle mat obtained by performing a needling treatment on a base mat including inorganic fibers.

The holding sealing material of the present embodiment may be manufactured, for example, by punching the base mat prepared by entangling inorganic fibers in accordance with a spinning method into a desired shape.

The following description will discuss the exhaust gas purifying apparatus according to the third embodiment of the present invention.

The exhaust gas purifying apparatus according to the third embodiment of the present invention has a similar structure as that of the exhaust gas purifying apparatus according to the first embodiment of the present invention except for the structure of the holding sealing material.

The holding sealing material of the present embodiment is used in the exhaust gas purifying apparatus of the present embodiment.

The method for manufacturing the exhaust gas purifying apparatus according to the third embodiment of the present invention is similar with the method for manufacturing the exhaust gas purifying apparatus according to the first embodiment of the present invention.

The present embodiment can exert not only the effects (1) to (5), and (7) explained in the first embodiment of the present invention but also the effect (8) explained in the second embodiment, and further the following effect as well.

(10) In the holding sealing material of the present embodiment, an end face opposite to the projected portion in the void-forming section of the holding sealing material has an opposite-portion notch which is formed in the length direction of the holding sealing material.

As the holding sealing material of the present embodiment has the void-forming section with the aforementioned shape, a void tends to be formed when the holding sealing material is rolled up.

Fourth Embodiment

The following description will discuss a fourth embodiment that is one of the embodiments of the present invention.

The holding sealing material, exhaust gas purifying apparatus, and method for manufacturing an exhaust gas purifying apparatus according to the fourth embodiment of the present invention are different from the holding sealing material, exhaust gas purifying apparatus, and method for manufacturing an exhaust gas purifying apparatus according to the first to third embodiments of the present invention in that a penetration portion which penetrates the holding sealing material in a thickness direction of the holding sealing material is formed in the fourth embodiment.

The following will discuss the holding sealing material according to the fourth embodiment of the present invention.

The holding sealing material of the fourth embodiment of the present invention has a similar structure as that of the holding sealing material of the first to third embodiment of the present invention, except that a penetration portion is formed in the fourth embodiment.

Figure 19A:
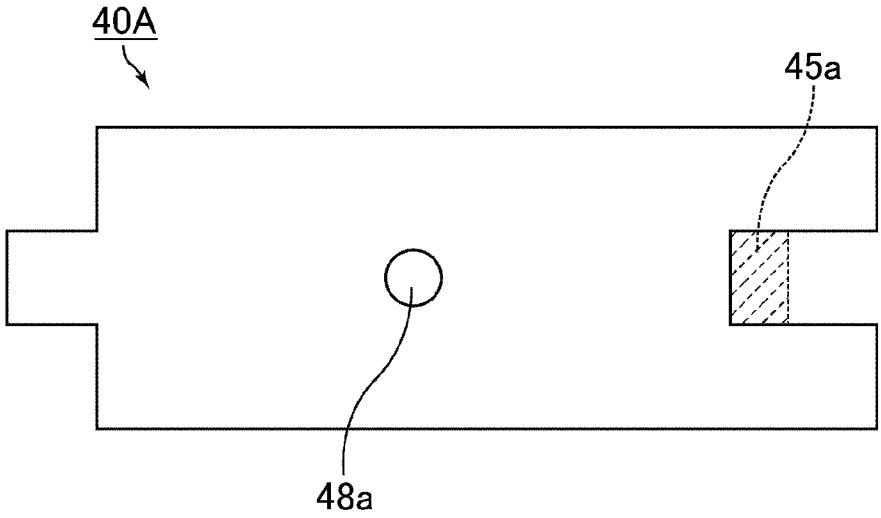
FIG. 19A, FIG. 19B, and FIG. 19C each are a plain view schematically showing an example of a holding sealing material according to a fourth embodiment of the present invention.
Figure 19B:
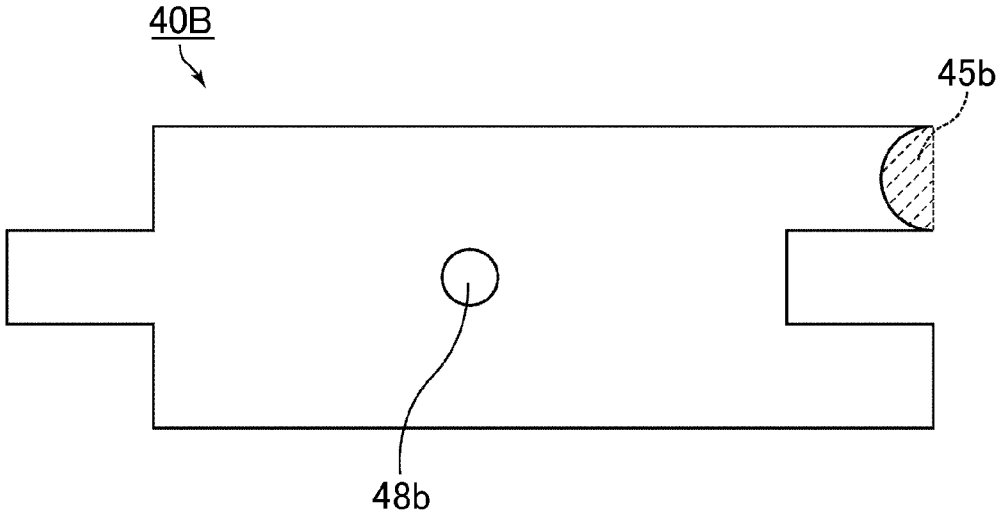
Figure 19C:
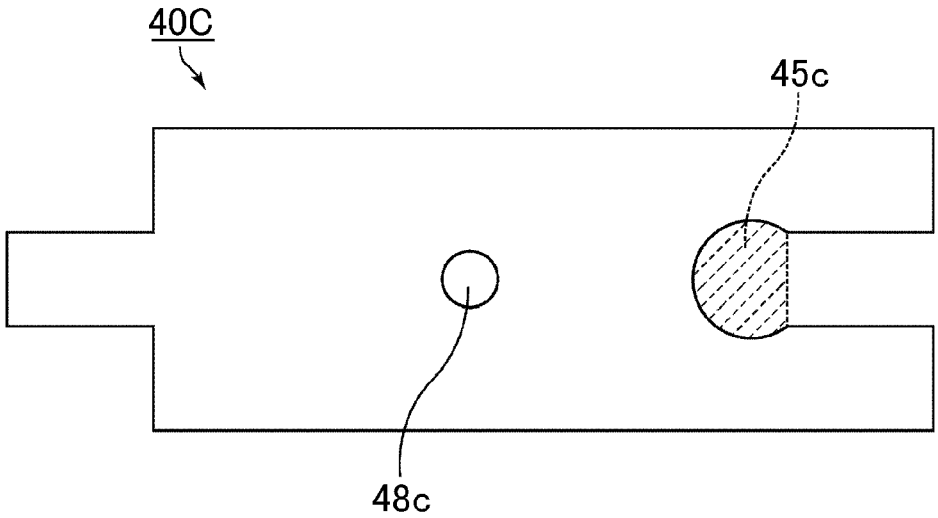

FIG. 19A, FIG. 19B, and FIG. 19C each are a plain view schematically showing an example of the holding sealing material according to the fourth embodiment of the present invention.

A holding sealing material 40A shown in FIG. 19A has a similar structure as that of the holding sealing material 10A shown in FIG. 2 as an example of the holding sealing material of the first embodiment of the present invention, except that a penetration portion 48*a* is formed in the holding sealing material 40A. Avoid 45*a* is formed when the holding sealing material 40A is rolled up.

A holding sealing material 40B shown in FIG. 19B has a similar structure as that of the holding sealing material 20A shown in FIG. 10 as an example of the holding sealing material of the second embodiment of the present invention, except that a penetration portion 48*b* is formed in the holding sealing material 40B. Avoid 45*b* is formed when the holding sealing material 40B is rolled up.

A holding sealing material 40C shown in FIG. 19C has a similar structure as that of the holding sealing material 30A shown in FIG. 14 as an example of the holding sealing material of the third embodiment of the present invention, except that a penetration portion 48*c* is formed in the holding sealing material 40C. Avoid 45*c* is formed when the holding sealing material 40C is rolled up.

In the holding sealing material of the present embodiment, a penetration portion is formed in a manner as to penetrate the holding sealing material in a thickness direction of the holding sealing material.

In the holding sealing material of the present embodiment, the number of the penetration portion of the holding sealing material is not particularly limited. Since the larger the number of the penetration portion, the smaller the retention of the holding sealing material is likely to be, the number of the penetration portion is preferably as small as possible, and more preferably one.

In the holding sealing material of the present embodiment, position of the penetration portion is not particularly limited. Preferably, the penetration portion is formed in the holding sealing material at a position facing, via the exhaust gas-treating body, the void that is formed in the neighborhood of the first end face and the second end face of the holding sealing material when an exhaust gas purifying apparatus is manufactured using the holding sealing material of the present embodiment.

In the holding sealing material of the present embodiment, examples of the shape of the penetration portion of the holding sealing material include approximately round-pillar shape, approximately rectangular-pillar shape, approximately cylindroid shape, approximately truncated cone shape, and pillar shape having a bottom face surrounded by approximately straight line and approximately arc line. Examples of the cross-sectional shape of the penetration portion include approximately round shape, approximately polygonal shape such as approximately rectangular shape, approximately ellipsoidal shape, approximately race track shape, and the like.

In the case of manufacturing an exhaust gas purifying apparatus using the holding sealing material of the present embodiment, the cross-sectional shape of the penetration portion may be matched with the cross-sectional shape an electrode member and the like.

Moreover, if a plurality of penetration portions are formed in the holding sealing material, the shapes of the penetration portions may be the same or may be different from one another.

The cross-sectional shape of the penetration portion refers to a cross-section in approximately parallel with the main face of the holding sealing material.

As used herein, the terms "approximately round pillar shape", "approximately round shape", "approximately perpendicular", "approximately parallel" and the like indicate that the shapes may not mathematically strict and respectively include shapes which are substantially the same as "round pillar shape", "round shape", "perpendicular", "parallel" and the like.

In the holding sealing material of the present embodiment, the diameter of the cross section of the penetration portion of the holding sealing material is preferably from about 1 mm to about 100 mm and more preferably from about 20 mm to about 40 mm.

If the diameter of the cross section of the penetration portion of the holding sealing material is about 1 mm or more, an electrode member or the like is more likely to be disposed at the penetration portion when the holding sealing material is used in the exhaust gas purifying apparatus. Meanwhile, if the diameter of the cross section of the penetration portion of the holding sealing material is about 100 mm or less, the area of the holding sealing material tends not to be too small, which tends not to deteriorate the retention of the holding sealing material. Moreover, if the diameter of the cross section of the penetration portion of the holding sealing material is about 100 mm or less, the area of the holding sealing material in the width direction of the holding sealing material tends not to decrease, which tends not to deteriorate the tensile strength of the holding sealing material.

Moreover, in the holding sealing material of the present embodiment, the cross-sectional area of the penetration portion of the holding sealing material is preferably from about 1 $mm^2$ to about 10000 $mm^2$, and more preferably from about 400 $mm^2$ to about 1600 $mm^2$.

If the cross-sectional area of the penetration portion of the holding sealing material is about 1 mm or more, a sufficient area for disposing the electrode member or the like are more likely to be secured in use of the holding sealing material in the exhaust gas purifying apparatus. If the cross-sectional area of the penetration portion of the holding sealing material is about 10000 $mm^2$ or less, the area of the holding sealing material is not too small, which tends not to deteriorate the retention of the holding sealing material.

The diameter of the cross section of the penetration portion refers to a diameter of a part approximately perpendicular to the thickness direction of the holding sealing material. In the case that the cross-sectional shape of the penetration portion is not a approximately round shape, the diameter refers to the maximum length passing through the center. The diameter of the cross section of the penetration portion is, for example, the diameter of the cross section if the penetration portion has approximately round pillar shape, the longer diameter of the cross section if the penetration portion has approximately cylindroid pillar shape, and the length of the longest part in the cross section if the penetration portion has approximately rectangular pillar shape or approximately polygonal pillar shape. If the penetration portion has approximately truncated cone shape, the diameter refers to the diameter of the approximately larger circle.

The holding sealing material of the present embodiment may contain a binder such as an organic binder.

The holding sealing material of the present embodiment may be a needle mat obtained by performing a needling treatment on a base mat including inorganic fibers.

The following description will discuss one example of the method for manufacturing the holding sealing material of the present embodiment.

For example, a method including manufacturing the holding sealing material according to any one of the first to the third embodiment of the present invention and forming a penetration portion by punching the manufactured holding sealing material with a punching blade in a predetermined shape; a method including forming the penetration portion by punching simultaneously upon punching out the base mat; and the like are exemplified.

The holding sealing material of the present embodiment can be manufactured by the methods mentioned earlier.

Next, an exhaust gas purifying apparatus according to the fourth embodiment of the present invention will be described.

Figure 20A:
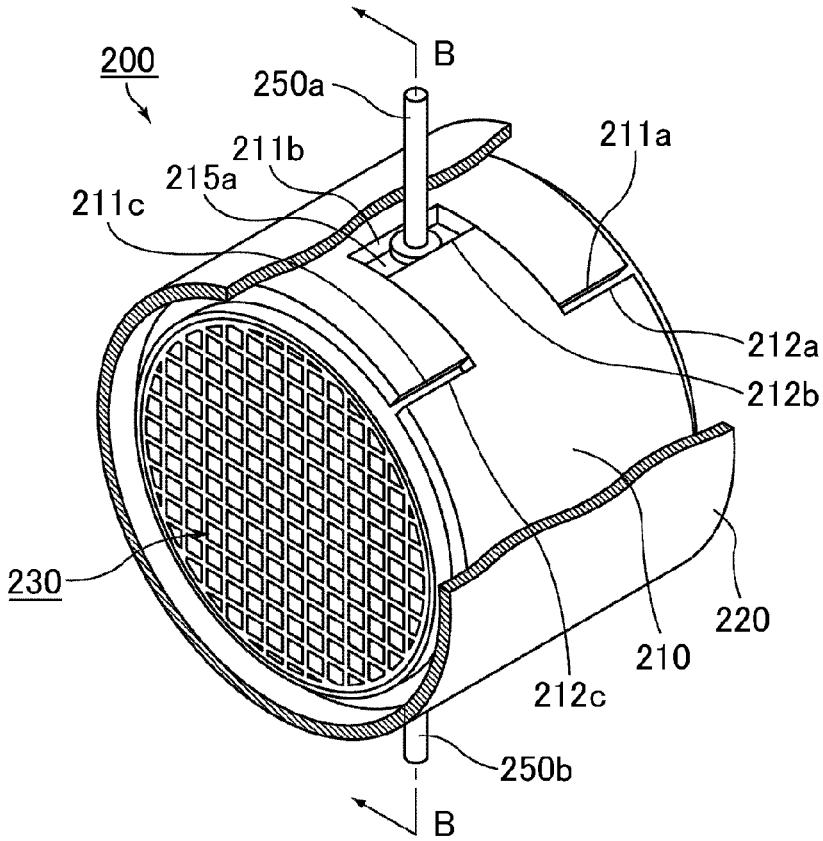
FIG. 20A is a perspective cross-sectional cutaway view schematically showing an example of an exhaust gas purifying apparatus according to the fourth embodiment of the present invention.
Figure 20B:
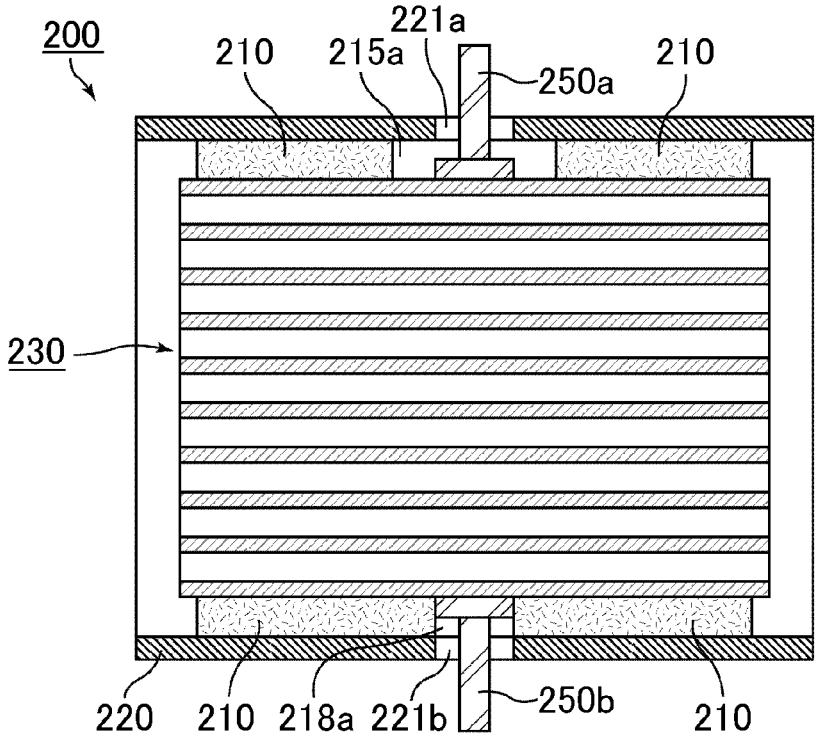
FIG. 20B is a B-B line cross-sectional view of the exhaust gas purifying apparatus shown in FIG. 20A.

FIG. 20A is a perspective cross-sectional cutaway view schematically showing an example of an exhaust gas purifying apparatus according to the fourth embodiment of the present invention. FIG. 20B is a B-B line cross-sectional view of the exhaust gas purifying apparatus shown in FIG. 20A.

An exhaust gas purifying apparatus 200 shown in FIG. 20A and FIG. 20B includes a casing 220, an exhaust gas-treating body 230 housed in the casing 220, and a holding sealing material 210 disposed between the exhaust gas-treating body 230 and the casing 220.

The exhaust gas purifying apparatus 200 further includes electrode members 250*a* and 250*b* which are connected to the exhaust gas-treating body 230, pass through the holding sealing material 210, and penetrate the casing 220. The electrode member 250*a* is an electrode member on the positive side and the electrode member 250*b* is an electrode member on the negative side.

The holding sealing material 210 is wound around the exhaust gas-treating body 230. The exhaust gas-treating body 230 is held by the holding sealing material 210.

An inlet pipe for introducing exhaust gas discharged from the internal combustion engine and an exhaust pipe for discharging the exhaust gas having passed through the exhaust gas-treating body to the outside are connected to ends of the casing 220, if necessary.

The exhaust gas purifying apparatus of the present embodiment is more likely to be used as an electrically heated catalyst converter.

In the exhaust gas purifying apparatus 200 shown in FIG. 20A and FIG. 20B, application of a predetermined voltage between the electrode member 250*a* on the positive side and the electrode member 250*b* on the negative side powers the exhaust gas-treating body 230 existing between the electrode member 250*a* on the positive side and the electrode member 250*b* on the negative side. As a result, the exhaust gas-treating body 230 generates heat.

The above process heats a catalyst supported on the exhaust gas-treating body 230 so that the catalyst is activated. As a result, oxidation and reduction reactions of toxic gas components such as CO, HC, and NOx contained in the exhaust gas proceed, converting the toxic gas components.

The following description will discuss the holding sealing material forming the exhaust gas purifying apparatus of the present embodiment.

The exhaust gas purifying apparatus of the present embodiment uses the holding sealing material of the present embodiment.

FIG. 20A and FIG. 20B show an example of an exhaust gas purifying apparatus 200 in which the holding sealing material 40A illustrated in FIG. 19A is used as the holding sealing material 210.

As shown in FIG. 20A and FIG. 20B, a void 215*a* is formed in the neighborhood of a first end face 211*b* and a second end face 212*b* in the void-forming section of the holding sealing material 210 which is wound around an exhaust gas-treating body 230. A positive-side electrode member 250*a* is disposed at the void 215*a*.

Moreover, a penetration portion 218*a* is formed in the holding sealing material 210, and a negative-side electrode member 250*b* is disposed at the penetration portion 218*a* in the holding sealing material.

In the exhaust gas purifying apparatus of the present embodiment, a negative-side electrode member may be disposed in a void formed in the neighborhood of the first end face and the second end face of the holding sealing material, and a positive-side electrode member may be formed in the penetration portion.

In the exhaust gas purifying apparatus of the present embodiment, the first end face and the second end face in the contact section of the holding sealing material may contact each other without a gap or may form a gap with a predetermined size.

In the case where a gap is formed between the first end face and the second end face in the contact section of the holding sealing material, an electrode member and/or a sensor are more likely to be disposed at the gap. In the case where a gap is formed between the first end face and the second end face in the contact section of the holding sealing material, the distance between the first end face and the second end face in the contact section of the holding sealing material is preferably about 80 mm or less, more preferably from about 5 mm to about 80 mm, and further preferably from about 5 mm to about 20 mm. If the distance between the first end face and the second end face in the contact section of the holding sealing material is about 80 mm or less, the area of the holding sealing material contacting the exhaust gas-treating body tends not to decrease. The holding sealing material thus tends to easily hold the exhaust gas-treating body. If the distance between the first end face and the second end face in the contact portion of the holding sealing material is about 5 mm or more, the gap is not too small. Therefore, an electrode member and/or a sensor may become easier to be disposed at the gap.

The exhaust gas-treating body explained in the first embodiment of the present invention may be used as the exhaust gas-treating body forming the exhaust gas purifying apparatus of the present embodiment.

The following description will discuss the casing forming the exhaust gas purifying apparatus of the present embodiment.

Figure 21:
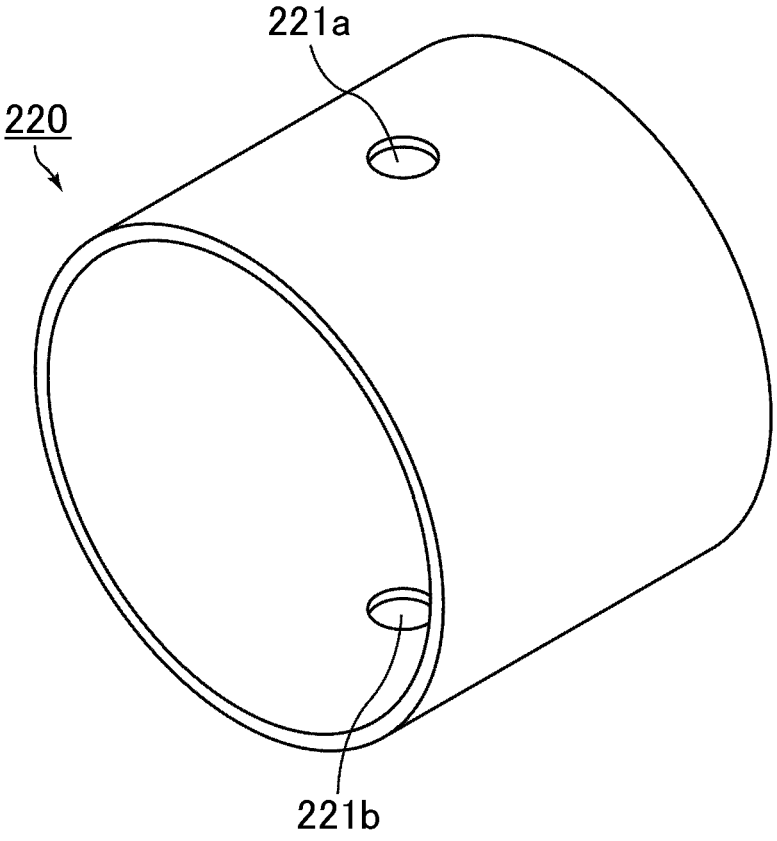
FIG. 21 is a perspective view schematically showing an example of a casing forming the exhaust gas purifying apparatus according to the fourth embodiment of the present invention.

FIG. 21 is a perspective view schematically showing an example of a casing forming the exhaust gas purifying apparatus according to the fourth embodiment of the present invention. The casing 220 shown in FIG. 21 is mainly made of metal such as stainless steel, and has a approximately cylindrical shape. The casing 220 has holes 221*a* and 221*b* for allowing an electrode member to penetrate therethrough.

The inner diameter of the casing 220 is made slightly shorter than a sum of the diameter of an end face of the exhaust gas-treating body and the thickness of the holding sealing material wound around the exhaust gas-treating body.

Meanwhile, the length of the casing may be slightly longer than the longitudinal direction length of the exhaust gas-treating body or may be approximately the same with the longitudinal direction length of the exhaust gas-treating body.

In the exhaust gas purifying apparatus 200 illustrated in FIG. 20A and FIG. 20B, the location of the void 215*a* formed in the neighborhood of the first end face and the second end face in the void-forming section of holding sealing material 210 corresponds with the location of the hole 221*a* in the casing 220. The location of the penetration portion 218*a* in the holding sealing material 210 corresponds with the location of the hole 221*b* in the casing 220. The positive-side electrode member 250*a* is disposed at the void 215*a* formed in the neighborhood of the first end face and the second end face in the void-forming section of the holding sealing material 210 and in the hole 221*a* of the casing 220. The negative-side electrode member 250*b* is disposed in the penetration portion 218*a* of the holding sealing material 210 and in the hole 221*b* of the casing 220.

The electrode member forming the exhaust gas purifying apparatus of the present embodiment will be explained.

The electrode member is connected with a battery power supply. Voltage is directly applied from the battery power supply to the electrode member. Accordingly, the exhaust gas-treating body connected with the electrode member is more likely to be charged with a current.

The position to dispose the electrode member is not particularly limited. Taking an efficient heating of the exhaust gas-treating body into consideration, the electrode members are preferably disposed at a position where the positive-side electrode member and the negative-side electrode member stand opposite one another.

The exhaust gas purifying apparatus of the present embodiment may further include a sensor such as a temperature sensor and an oxygen sensor, similarly to the exhaust gas purifying apparatus according to the first embodiment of the present invention.

Figure 22A:
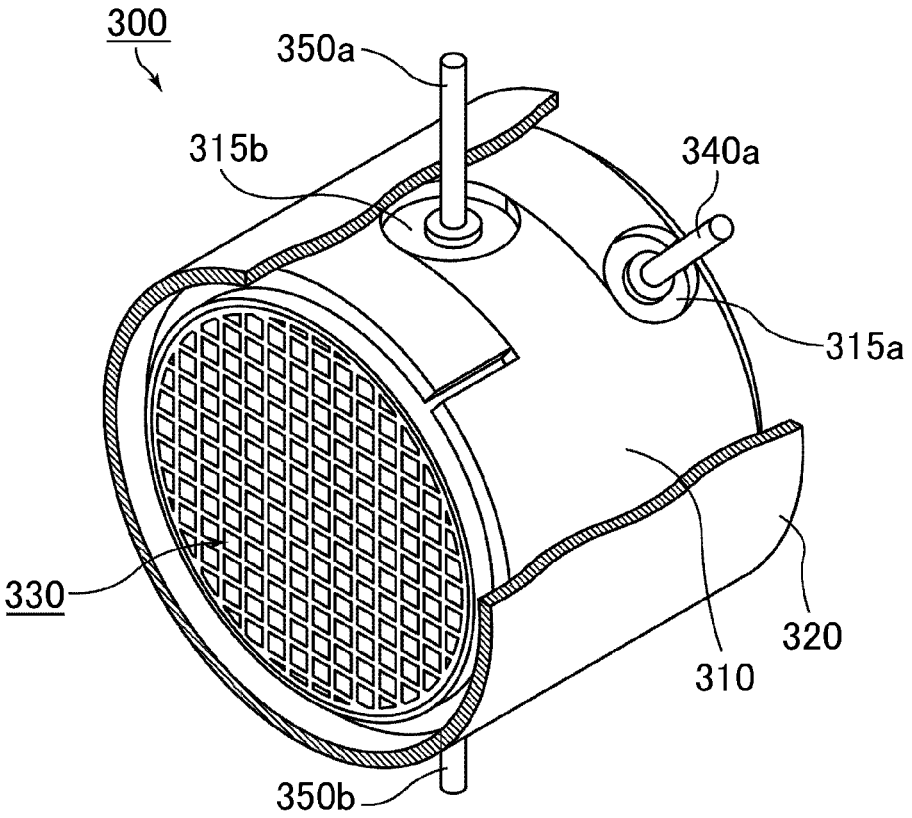
FIG. 22A is a perspective cross-sectional cutaway view schematically showing other example of the exhaust gas purifying apparatus according to the fourth embodiment of the present invention.
Figure 22B:
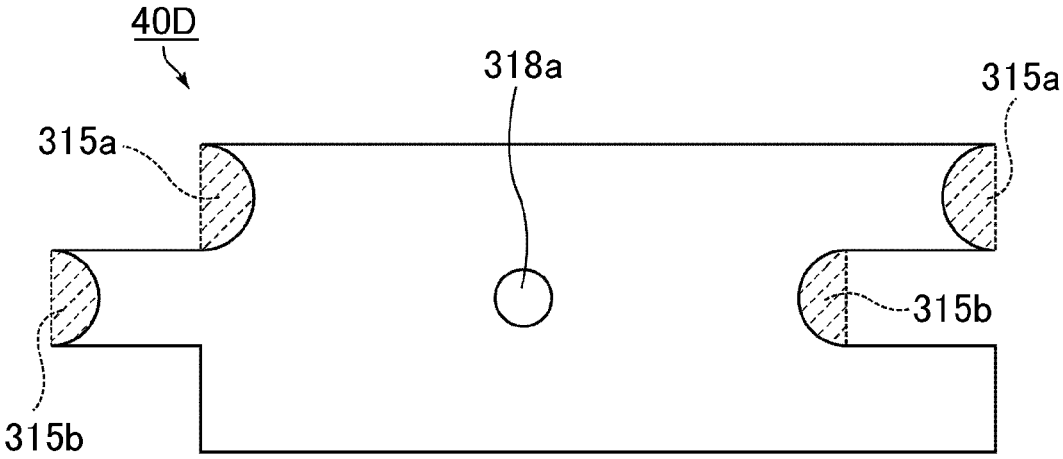
FIG. 22B is a plain view schematically illustrating the holding sealing material forming the exhaust gas purifying apparatus shown in FIG. 22A.

FIG. 22A is a perspective cross-sectional cutaway view schematically showing other example of the exhaust gas purifying apparatus according to the fourth embodiment of the present invention. FIG. 22B is a plain view schematically illustrating the holding sealing material forming the exhaust gas purifying apparatus shown in FIG. 22A.

In an exhaust gas purifying apparatus 300 shown in FIG. 22A, a holding sealing material 40D shown in FIG. 22B is used as the holding sealing material 310. In this case, for example, a sensor 340*a*, a positive-side electrode member 350*a*, and a negative-side electrode member 350*b* are more likely to be disposed in avoid 315*a*, a void 315*b*, and a penetration portion 318*a*, respectively, in the holding sealing material 310.

Although not shown in FIG. 22A, a casing 320 forming the exhaust gas purifying apparatus 300 is provided with three holes for allowing the sensor and the electrode members to penetrate therein.

The following description will discuss the method for manufacturing an exhaust gas purifying apparatus according to the fourth embodiment of the present invention with reference to the drawings.

FIG. 23A, FIG. 23B, FIG. 23C, and FIG. 23D each are a perspective view schematically showing an example of a method for manufacturing the exhaust gas purifying apparatus according to the fourth embodiment of the present invention.

FIG. 23A, FIG. 23B, FIG. 23C, and FIG. 23D illustrate a method for manufacturing the exhaust gas purifying apparatus 200 shown in FIG. 20A and FIG. 20B as an example of the method for manufacturing the exhaust gas purifying apparatus according to the fourth embodiment of the present invention.

Figure 23A:
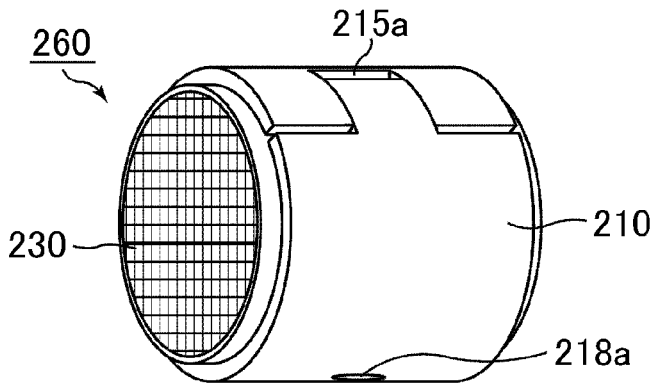
FIG. 23A, FIG. 23B, FIG. 23C, and FIG. 23D each are a perspective view schematically showing an example of a method for manufacturing an exhaust gas purifying apparatus according to the fourth embodiment of the present invention.

First, as shown in FIG. 23A, winding process is performed by winding the holding sealing material 210 around the exhaust gas-treating body 230 to manufacture a wound body (exhaust gas-treating body wound with the holding sealing material) 260.

The holding sealing material 40A illustrated in FIG. 19A is used as the holding sealing material 210. In this case, the void 215*a* is formed in the neighborhood of the first end face and the second end face in the void-forming section of the holding sealing material.

The penetration portion 218*a* is formed in the holding sealing material 210.

Depending on the relation between the length of the holding sealing material and the circumferential length of the exhaust gas-treating body, the first end face and the second end face in the contact section of the holding sealing material may contact each other, or may form a gap without contacting.

Figure 23B:
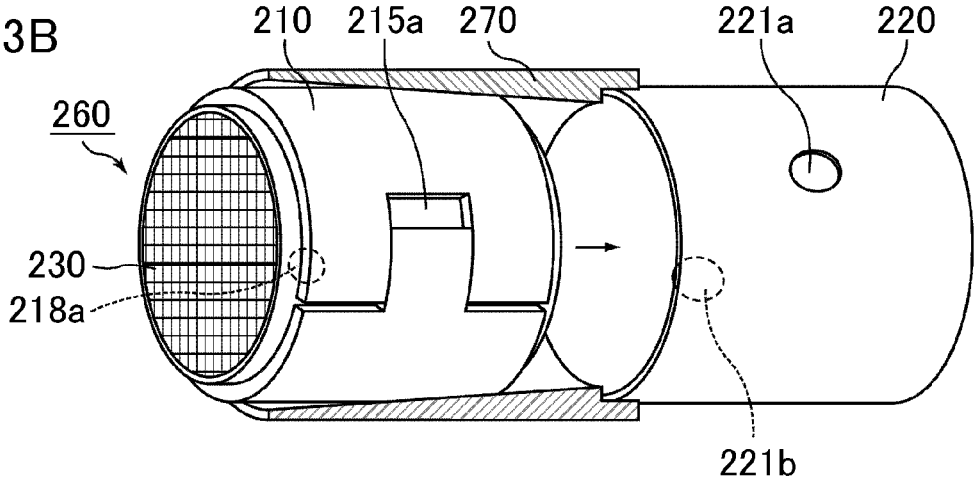

Next, as shown in FIG. 23B, housing process is performed by housing the manufactured wound body 260 in the casing 220 having approximately a cylindrical shape.

Examples of the method for housing the wound body in the casing include a press-fitting method (stuffing method), a sizing method (swaging method), and a clam shell method, which are explained in the first embodiment of the present invention.

A press-fitting method (stuffing method) or a sizing method (swaging method) is preferable among the methods for housing the wound body in the casing. This is because a press-fitting method (stuffing method) or a sizing method (swaging method) does not require two parts as casing, and therefore the number of manufacturing process is more likely to be reduced.

FIG. 23B illustrates a method for stuffing the wound body 260 in the casing 220 with a stuffing jig 270.

The stuffing jig 270 has a similar structure as that of the stuffing jig 170 explained in the first embodiment of the present invention.

The method for stuffing the wound body in the casing is not particularly limited, and may be a method including stuffing the wound body by pushing the wound body with hands into the casing, and the like.

Figure 23C:
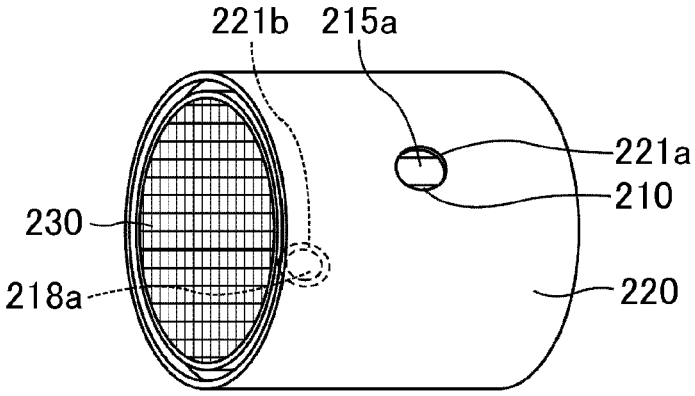

Thereafter, as shown in FIG. 23C, position adjustment process is performed by adjusting the position of the void 215*a* formed in the neighborhood of the first end face and the second end face in the void-forming section of the holding sealing material 210 and the position of the penetration portion 218*a* to the positions of the hole 221*a* and 221*b* of the casing 220, respectively.

As the method for adjusting the position of the void and the position of the penetration portion to the positions of the holes of the casing, a method including rotation of the wound body housed in the casing, and the like can be exemplified.

In the above housing process, in the case of housing the wound body in the casing while adjusting the positions of the void and the penetration portion to match the position of the holes of the casing, the housing process and the position adjustment process are more likely to be performed simultaneously.

Thereafter, the first disposing process is performed by disposing an electrode member in a manner as to be connected with the exhaust gas-treating body, to pass through the holding sealing material, and to penetrate the casing. Also, the second disposing process is performed by disposing another electrode member in a manner as to be connected with the exhaust gas purifying apparatus, to pass through the holding sealing material, and to penetrate the casing.

Figure 23D:
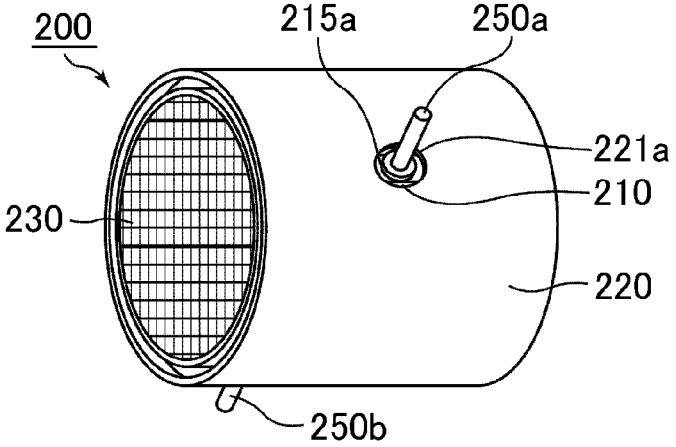

As shown in FIG. 23D, in the first disposing process, the positive-side electrode member 250*a* is allowed to pass through the hole 221*a* which is one of the holes formed in the casing 220 and the void 215*a* formed in the neighborhood of the first end face and the second end face in the void-forming section of the holding sealing material 210 so that the positive-side electrode member 250*a* is connected to the exhaust gas-treating body 230. In the second disposing process, the negative-side electrode member 250*b* is allowed to pass through the other hole 221*b* formed in the casing 220 and the penetration portion 218*a* formed in the holding sealing material 210 so that the negative-side electrode member 250*b* is connected to the exhaust gas-treating body 230.

Either the first disposing process or the second disposing process may be performed first as long as the disposing processes are performed after the position adjustment process (after the housing process in the case where housing process and the position adjustment process are simultaneously performed).

Through the above process, the exhaust gas purifying apparatus 200 shown in FIG. 20A and FIG. 20B can be manufactured.

In the aforementioned method for manufacturing an exhaust gas purifying apparatus according to the present embodiment, the positive-side electrode member is disposed at the void and the hole of the casing, and the negative-side electrode member is disposed in the penetration portion and the hole of the casing after housing the wound body in the casing.

In the method for manufacturing an exhaust gas purifying apparatus according to the present embodiment, if a clam shell method is applied, the wound body may be housed in the casing in a following manner. Namely, the wound body is placed on the first casing having holes in a manner that the position of the penetration portion of the holding sealing material corresponds to the hole of the first casing; the positive-side electrode member is disposed at the void; the negative-side electrode member is disposed at the penetration portion and the hole of the first casing; and then the second casing is placed on top with the positive-side electrode member passing through the hole formed in the second casing.

Moreover, in the method for manufacturing an exhaust gas purifying apparatus according to the present embodiment, if a clam shell method is applied, an electrode-attached wound body may be manufactured as follows. Namely, an electrode-attached body is prepared by firstly fixing the positive-side electrode member and the negative-side electrode member to predetermined positions of the exhaust gas-treating body; allowing the negative-side electrode member to pass through the penetration portion in the holding sealing material; and then winding the holding sealing material around the exhaust gas-treating body in a manner avoiding the positive-side electrode member. In this case, after placing the electrode-attached wound body on the first casing having a hole in a manner to allow the negative-side electrode member to pass through the hole, the second casing is placed on top in a manner allowing the positive-side electrode member to pass through the hole formed in the second casing so that the wound body is housed in the casing.

In the present embodiment, not only the effects (1) to (10) explained in the first to the third embodiments of the present invention but also the following effects can be exerted.

(11) In the holding sealing material of the present embodiment, a penetration portion penetrating the holding sealing material in the thickness direction of the holding sealing material is formed.

In the case of manufacturing the exhaust gas purifying apparatus using the holding sealing material of the present embodiment, an electrode member is more likely to be disposed at the void formed in the neighborhood of the first end face and the second end face of the holding sealing material, and also an electrode member is more likely to be disposed at the penetration portion in the holding sealing material.

(12) Since electrode members are more likely to be disposed in the exhaust gas purifying apparatus of the present embodiment, the exhaust gas purifying apparatus of the present embodiment is more likely to be used as an electrically heated catalyst converter.

Fifth Embodiment

The following description will discuss a fifth embodiment that is one of the embodiments of the present invention.

In the first to the fourth embodiments of the present invention, each of the first end face and the second end face of the holding sealing material has three levels of steps. In contrast, in the fifth embodiment of the present invention, each of the first end face and the second end face of the holding sealing material has two levels of steps.

First, the holding sealing material according to the fifth embodiment of the present invention will be described.

The holding sealing material according to the fifth embodiment of the present invention has a similar structure as that of the holding sealing material according to any of the first to the fourth embodiments of the present invention, except that two levels of steps are provided in the fifth embodiment.

In the holding sealing material of the present embodiment, one projected portion is formed in the first end face, and one projected portion is formed in the second end face. Namely, the holding sealing material of the present embodiment has two levels of steps.

Figure 24A:
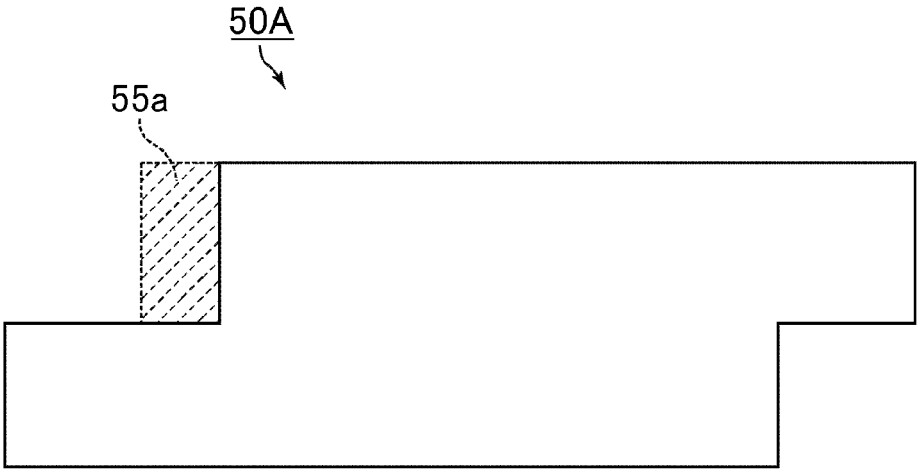
FIG. 24A, FIG. 24B, and FIG. 24C each are a plain view schematically showing an example of a holding sealing material according to a fifth embodiment of the present invention.
Figure 24B:
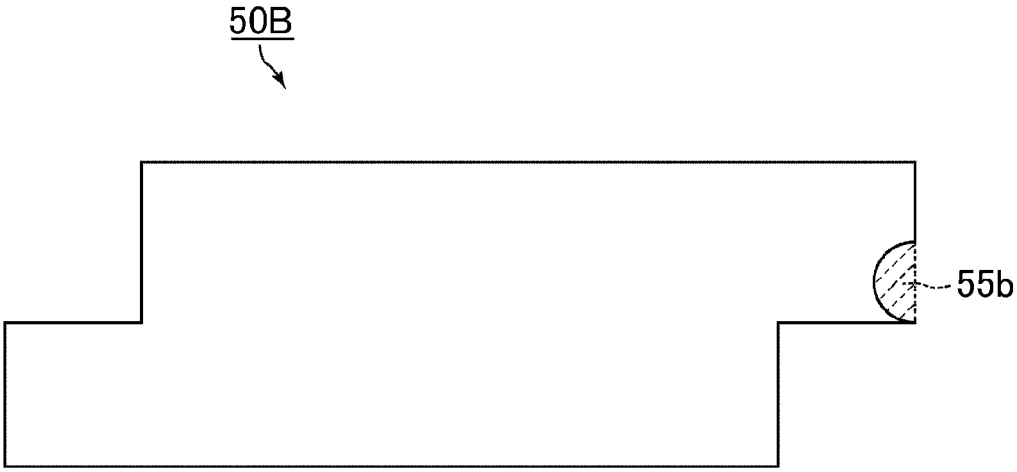
Figure 24C:
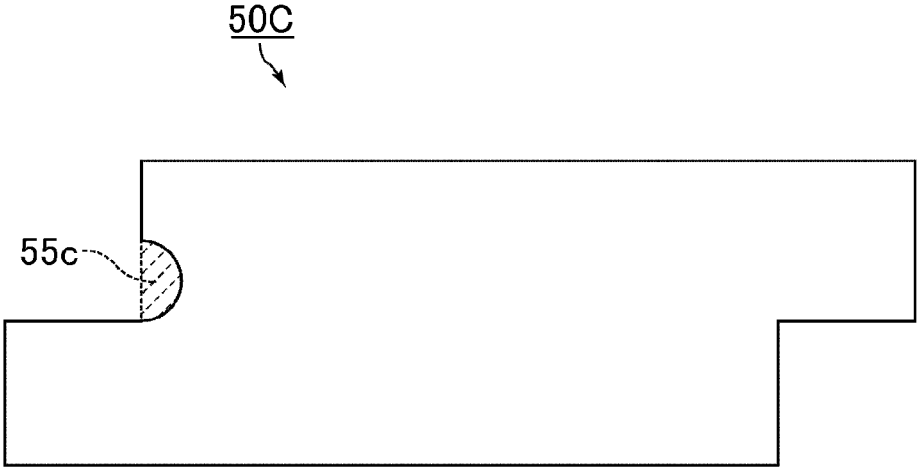

FIG. 24A, FIG. 24B, and FIG. 24C each are a plain view schematically showing an example of the holding sealing material according to the fifth embodiment of the present invention.

A holding sealing material 50A shown in FIG. 24A has a similar structure as that of the holding sealing material 10A shown in FIG. 2 as an example of the holding sealing material of the first embodiment of the present invention, except that two levels of steps are provided in the holding sealing material 50A. A void 55*a* is formed when the holding sealing material 50A is rolled up.

A holding sealing material 50B shown in FIG. 24B has a similar structure as that of the holding sealing material 20A shown in FIG. 10 as an example of the holding sealing material of the second embodiment of the present invention, except that two levels of steps are provided in the holding sealing material 50B. A void 55*b* is formed when the holding sealing material 50B is rolled up.

A holding sealing material 50C shown in FIG. 24C has a similar structure as that of the holding sealing material 30A shown in FIG. 14 as an example of the holding sealing material of the third embodiment of the present invention, except that two levels of steps are provided in the holding sealing material 50C. A void 55*c* is formed when the holding sealing material 50C is rolled up.

As described above, in the holding sealing material 50A shown in FIG. 24A, the holding sealing material 50B shown in FIG. 24B, and the holding sealing material 50C shown in FIG. 24C, each projected portion and the portion opposite to the projected portion forms a void without fitting when the holding sealing material is rolled up.

In the holding sealing material of the present embodiment, the penetration portion explained in the fourth embodiment of the present invention may be formed.

Figure 25A:
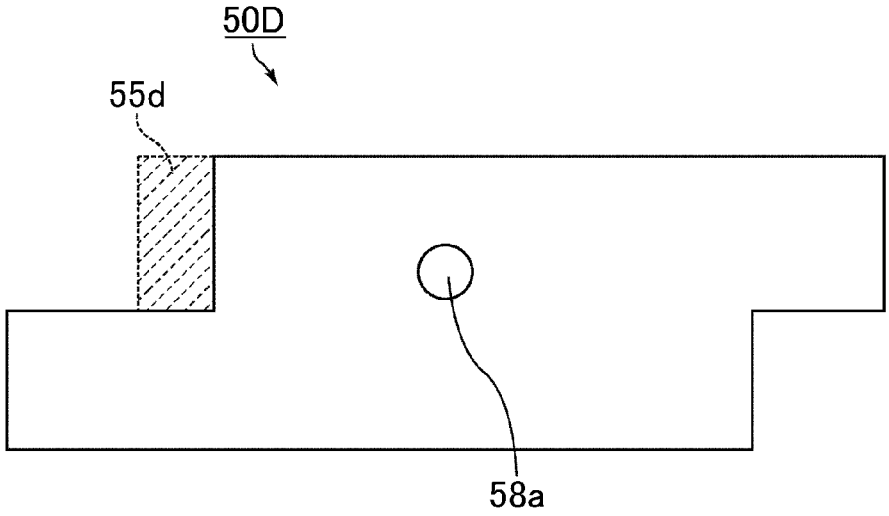
FIG. 25A, FIG. 25B, and FIG. 25C each are a plain view schematically showing other example of a holding sealing material according to the fifth embodiment of the present invention.
Figure 25B:
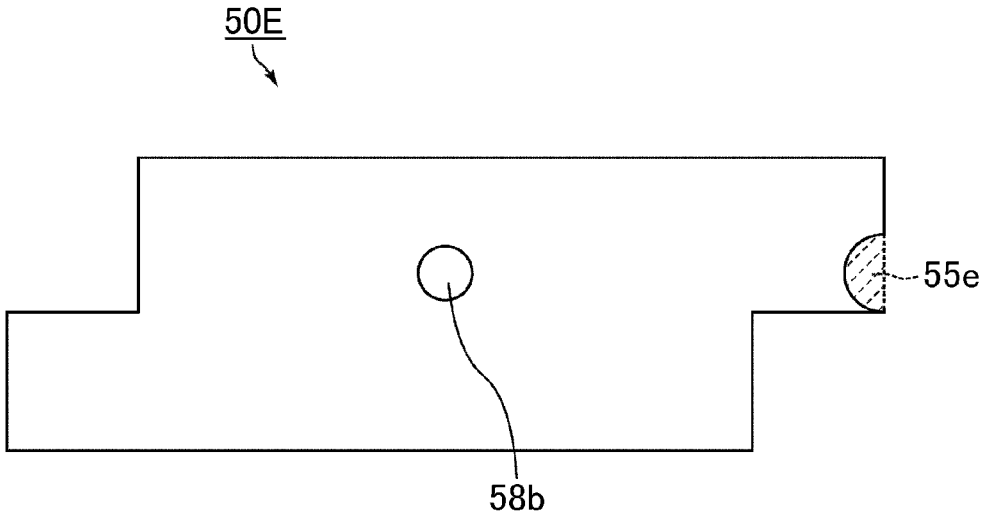
Figure 25C:
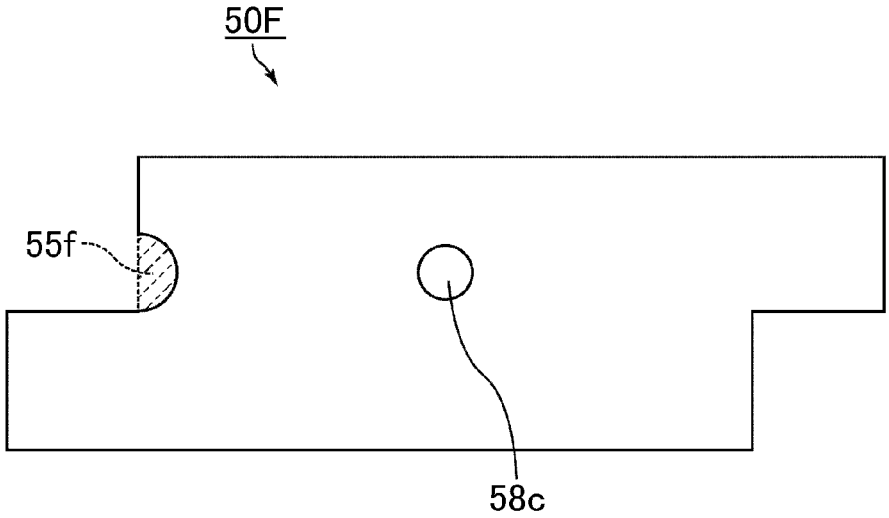

FIG. 25A, FIG. 25B, and FIG. 25C each are a plain view schematically showing other example of a holding sealing material according to the fifth embodiment of the present invention.

In a holding sealing material 50D illustrated in FIG. 25A, the penetration portion 58*a* explained in the fourth embodiment of the present invention is formed in the holding sealing material 50A illustrated in FIG. 24A. Avoid 55*d* is formed when the holding sealing material 50D is rolled up.

In a holding sealing material 50E illustrated in FIG. 25B, the penetration portion 58*b* explained in the fourth embodiment of the present invention is formed in the holding sealing material 50B illustrated in FIG. 24B. Avoid 55*e* is formed when the holding sealing material 50E is rolled up.

In a holding sealing material 50F illustrated in FIG. 25C, the penetration portion 58*c* explained in the fourth embodiment of the present invention is formed in the holding sealing material 50C illustrated in FIG. 24C. Avoid 55*f* is formed when the holding sealing material 50F is rolled up.

Next, the exhaust gas purifying apparatus according to the fifth embodiment of the present invention will be described.

The exhaust gas purifying apparatus according to the fifth embodiment of the present invention has a similar structure as that of the exhaust gas purifying apparatus according to any of the first to the fourth embodiment of the present invention except for the structure of the holding sealing material.

The holding sealing material of the present embodiment is used in the exhaust gas purifying apparatus of the present embodiment.

The method for manufacturing the exhaust gas purifying apparatus according to the fifth embodiment of the present invention is similar with the method for manufacturing the exhaust gas purifying apparatus according to any of the first to the fourth embodiment of the present invention.

The present embodiment can exert the effects (1) to (12) explained in the first to the fourth embodiments of the present invention.

Other Embodiments

In the holding sealing material according to the first to the fourth embodiments of the present invention, each of the first end face and the second end face has three levels of steps. In the holding sealing material according to the fifth embodiment of the present invention, each of the first end face and the second end face has two levels of steps.

However, in the holding sealing material of the embodiments of the present invention, the number of levels of the steps formed by the projected portions in the holding sealing material is not particularly limited. Therefore, each of the first end face and the second end face of the holding sealing material may have four levels or more of steps.

In the holding sealing material of the embodiments of the present invention, the number of levels of steps provided in the first end face of the holding sealing material may be different from that of levels of steps provided in the second end face of the holding sealing material.

Moreover, the holding sealing material of the embodiments of the present invention may have a structure in which one of the first end face and the second end face of the holding sealing material has a step and the other does not have a step.

In the holding sealing material of the embodiments of the present invention, the first end face and the second end face may not have a step.

Figure 26:
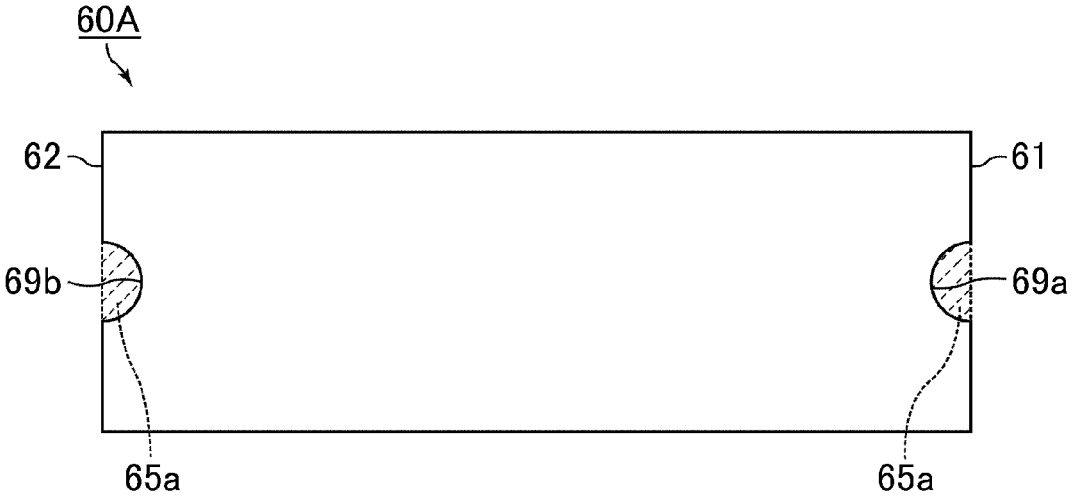
FIG. 26 is a plain view schematically showing other example of a holding sealing material according to the embodiments of the present invention.

FIG. 26 is a plain view schematically showing other example of a holding sealing material according to the embodiments of the present invention.

In a holding sealing material 60A shown in FIG. 26, a first end face 61 and a second end face 62 do not have a step. The holding sealing material 60A has an end-face notch 69*a* formed in the first end face 61 in the length direction of the holding sealing material and has an end-face notch 69*b* formed in the second end face 62.

Therefore, when the holding sealing material 60A shown in FIG. 26 is rolled up, the first end face 61 is more likely to be made in contact with the second end face 62 at a portion where the end-face notches 69*a* and 69*b* are not formed. In contrast, at a portion where the end-face notches 69*a* and 69*b* are formed, the first end face 61 cannot be made in contact with the second end face 62. As a result, a void 65*a* is formed in the neighborhood of the end-face notches 69*a* and 69*b*.

In the exhaust gas apparatus according to the first to the third embodiments of the present invention, the holding sealing material according to the first to the third embodiments of the present invention, respectively, are used as a holding sealing material forming the exhaust gas purifying apparatus. Further, a sensor such as a temperature sensor and an oxygen sensor is disposed in a void formed in the neighborhood of the first end face and the second end face of the holding sealing material.

In the exhaust gas purifying apparatus of the embodiments of the present invention, in the case that the holding sealing material according to anyone of the first to the third embodiments of the present invention is used as the holding sealing material forming the exhaust gas-purifying apparatus, the member disposed at the void formed in the neighborhood of the first end face and the second end face of the holding sealing material is not limited to a sensor, and may be an electrode member as well.

For example, in the case of using the holding sealing material 10B shown in FIG. 5A is used as the holding sealing material forming the exhaust gas purifying apparatus, an electrode member is more likely to be disposed in each of the void 15*b* and the void 15*c*.

In the exhaust gas purifying apparatus of the embodiments of the present invention, an electrode member and/or a sensor may be disposed as long as the electrode member and/or the sensor are/is disposed at the void formed in the neighborhood of the first end face and the second end face in the void-forming section of the holding sealing material. Moreover, a plurality of electrode members and/or sensors may be disposed in a single void.

Furthermore, in the exhaust gas purifying apparatus of the embodiments of the present invention, if a gap is formed between the first end face and the second end face in the contact section of the holding sealing material, an electrode member and/or a sensor may be disposed in the gap.

In the first to the fifth embodiments of the present invention, the methods for manufacturing the exhaust gas purifying apparatus using press-fitting system (stuffing system) are mainly explained.

The exhaust gas purifying apparatuses according to the embodiments of the present invention may also be manufactured by a sizing method (swaging method). One example of the method for manufacturing the exhaust gas purifying apparatus using a sizing method will be explained below with reference to the drawings. Meanwhile, since the winding process, position adjustment process, and disposing process (first disposing process) are similar with those applied in the first embodiment of the present invention, only a housing process will be described.

Figure 27A:
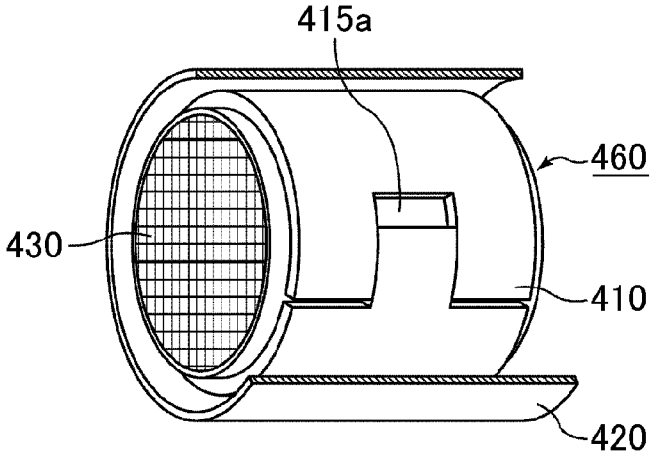
FIG. 27A, FIG. 27B and FIG. 27C each are a perspective view schematically showing other example of housing process in the method for manufacturing an exhaust gas purifying apparatus according to the embodiments of the present invention.
Figure 27B:
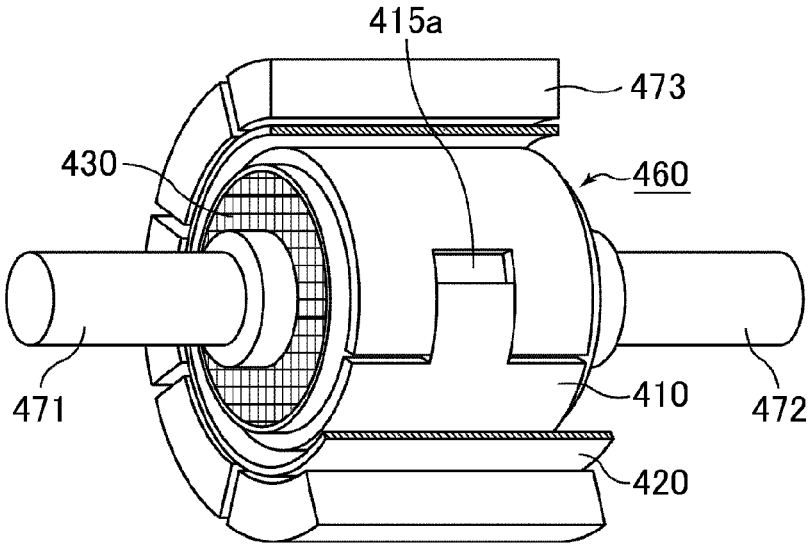
Figure 27C:
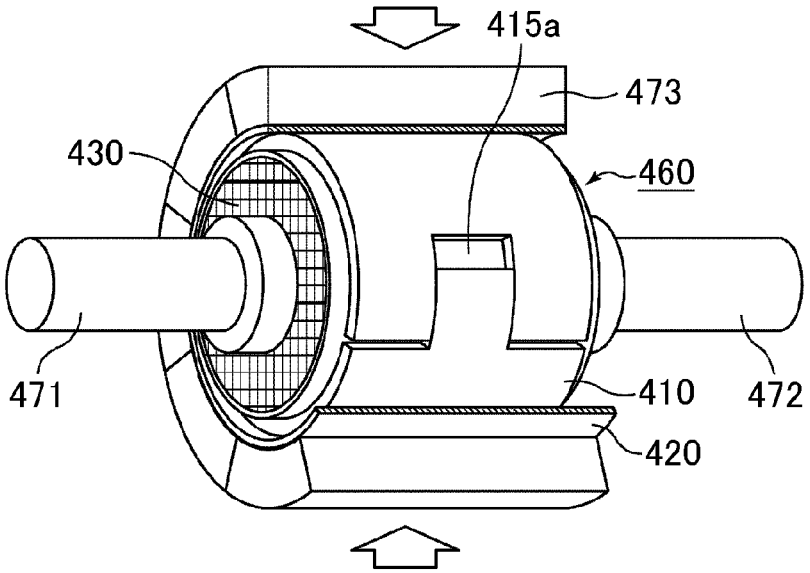

FIG. 27A, FIG. 27B and FIG. 27C each are a perspective view schematically showing other example of housing process in the method for manufacturing an exhaust gas purifying apparatus according to the embodiments of the present invention.

In the housing process, as shown in FIG. 27A, a wound body 460 (an exhaust gas-treating body 430 wound with a holding sealing material 410) is softly introduced into the casing 420.

As used herein, the wording "softly" means "not stuffing," or specifically means introducing the wound body with no contact between the holding sealing material 410 and the inner wall of the casing 420 or introducing the wound body in such a slightly compressed state that does not cause damage in the holding sealing material 410 regardless of occurrence of the contact. Preferably, the wound body is introduced in the casing while being supported by shafts 471 and 472 shown in FIG. 27B in a state that the wound body 460 would drop from the casing 420 unless it is supported by the shafts.

Next, as shown in FIG. 27B, the exhaust gas-treating body 430 is shifted in the casing 420 while being sandwiched by the shafts 471 and 472 so that the exhaust gas-treating body 430 is held at a predetermined position.

Thereafter, the diameter of the casing 420 is reduced as shown in FIG. 27C. In other words, compression force is applied to the outer circumference of the casing 420 to reduce the inner diameter of the casing 420. Specifically, the body of the casing 420 is pressed by a collet 473 from the outer circumference of the casing 420 in the centripetal direction to compress the portion and the holding sealing material 410 existing therein. Thereby, the holding sealing material 410 and the exhaust gas-treating body 430 are held inside the casing 420. The exhaust gas-treating body 430 is held at a predetermined position in the casing 420 by the surface pressure generated by the repulsion from the compressed holding sealing material 410.

Through the above process, the wound body is more likely to be housed in the casing.

In the holding sealing material of the embodiments of the present invention, if a projected portion is formed in the first end face and the second end face, the size of the projected portion forming the contact section is preferably from about 10 mm in width×about 10 mm in length to about 200 mm in width×about 200 mm in length, and more preferably from about 20 mm in width×about 20 mm in length to about 100 mm in width×about 100 mm in length.

If the holding sealing material having the projected portion with the aforementioned shape is used for manufacturing an exhaust gas purifying apparatus, since the holding sealing material tends to fit due to the projected portion, the exhaust gas-treating body is more likely to be firmly supported by the holding sealing material.

If the size of the projected portion forming the contact section is about 10 mm in width×about 10 mm in length or larger, or about 200 mm in width×about 200 mm in length or smaller, the contact area between the first end face and the second end face in the contact section of the holding sealing material is not too small. Therefore, the first end face and the second end face of the holding sealing material are more likely to be bonded one another. As a result, the exhaust gas-treating body is likely to be supported by the holding sealing material in manufacturing the exhaust gas purifying apparatus using the holding sealing material.

The inorganic fibers forming the holding sealing material of the embodiments of the present invention are not limited to the aforementioned inorganic fibers containing alumina and silica, but may be inorganic fibers containing other inorganic compounds as well.

Moreover, of alumina and silica, the inorganic fibers containing only alumina or the inorganic fibers containing only silica may be used.

As the compounding amount of the inorganic fibers containing alumina and silica, a weight ratio in a range from $Al_2O_3$:$SiO_2$=about 60:40 to about 80:20 is preferably used, and more preferably, a weight ratio in a range from $Al_2O_3$:$SiO_2$=about 70:30 to about 74:26 is used.

If the alumina content is the preferable maximum alumina content ($Al_2O_3$:$SiO_2$=about 80:20) or less in the above compounding amount, crystallization of alumina and silica less likely to proceed. Thus, the flexibility of the inorganic fibers tends not to decrease. Moreover, if the silica content is the preferable minimum silica content ($Al_2O_3$:$SiO_2$=about 80:20) or more in the above compounding amount, the rigidity of the inorganic fibers is less likely to be lacking, and sufficient shear strength is more likely to be obtained. As a result, the winding property to the exhaust gas-treating body is not likely to be reduced, and thus the holding sealing material tends not to break.

In the case of the inorganic fibers containing only alumina of alumina and silica, in addition to alumina, for example, additives, such as CaO, MgO and $ZrO_2$, may be contained therein.

The inorganic fibers containing only silica, of alumina and silica, may also contain additives such as CaO, MgO and $ZrO_2$, in addition to silica.

The average fiber length of the inorganic fibers forming the holding sealing material of the embodiments of the present invention is preferably from about 5 mm to about 150 mm, and more preferably from about 10 mm to about 80 mm.

In the case of the inorganic fibers having average fiber length of about 5 mm or more, since the fiber length of the inorganic fibers is not too short, the inorganic fibers tend not to insufficiently entangle one another. As a result, the holding sealing material tends not to have low shear strength. In the case of the inorganic fibers having average fiber length of about 150 mm or less, since the fiber length of the inorganic fibers is not too long, handling property of the inorganic fibers is less likely to be deteriorated in manufacturing the holding sealing material. As a result, the winding property to the exhaust gas-treating body is less likely to be deteriorated, and thus the holding sealing material tends not to break easily.

The average fiber diameter of the inorganic fibers forming the holding sealing material of the embodiments of the present invention is preferably from about 1 μm to about 20 μm, and more preferably from about 3 μm to about 10 μm.

In the case of the inorganic fibers having average fiber diameter of from about 1 μm to about 20 μm, the strength and the flexibility of the inorganic fibers are likely to be sufficiently high, making it easier to improve the shear strength of the holding sealing material.

In the case of the inorganic fibers having average fiber diameter of about 1 μm or more, the inorganic fibers are not thin and thus tend not to break easily, and therefore the tensile strength of the inorganic fibers tends not to be insufficient. In the case of the inorganic fibers having average fiber diameter of about 20 μm or less, the inorganic fibers tend to bend, therefore the flexibility tends not to be insufficient.

The weight per unit area of the holding sealing material of the embodiments of the present invention is preferably from about 500 g/m$^2$ to about 7000 g/m$^2$, and more preferably from about 1000 g/m$^2$ to about 4000 g/m$^2$, although not limited thereto. In the case of the weight per unit area of the holding sealing material of about 500 g/m$^2$ or more, the holding sealing material tends to have sufficient retention. In the case of the weight per unit area of the holding sealing material of about 7000 g/m$^2$ or less, the volume of the holding sealing material is more likely to be reduced. For this reason, if an exhaust gas purifying apparatus is manufactured by using the holding sealing material of the above two cases, the exhaust gas-treating body is less likely to drop from the casing.

The bulk density of the holding sealing material of the embodiments of the present invention (bulk density of the holding sealing material before a wound body is stuffed into a casing) is preferably from about 0.05 g/cm$^2$ to about 0.30 g/cm$^2$, although not limited thereto. In the case of the bulk density of the holding sealing material of about 0.05 g/cm or more, the inorganic fibers tend not to weakly entangle and tend not to separate from one another. Therefore, a predetermined shape of the holding sealing material is more likely to be maintained. In the case of the bulk density of the holding sealing material of about 0.30 g/cm$^3$ or less, the holding sealing material tends not to be hard. Therefore, the winding property to the exhaust gas-treating body tends not to deteriorate, and the holding sealing material tends not to break.

The thickness of the holding sealing material of the embodiments of the present invention is preferably from about 3 mm to about 50 mm, and more preferably from about 6 mm to about 20 mm, although not limited thereto. In the case of the thickness of the holding sealing material of about 3 mm or more, the holding sealing material tends to have sufficient retention. If an exhaust gas purifying apparatus is manufactured by using the holding sealing material of this kind, the exhaust gas-treating body tends not to drop from the casing. In the case of the thickness of the holding sealing material of about 50 mm or less, the holding sealing material is not too thick. Therefore, the winding property to the exhaust gas-treating body tends not to deteriorate, and the holding sealing material tends not to break.

In the case that a binder is added in the holding material of the embodiments of the present invention, examples of the method for adding a binder in the holding sealing material include a method which includes approximately uniformly spraying a binder solution containing an organic binder and the like to the entire holding sealing material with a spray and the like.

Examples of the organic binder contained in the binder solution include an acrylic resin, rubber such as acrylic rubber, a water soluble organic polymer such as carboxymethyl cellulose or polyvinyl alcohol, a thermoplastic resin such as styrene resin, and a thermosetting resin such as an epoxy resin.

Among the examples, acrylic rubber, acrylonitrile-butadiene rubber, and styrene-butadiene rubber are in particular preferable.

The compounding amount of the organic binder is preferably from about 0.5% by weight to about 15% by weight relative to the total weight of the inorganic fibers, the organic binder and the inorganic binder.

In the case of the compounding amount of the organic binder of about 0.5% by weight or more relative to the total weight of the inorganic fibers, the organic binder and the inorganic binder, the amount of the organic binder is not too small, which tends not to cause scattering of the inorganic fibers. Therefore, the strength of the holding sealing material tends not to decrease. In the case of the compounding amount of the organic binder of about 15% by weight or less relative to the total weight of the inorganic fibers, the organic binder and the inorganic binder, if the holding sealing material is used in an electrically heating exhaust gas purifying apparatus, the amount of the discharged organic components derived from the organic binder in the discharged exhaust gas is not likely to be increased. This tends not to increase environmental burden.

The binder solution may contain a plurality of kinds of the aforementioned organic binders.

Moreover, as the binder solution, in addition to a latex formed by dispersing the organic binder in water, a solution or the like prepared by dissolving the organic binder in water or an organic solvent may be used.

In the case that an inorganic binder is contained in the binder solution, examples of the inorganic binder include alumina sol, silica sol, or the like.

The compounding amount of the inorganic binder is preferably from about 0.5% by weight to about 15% by weight relative to the total of the inorganic fibers, the organic binder and the inorganic binder, although the compounding amount is not particularly limited as long as it is more likely to combine the inorganic fibers.

In the case of the compounding amount of the inorganic binder of about 0.5% by weight or more relative to the total of the inorganic fibers, the organic binder and the inorganic binder, the amount of the inorganic binder is not too small, which tends not to cause scattering of the inorganic fibers. Therefore, the strength of the holding sealing material tends not to decrease. In the case of the compounding amount of the inorganic binder of about 15% by weight or less relative to the total of the inorganic fibers, the organic binder and the inorganic binder, the holding sealing material is not too hard, the holding sealing material tends not to break.

In the case that the holding sealing material of the embodiments of the present invention has been provided with a needling treatment, the needling treatment may be performed on the entire base mat or a part of the base mat.

The needling treatment may be performed before adding the binder to the holding sealing material, or may be performed after adding the binder to the holding sealing material.

The needling treatment may be performed with, for example, a needling machine. The needling machine includes a support plate for supporting the base mat and a needle board which is disposed at an upper side of the support plate and is capable of reciprocating in the punching direction (thickness direction of base mat). A large number of needles are attached to the needle board. The needle board is shifted on the base mat mounted on the support plate. By inserting and withdrawing the plurality of needles to and from the base mat, the inorganic fibers forming the base mat is more likely to be intricately entangled with one another.

The times of the needling treatment or the number of needles may be changed depending on the desired bulk density, the weight per unit area, or the like.

With regard to the holding sealing material forming the exhaust gas purifying apparatus of the embodiments of the present invention, the number of sheets of the holding sealing material is not particularly limited as long as the holding sealing material of the embodiments of the present invention is used, and one sheet of the holding sealing material may be used, or a plurality of sheets of the holding sealing materials mutually combined with one another may also be used.

Examples of the method for combining the plurality of holding sealing materials include a method in which the holding sealing materials are mutually stitched together with a sewing machine, a method in which holding sealing materials are mutually bonded to one another by using an adhesive tape, an adhesive material or the like, although not limited thereto.

The material for the casing forming the exhaust gas purifying apparatus of the embodiments of the present invention is not particularly limited as long as it is a metal having heat resistance, and specific examples of the material include metals such as stainless steel, aluminum and iron.

In the exhaust gas purifying apparatus of the embodiments of the present invention, the shape of the casing may be preferably prepared as a clam shell shape, a down-sizing type shape, or the like, in addition to an approximately cylindrical shape.

In the exhaust gas purifying apparatus of the embodiments of the present invention, the shape of the exhaust gas-treating body is not particularly limited as long as it is a pillar shape. In addition to an approximately round pillar shape, for example, a desired shape, such as an approximately cylindroid shape or a approximately rectangular pillar shape, with a desired size, may be used.

The exhaust gas-treating body forming the exhaust gas purifying apparatus of the embodiments of the present invention may be a honeycomb structure which includes a cordierite or the like and is integrally formed as shown in FIG. 7. The exhaust gas-treating body may also be a honeycomb structure including silicon carbide or the like, in which a plurality of pillar-shaped honeycomb fired bodies are bonded by interposing an adhesive layer mainly containing ceramic therebetween, each of the honeycomb fired bodies having a large number of through holes placed in parallel with one another in the longitudinal direction with a separation wall interposed therebetween. Moreover, the exhaust gas-treating body forming the exhaust gas purifying apparatus may be a metal-made exhaust gas-treating body.

In the case of using the exhaust gas purifying apparatus of the embodiments of the present invention as an electrically heated catalyst converter, a preferable material for the exhaust gas-treating body is a conductive ceramic such as phosphorus doped silicon carbide because of its excellent electric conductivity.

The exhaust gas-treating body forming the exhaust gas purifying apparatus of the embodiments of the present invention is not limited to a catalyst carrier, and may be, for example, a honeycomb structure in which a large number of cells are placed in parallel with one another in the longitudinal direction with a cell wall interposed therebetween, with either end of each cell sealed with a plug, and the like. In this case, the exhaust gas-treating body is more likely to function as a filter (DPF) capable of removing PM contained in exhaust gas.

In the exhaust gas purifying apparatus of the embodiments of the present invention, if a catalyst is supported on the exhaust gas-treating body forming the exhaust gas purifying apparatus, examples of the catalyst supported on the exhaust gas-treating body include noble metals such as platinum, palladium and rhodium. These catalysts may be used alone, or two or more kinds of these may be used in combination.

Examples of the catalyst also include alkali metals such as potassium and sodium, alkaline earth metals such as barium, metal oxides such as cerium oxide, and the like.

Examples of the method for supporting a catalyst on the exhaust gas-treating body include a method including heating the exhaust gas-treating body after having been impregnated with a solution containing a catalyst, a method including forming a catalyst supporting layer made of an alumina film on the surface of the exhaust gas-treating body and supporting a catalyst on the alumina film, and the like.

Examples of the method for forming the alumina film include a method in which the exhaust gas-treating body is heated after having been impregnated with a metal compound solution containing aluminum such as $Al(NO_3)_3$, or a method in which the exhaust gas-treating body is heated after having been impregnated with a solution containing alumina powder, and the like.

Moreover, as the method for supporting a catalyst on an alumina film, for example, a method may be used in which an exhaust gas-treating body on which an alumina film has been formed is impregnated with a solution containing noble metal, or the like, and then heated.

With regard to the holding sealing material and the exhaust gas purifying apparatus of the embodiments of the present invention, the essential feature is that a void is formed in the neighborhood of the first end face and the second end face of the void-formation section when the holding sealing material is rolled up to make the first end face of the contact section in contact with the second end face of the contact section. By appropriately combining the various structures described in the first to the fifth embodiments and other embodiments of the present invention (for example, size of the projected portion, composition of the inorganic fibers, kinds of sensor, and the like) with the essential feature, desired effects are more likely to be obtained.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A holding sealing material comprising:

inorganic fibers;

a mat shape;

a first end face and a second end face, the first end face and the second end face being approximately parallel in a width direction of the holding sealing material;

a contact section including a first portion of the holding sealing material, the first portion having a first distance between the first end face and the second end face, the first distance being longest in a length direction of the holding sealing material;

a void-forming section including a second portion of the holding sealing material, the second portion having a second distance between the first end face and the second end face, the second distance being shorter than the first distance of the contact section in the length direction of the holding sealing material; and the holding sealing material having a structure to provide a void in a vicinity of the first end face of the void-forming section and the second end face of the void-forming section in a state where the holding sealing material is rolled up so that the first end face of the contact section is made in contact with the second end face of the contact section, wherein at least one of the first end face and the second end face has a step formed by at least one projected portion, wherein a length of the projected portion in the void-forming section of the holding sealing material is shorter than a length of the projected portion in the contact section of the holding sealing material in the length direction of the holding sealing material, and wherein the length of the projected portion in the void-forming section of the holding sealing material is from about 1% to about 90% of the length of the projected portion in the contact section of the holding sealing material.

2. The holding sealing material according to claim 1, wherein at least one of the first end face and the second end face in the void-forming section of the holding sealing material has an end-face notch which is formed in the length direction of the holding sealing material.

3. A holding sealing material comprising:

inorganic fibers;

a mat shape;

a first end face and a second end face, the first end face and the second end face being approximately parallel in a width direction of the holding sealing material;

a contact section including a first portion of the holding sealing material, the first portion having a first distance between the first end face and the second end face, the first distance being longest in a length direction of the holding sealing material;

a void-forming section including a second portion of the holding sealing material, the second portion having a second distance between the first end face and the second end face, the second distance being shorter than the first distance of the contact section in the length direction of the holding sealing material; and the holding sealing material having a structure to provide a void in a vicinity of the first end face of the void-forming section and the second end face of the void-forming section in a state where the holding sealing material is rolled up so that the first end face of the contact section is made in contact with the second end face of the contact section, wherein at least one of the first end face and the second end face has a step formed by at least one projected portion, and wherein the projected portion in the void-forming section of the holding sealing material has a projected-portion notch which is formed in the length direction of the holding sealing material.

4. A holding sealing material comprising:

inorganic fibers;

a mat shape;

a first end face and a second end face, the first end face and the second end face being approximately parallel in a width direction of the holding sealing material;

a contact section including a first portion of the holding sealing material, the first portion having a first distance between the first end face and the second end face, the first distance being longest in a length direction of the holding sealing material;

a void-forming section including a second portion of the holding sealing material, the second portion having a second distance between the first end face and the second end face, the second distance being shorter than the first distance of the contact section in the length direction of the holding sealing material; and the holding sealing material having a structure to provide a void in a vicinity of the first end face of the void-forming section and the second end face of the void-forming section in a state where the holding sealing material is rolled up so that the first end face of the contact section is made in contact with the second end face of the contact section, wherein at least one of the first end face and the second end face has a step formed by at least one projected portion, wherein an end face opposite to the projected portion in the void-forming section of the holding sealing material has an opposite-portion notch which is formed in the length direction of the holding sealing material, and wherein a cross-sectional area of the opposite-portion notch in a direction approximately in parallel with a main face of the holding sealing material is from about 1% to about 90% of a cross-sectional area of the void-forming section without the opposite-portion notch.

5. The holding sealing material according to claim 1, further comprising a penetration portion penetrating the holding sealing material in a thickness direction of the holding sealing material.

6. The holding sealing material according to claim 3, wherein a cross-sectional area of the projected-portion notch in a direction approximately in parallel with a main face of the holding sealing material is from about 1% to about 90% of a cross-sectional area of the void-forming section without the projected-portion notch.

7. The holding sealing material according to claim 1, wherein a cross-sectional area of the void in a plane approximately in parallel with a main face of the holding sealing material is from about 1 $mm^2$ to about 10000 $mm^2$.

8. An exhaust gas purifying apparatus comprising:

a casing;

an exhaust gas-treating body housed in the casing;

a holding sealing material comprising:

inorganic fibers;

a mat shape;

a first end face and a second end face, the first end face and the second end face being approximately parallel in a width direction of the holding sealing material;

a contact section including a first portion of the holding sealing material, the first portion having a first distance between the first end face and the second end face, the first distance being longest in a length direction of the holding sealing material;

a void-forming section including a second portion of the holding sealing material, the second portion having a second distance between the first end face and the second end face, the second distance being shorter than the first distance of the contact section in the length direction of the holding sealing material;

the holding sealing material being wound around the exhaust gas-treating body so that the first end face of the contact section faces the second end face of the contact section; and the holding sealing material being disposed between the exhaust gas-treating body and the casing; and a void provided in a vicinity of the first end face and the second end face of the void-forming section in the holding sealing material, wherein at least one of the first end face and the second end face has a step formed by at least one projected portion, wherein a length of the projected portion in the void-forming section of the holding sealing material is shorter than a length of the projected portion in the contact section of the holding sealing material in the length direction of the holding sealing material, and wherein the length of the projected portion in the void-forming section of the holding sealing material is from about 1% to about 90% of the length of the projected portion in the contact section of the holding sealing material.

9. The exhaust gas purifying apparatus according to claim 8, further comprising:

at least one of an electrode member and a sensor which is connected to the exhaust gas-treating body, passes through the holding sealing material, and penetrates the casing, wherein the at least one of the electrode member and the sensor is disposed at the void of the holding sealing material.

10. The exhaust gas purifying apparatus according to claim 9, further comprising:

at least one of another electrode member and another sensor which is connected to the exhaust gas-treating body, passes through the holding sealing material, and penetrates the casing, wherein the holding sealing material has a penetration portion penetrating the holding sealing material in a thickness direction of the holding sealing material, and the at least one of another electrode member and another sensor is disposed at the penetration portion in the holding sealing material.

11. The exhaust gas purifying apparatus according to claim 8, wherein at least one of the first end face and the second end face in the void-forming section of the holding sealing material has an end-face notch which is formed in the length direction of the holding sealing material.

12. An exhaust gas purifying apparatus comprising:

a casing;

an exhaust gas-treating body housed in the casing;

a holding sealing material comprising:

inorganic fibers;

a mat shape;

a first end face and a second end face, the first end face and the second end face being approximately parallel in a width direction of the holding sealing material;

a contact section including a first portion of the holding sealing material, the first portion having a first distance between the first end face and the second end face, the first distance being longest in a length direction of the holding sealing material;

a void-forming section including a second portion of the holding sealing material, the second portion having a second distance between the first end face and the second end face, the second distance being shorter than the first distance of the contact section in the length direction of the holding sealing material;

the holding sealing material being wound around the exhaust gas-treating body so that the first end face of the contact section faces the second end face of the contact section; and the holding sealing material being disposed between the exhaust gas-treating body and the casing; and a void provided in a vicinity of the first end face and the second end face of the void-forming section in the holding sealing material, wherein at least one of the first end face and the second end face has a step formed by at least one projected portion, and wherein the projected portion in the void-forming section of the holding sealing material has a projected-portion notch which is formed in the length direction of the holding sealing material.

13. An exhaust gas purifying apparatus comprising:

a casing;

an exhaust gas-treating body housed in the casing;

a holding sealing material comprising:

inorganic fibers;

a mat shape;

a first end face and a second end face, the first end face and the second end face being approximately parallel in a width direction of the holding sealing material;

a contact section including a first portion of the holding sealing material, the first portion having a first distance between the first end face and the second end face, the first distance being longest in a length direction of the holding sealing material;

a void-forming section including a second portion of the holding sealing material, the second portion having a second distance between the first end face and the second end face, the second distance being shorter than the first distance of the contact section in the length direction of the holding sealing material;

the holding sealing material being wound around the exhaust gas-treating body so that the first end face of the contact section faces the second end face of the contact section; and the holding sealing material being disposed between the exhaust gas-treating body and the casing; and a void provided in a vicinity of the first end face and the second end face of the void-forming section in the holding sealing material, wherein at least one of the first end face and the second end face has a step formed by at least one projected portion, wherein an end face opposite to the projected portion in the void-forming section of the holding sealing material has an opposite-portion notch which is formed in the length direction of the holding sealing material, and wherein a cross-sectional area of the opposite-portion notch in a direction approximately in parallel with a main face of the holding sealing material is from about 1% to about 90% of a cross-sectional area of the void-forming section without the opposite-portion notch.

14. The exhaust gas purifying apparatus according to claim 8, wherein the holding sealing material has a penetration portion penetrating the holding sealing material in a thickness direction of the holding sealing material.

15. The exhaust gas purifying apparatus according to claim 12, wherein a cross-sectional area of the projected-portion notch in a direction approximately in parallel with a main face of the holding sealing material is from about 1% to about 90% of a cross-sectional area of the void-forming section without the projected-portion notch.

16. The exhaust gas purifying apparatus according to claim 8, wherein a cross-sectional area of the void in a plane approximately in parallel with a main face of the holding sealing material is from about 1 $mm^2$ to about 10000 $mm^2$.

17. The exhaust gas purifying apparatus according to claim 8, wherein the first end face and the second end face in the contact section of the holding sealing material contact each other without a gap.

18. The exhaust gas purifying apparatus according to claim 8, wherein the first end face and the second end face in the contact section of the holding sealing material form a gap with a predetermined size.

19. The exhaust gas purifying apparatus according to claim 18, wherein a distance between the first end face and the second end face in the contact section of the holding sealing material is about 80 mm or less.

20. A method for manufacturing an exhaust gas purifying apparatus, comprising:

providing a holding sealing material including inorganic fibers, the holding sealing material having a mat shape, the holding sealing material having a first end face and a second end face, the first end face and the second end face being approximately parallel in a width direction of the holding sealing material, the holding sealing material having a contact section including a first portion of the holding sealing material, the first portion having a first distance between the first end face and the second end face, the first distance being longest in a length direction of the holding sealing material, the holding sealing material having a void-forming section including a second portion of the holding sealing material, the second portion having a second distance between the first end face and the second end face, the second distance being shorter than the first distance of the contact section in the length direction of the holding sealing material;

winding the holding sealing material around an exhaust gas-treating body so that the first end face of the contact section faces the second end face of the contact section and so that a void is provided in a vicinity of the first end face and the second end face of the void-forming section in the holding sealing; and housing the exhaust gas-treating body in a casing to dispose the holding sealing material between the exhaust gas-treating body and the casing, wherein at least one of the first end face and the second end face has a step formed by at least one projected portion, wherein a length of the projected portion in the void-forming section of the holding sealing material is shorter than a length of the projected portion in the contact section of the holding sealing material in the length direction of the holding sealing material, and wherein the length of the projected portion in the void-forming section of the holding sealing material is from about 1% to about 90% of the length of the projected portion in the contact section of the holding sealing material.

21. The method according to claim 20, further comprising:

disposing at least one of an electrode member and a sensor at the void of the holding sealing material in a manner that the at least one of the electrode member and the sensor is connected to the exhaust gas-treating body, passes through the holding sealing material, and penetrates the casing.

22. The method according to claim 21, wherein the holding sealing material has a penetration portion penetrating the holding sealing material in the thickness direction of the holding sealing material is used as the holding sealing material, and the method further comprises disposing at least one of another electrode member and another sensor at the penetration portion in a manner that the at least one of another electrode member and another sensor is connected to the exhaust gas-treating body, passes through the holding sealing material, and penetrates the casing.

23. The method according to claim 20, wherein at least one of the first end face and the second end face in the void-forming section of the holding sealing material has an end-face notch which is formed in the length direction of the holding sealing material.

24. A method for manufacturing an exhaust gas purifying apparatus, comprising:

providing a holding sealing material including inorganic fibers, the holding sealing material having a mat shape, the holding sealing material having a first end face and a second end face, the first end face and the second end face being approximately parallel in a width direction of the holding sealing material, the holding sealing material having a contact section including a first portion of the holding sealing material, the first portion having a first distance between the first end face and the second end face, the first distance being longest in a length direction of the holding sealing material, the holding sealing material having a void-forming section including a second portion of the holding sealing material, the second portion having a second distance between the first end face and the second end face, the second distance being shorter than the first distance of the contact section in the length direction of the holding sealing material;

winding the holding sealing material around an exhaust gas-treating body so that the first end face of the contact section faces the second end face of the contact section and so that a void is provided in a vicinity of the first end face and the second end face of the void-forming section in the holding sealing; and housing the exhaust gas-treating body in a casing to dispose the holding sealing material between the exhaust gas-treating body and the casing, wherein at least one of the first end face and the second end face has a step formed by at least one projected portion, and wherein the projected portion in the void-forming section of the holding sealing material has a projected-portion notch which is formed in the length direction of the holding sealing material.

25. A method for manufacturing an exhaust gas purifying apparatus, comprising:

providing a holding sealing material including inorganic fibers, the holding sealing material having a mat shape, the holding sealing material having a first end face and a second end face, the first end face and the second end face being approximately parallel in a width direction of the holding sealing material, the holding sealing material having a contact section including a first portion of the holding sealing material, the first portion having a first distance between the first end face and the second end face, the first distance being longest in a length direction of the holding sealing material, the holding sealing material having a void-forming section including a second portion of the holding sealing material, the second portion having a second distance between the first end face and the second end face, the second distance being shorter than the first distance of the contact section in the length direction of the holding sealing material;

winding the holding sealing material around an exhaust gas-treating body so that the first end face of the contact section faces the second end face of the contact section and so that a void is provided in a vicinity of the first end face and the second end face of the void-forming section in the holding sealing; and housing the exhaust gas-treating body in a casing to dispose the holding sealing material between the exhaust gas-treating body and the casing, wherein at least one of the first end face and the second end face has a step formed by at least one projected portion, wherein an end face opposite to the projected portion in the void-forming section of the holding sealing material has an opposite-portion notch which is formed in the length direction of the holding sealing material, and wherein a cross-sectional area of the opposite-portion notch in a direction approximately in parallel with a main face of the holding sealing material is from about 1% to about 90% of the cross-sectional area of the void-forming section without the opposite-portion notch.

26. The method according to claim 20, wherein the holding sealing material has a penetration portion penetrating the holding sealing material in a thickness direction of the holding sealing material.

27. The method according to claim 24, wherein a cross-sectional area of the projected-portion notch in a direction approximately in parallel with a main face of the holding sealing material is from about 1% to about 90% of a cross-sectional area of the void-forming section without the projected-portion notch.

28. The method according to claim 20, wherein a cross-sectional area of the void in a plane approximately in parallel with a main face of the holding sealing material is from about 1 $mm^2$ to about 10000 $mm^2$.

29. The method according to claim 20, wherein the first end face and the second end face in the contact section of the holding sealing material contact each other without a gap.

30. The method according to claim 20, wherein the first end face and the second end face in the contact section of the holding sealing material form a gap with a predetermined size.

31. The method according to claim 30, wherein a distance between the first end face and the second end face in the contact section of the holding sealing material is about 80 mm or less.

* * * * *